US012747120B2

(12) United States Patent
Takasaki

(10) Patent No.: US 12,747,120 B2
(45) Date of Patent: Sep. 29, 2026

(54) IMAGE RECORDING DEVICE

(71) Applicant: BROTHER KOGYO KABUSHIKI KAISHA, Nagoya (JP)

(72) Inventor: Hironori Takasaki, Ogaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 212 days.

(21) Appl. No.: 18/624,632

(22) Filed: Apr. 2, 2024

(65) Prior Publication Data

US 2024/0327152 A1 Oct. 3, 2024

(30) Foreign Application Priority Data

Apr. 3, 2023 (JP) ..... 2023-060382

(51) Int. Cl.
*B65H 5/06* (2006.01)
*B65H 9/00* (2006.01)

(52) U.S. Cl.
CPC ..... *B65H 5/06* (2013.01); *B65H 9/004* (2013.01); *B65H 2301/162* (2013.01); *B65H 2301/331* (2013.01); *B65H 2301/446* (2013.01); *B65H 2301/515* (2013.01); *B65H 2551/21* (2013.01); *B65H 2801/06* (2013.01)

(58) Field of Classification Search
CPC .... B65H 5/06; B65H 9/004; B65H 2301/446; B65H 2301/515
See application file for complete search history.

(56) References Cited

U.S. PATENT DOCUMENTS 5,583,617 A * 12/1996 Altrieth, III ..... G03G 15/5016 399/81
6,750,878 B1 * 6/2004 Tatsuo ..... H04N 1/00411 715/705
6,920,613 B2 * 7/2005 Dorsey ..... H04N 1/32657 715/714
7,239,979 B1 * 7/2007 McComber ..... G06F 11/327 714/45
7,403,721 B2 * 7/2008 Yamada ..... G03G 15/502 399/9
11,897,256 B2 * 2/2024 Chiba ..... B41J 13/0018
2021/0197582 A1 7/2021 Yoshiaki et al.
(Continued)

FOREIGN PATENT DOCUMENTS

EP 0699966 B1 * 8/2006 ..... G03G 15/55
JP 8-91658 A 4/1996
JP H11292360 A * 10/1999
(Continued)

*Primary Examiner* — Christle I Marshall
(74) *Attorney, Agent, or Firm* — Merchant & Gould P.C.

(57) ABSTRACT

An image recording device includes: a conveyer configured to convey a sheet set in a first feeding tray in a state in which the sheet is wound in a roll shape to serve as a roll sheet; a recording device configured to record an image on the sheet conveyed by the conveyer; a display; and a controller. The controller is configured to execute: a process of stopping conveyance of the sheet in response to detection of an abnormality in the sheet after the conveyance of the sheet is started; and a process of causing the display to display thereon at least one object display screen which indicates, by an object, a target location to restore the abnormality in the sheet to a normal state.

16 Claims, 37 Drawing Sheets

(56) References Cited

U.S. PATENT DOCUMENTS

| | | | | |
|---|---|---|---|---|
| 2023/0286296 | A1* | 9/2023 | Yamaguchi | B41J 11/663 |
| 2023/0286771 | A1* | 9/2023 | Yamaguchi | B65H 35/002 |

FOREIGN PATENT DOCUMENTS

| | | | | |
|---|---|---|---|---|
| JP | 2002-326412 | A | | 11/2002 |
| JP | 2003223081 | A | * | 8/2003 |
| JP | 2005-179019 | A | | 7/2005 |
| JP | 2015-085531 | A | | 5/2015 |
| JP | 2021-107134 | A | | 7/2021 |

* cited by examiner (FIG. 6 CONTINUED)
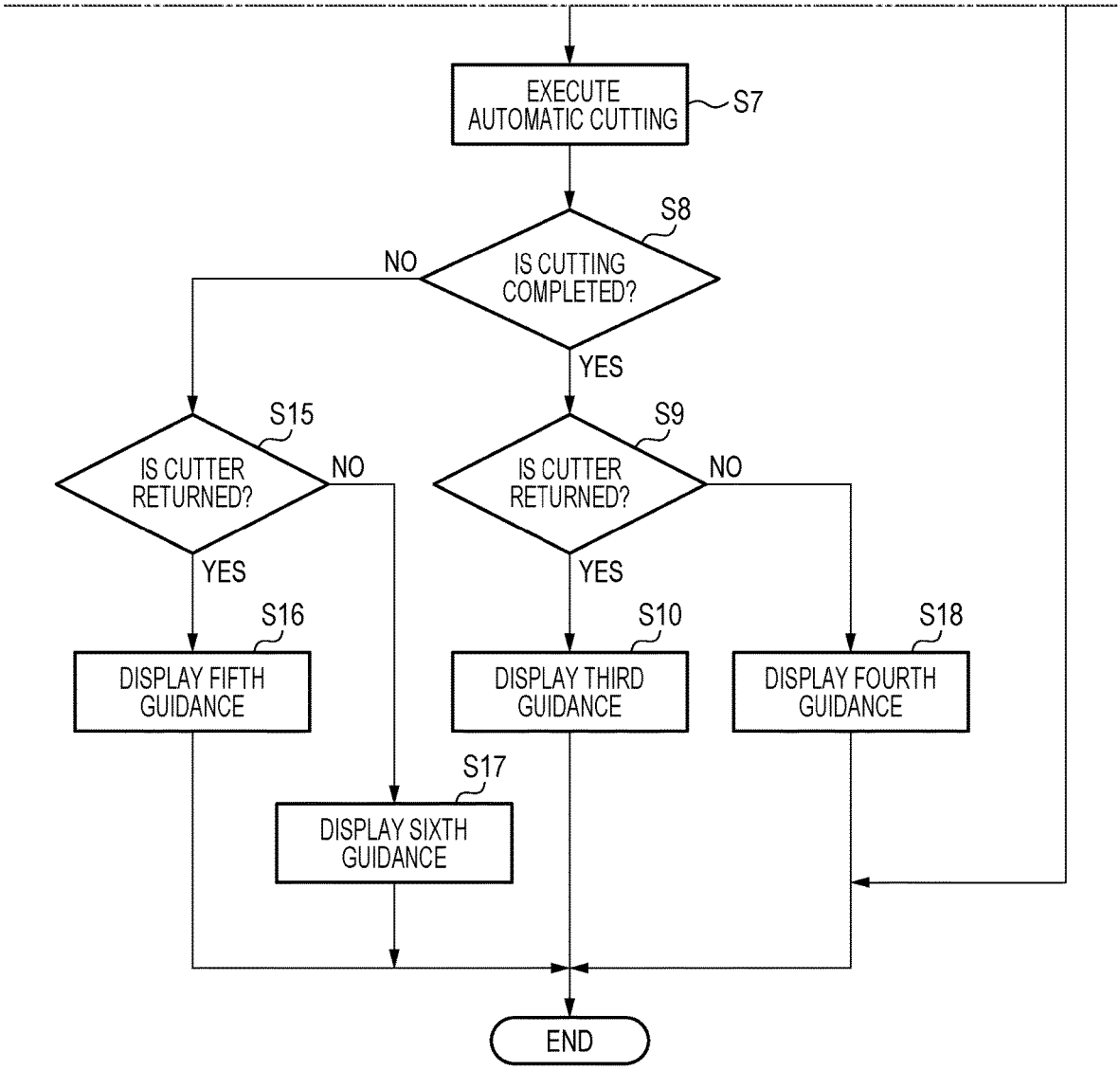

IMAGE RECORDING DEVICE

REFERENCE TO RELATED APPLICATIONS

This application claims priority from Japanese Patent Application No. 2023-060382 filed on Apr. 3, 2023. The entire content of the priority application is incorporated herein by reference.

BACKGROUND ART

The present disclosure relates to an image recording device capable of displaying a procedure of fixing a conveyance jam of a sheet wound in a roll shape.

JPH08-091658A discloses a roll paper feeding device that automatically cuts a sheet pulled out from roll paper when a conveyance jam of the sheet is detected. The cut sheet can be removed from a conveyance path when nipping by a conveyance roller is released. A message prompting removal of the sheet remaining in the conveyance path is displayed on a display.

DESCRIPTION

A sheet removal method differs depending on a cut state of whether the sheet is cut or not when the conveyance jam occurs and a position of the sheet in the conveyance path. However, it is difficult for a user to accurately grasp whether the sheet is cut and the position of the sheet.

The present disclosure has been made in view of the above circumstances, and an object of the present disclosure is to provide an image recording device capable of guiding an appropriate removal method in accordance with a sheet situation.

(1) An image recording device of the present disclosure includes: a conveyer configured to convey a sheet set in a first feeding tray in a state in which the sheet is wound in a roll shape to serve as a roll sheet; a recording device configured to record an image on the sheet conveyed by the conveyer; a display; and a controller. The controller is configured to execute: a process of stopping conveyance of the sheet in response to detection of an abnormality in the sheet after the conveyance of the sheet is started; and a process of causing the display to display thereon at least one object display screen which indicates, by an object, a target location to restore the abnormality in the sheet to a normal state.

In response to detection of the abnormality in the sheet, the object display screen indicating the target location for restoring the abnormality in the sheet to the normal state is displayed on the display, and thus the user can easily understand means for fixing the conveyance jam.

(2) The controller may cause the display to display thereon guidance data including the at least one object display screen and a notification indicating occurrence of the abnormality in the sheet.

The user can be notified of occurrence of the abnormality.

(3) The abnormality in the sheet may be a conveyance jam of the sheet.

(4) The image recording device may further include a second feeding tray configured to allow a plurality of sheets to be set in a stacked state. The controller may be configured to cause the display to display thereon which of the first feeding tray or the second feeding tray the sheet causing the conveyance jam is fed from.

The user can easily grasp whether the conveyance jam is caused by the roll sheet or the conveyance jam is caused by the stacked sheet.

(5) The guidance data may include a notification indicating occurrence of an abnormality in cutting of the sheet.

(6) The image recording device may further include a first sensor configured to detect a presence or absence of the sheet at a first detection position in a conveyance path in which the sheet is conveyed from the first feeding tray by the conveyer. The conveyer may include: a feeder configured to feed the sheet from the first feeding tray to the conveyance path; and a first roller pair configured to convey the sheet in the conveyance path. The controller may be configured to cause, in response to determining that the sheet does not reach the first detection position based on a signal obtained from the first sensor after driving the feeder, the display to display thereon a first guidance as the guidance data, the first guidance comprising the at least one object display screen. The at least one object display screen in the first guidance may include: a screen indicating that the first feeding tray is extracted from a housing; and a screen for resetting the roll sheet the first feeding tray.

In a case in which the sheet fed to the conveyance path by the feeder is jammed in the conveyance path before reaching the first detection position, the user can easily understand the means for fixing the conveyance jam by the first guidance displayed on the display.

(7) The first guidance may include a screen indicating that a leading end of the sheet is cut.

The user can easily understand that the leading end of the sheet, which is folded or the like, is to be cut.

(8) The first feeding tray may define a passage extending from a setting position of the roll sheet in a feeding direction of the sheet. The first guidance may include a screen indicating that the leading end of the sheet, which has entered the passage, is set at a setting position.

The user can easily understand that when the roll sheet is reset in the first feeding tray, the leading end of the sheet is set at the setting position, whereby the roll sheet is ready to be fed and conveyed in the image recording device.

(9) The first feeding tray may include a side guide configured to move in a direction intersecting the feeding direction to contact the sheet passing through the passage. The first guidance may include a screen indicating that the side guide is moved.

The user can easily understand that when the roll sheet is reset in the first feeding tray, the side guide is to be moved in accordance with the sheet.

(10) The image recording device may further include: a second roller pair provided downstream of the first roller pair in a conveyance direction in the conveyance path; and a second sensor provided upstream of the second roller pair in the conveyance direction in the conveyance path and configured to detect a presence or absence of the sheet at a second detection position in the conveyance path upstream of the second roller pair in the conveyance direction. The controller may be configured to cause the display to display thereon a second guidance as the guidance data, in response to determining, after driving the feeder, based on signals obtained from the first sensor and the second sensor that the sheet is nipped and held by the first roller pair but does not reach the second roller pair. The at least one object display screen in the second guidance includes: a screen indicating release of nipping of the sheet by the first roller pair; the screen indicating that the first feeding tray is extracted from the housing; and a screen indicating that the roll sheet is reset in the first feeding tray.

In a case in which the sheet fed to the conveyance path by the feeder is jammed in the conveyance path before reaching the second detection position, the user can easily understand the means for fixing the conveyance jam by the second guidance displayed on the display.

(11) The housing may include a first cover configured to open a part of the conveyance path to the outside, the part of the conveyance path at which the first roller pair is provided. One roller of the first roller pair may be configured to be separate, by moving together with the first cover, from another roller of the first roller pair. The at least one object display screen in the second guidance may include a screen for opening the first cover to release the nipping of the sheet by the first roller pair.

The user can easily understand that the nipping of the sheet by the first roller pair is released by opening the first cover.

(12) The image recording device may further include: a third sensor provided downstream of the second sensor in the conveyance direction in the conveyance path and configured to detect a presence or absence of the sheet at a third detection position in the conveyance path downstream of the second roller pair in the conveyance direction; and a discharge tray configured to be attached to and detached from the housing and support the sheet discharged from the conveyance path. The controller may be configured to cause the display to display thereon a third guidance as the guidance data, in response to: determining, after driving the feeder, based on signals obtained from the first sensor and the second sensor, that the sheet is nipped and held by the first roller pair and the second roller pair; and determining, after driving the feeder, based on a signal obtained from the third sensor, a conveyance jam of the sheet occurs. The at least one object display screen in the third guidance may include: the screen indicating release of nipping of the sheet by the first roller pair; a screen indicating that the discharge tray is detached from the housing to remove the sheet from the conveyance path; a screen indicating that the first feeding tray is extracted from the housing; and a screen indicating that the roll sheet is reset in the first feeding tray.

When the sheet is jammed downstream of the second roller pair in the conveyance direction, the user can easily understand the means for fixing the conveyance jam by the third guidance displayed on the display.

(13) The image recording device may further include: a cutter carriage provided upstream of the first roller pair in the conveyance direction in the conveyance path and configured to move in a movement direction intersecting the conveyance direction; a cutter mounted on the cutter carriage; and an input device. The controller may be configured to cause the display to display thereon the third guidance after moving the cutter carriage in accordance with a command input to the input device.

After the sheet is cut by the cutter when the conveyance jam occurs, the user can easily understand the means for fixing the conveyance jam by the third guidance displayed on the display.

(14) The image recording device may further include: a fourth sensor configured to detect the cutter carriage being located at a first position, the first position being one end in the movement direction; and a fifth sensor configured to detect the cutter carriage being located at a second position, the second position being another end in the movement direction. The housing may further include a second cover configured to open the cutter carriage to the outside. The controller may be configured to cause the display to display thereon a fourth guidance as the guidance data in response to causing the cutter carriage to move and determining, based on signals obtained from the fourth sensor and the fifth sensor, that the cutter carriage is not moved to the first position after being moved from the first position to the second position. The at least one object display screen in the fourth guidance may include a screen indicating that the second cover is opened and the cutter carriage is moved to the first position.

In a state in which the cutter carriage does not return to the first position after the cutter cuts the sheet, the user can understand that the cutter carriage is to be returned to the first position by the fourth guidance.

(15) The image recording device may further include: a fourth sensor configured to detect the cutter carriage being located at a first position, the first position being one end in the movement direction; and a fifth sensor configured to detect the cutter carriage being located at a second position, the second position being another end in the movement direction. The housing may further include a second cover configured to open the cutter carriage to the outside. The controller may be configured to cause the display to display thereon a fifth guidance as the guidance data in response to causing the cutter carriage to move and determining, based on signals obtained from the fourth sensor and the fifth sensor, that the cutter carriage is moved to the first position without being moved from the first position to the second position. The at least one object display screen in the fifth guidance may include a screen indicating that the second cover is opened and the sheet is cut.

In a state in which the cutter carriage returns to the first position without cutting the sheet by the cutter, the user can understand that the sheet is to be cut by himself by the fifth guidance.

(16) The image recording device may further include: a fourth sensor configured to detect the cutter carriage being located at a first position, the first position being one end in the movement direction; and a fifth sensor configured to detect the cutter carriage being located at a second position, the second position being the other end in the movement direction. The housing may further include a second cover configured to open the cutter carriage to the outside. The controller may be configured to cause the display to display thereon a sixth guidance as the guidance data in response to causing the cutter carriage to move and determining, based on signals obtained from the fourth sensor and the fifth sensor, that the cutter carriage is not moved from the first position to the second position and is not moved to the first position. The at least one object display screen in the sixth guidance may include a screen indicating that the second cover is opened, the cutter carriage is moved to the first position, and the sheet is cut.

In a state in which the cutter does not cut the sheet and the cutter carriage does not return to the first position, the user can understand that the cutter carriage is to be returned to the first position and the sheet is to be cut by himself by the sixth guidance.

According to the present disclosure, an appropriate sheet removal method is guided.

Figure 1:
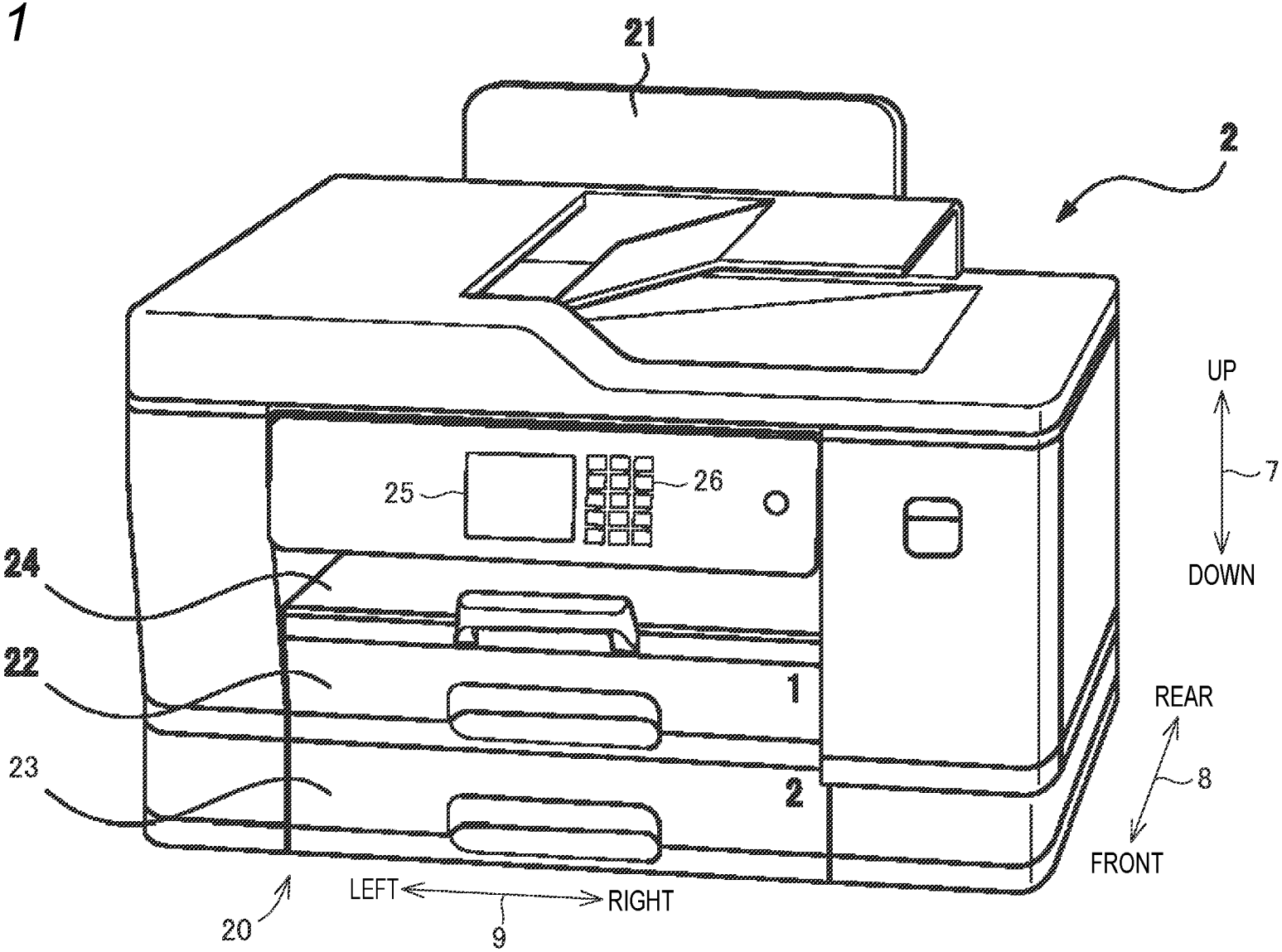
FIG. 1 is an external perspective view of an image recording device 2.

Hereinafter, an embodiment of the present disclosure will be described. The present embodiment is merely one embodiment of the present disclosure, and it is needless to say that the embodiment can be modified without changing the scope of the present invention. In the following description, an advancement movement from a start point to an end point of an arrow is expressed as an "orientation", and a unidirectional or bidirectional movement along a line connecting the start point and the end point of the arrow is expressed as a "direction". In the following description, an up-down direction 7 is defined based on a state in which an image recording device 2 is installed to be usable (a state in FIG. 1). A front-rear direction 8 is defined with a side on which a discharge tray 24 is provided as a near side (a front side). When the image recording device 2 is viewed from the near side (the front side), a left-right direction 9 is defined. In the present embodiment, the word "image" means a recorded object to be recorded on a sheet by ink discharged from a recording unit 6, or a figure drawn on a screen displayed on a display 25. Further, the word "screen" means a display object to be drawn on the display 25 provided in the image recording device 2. In addition, "setting" a roll sheet 46 includes "placing" the roll sheet 46 and "attaching" the roll sheet 46 to the image recording device 2 (including various sheet feeding trays 20).

Overall Configuration of Image Recording Device 2

Figure 2:
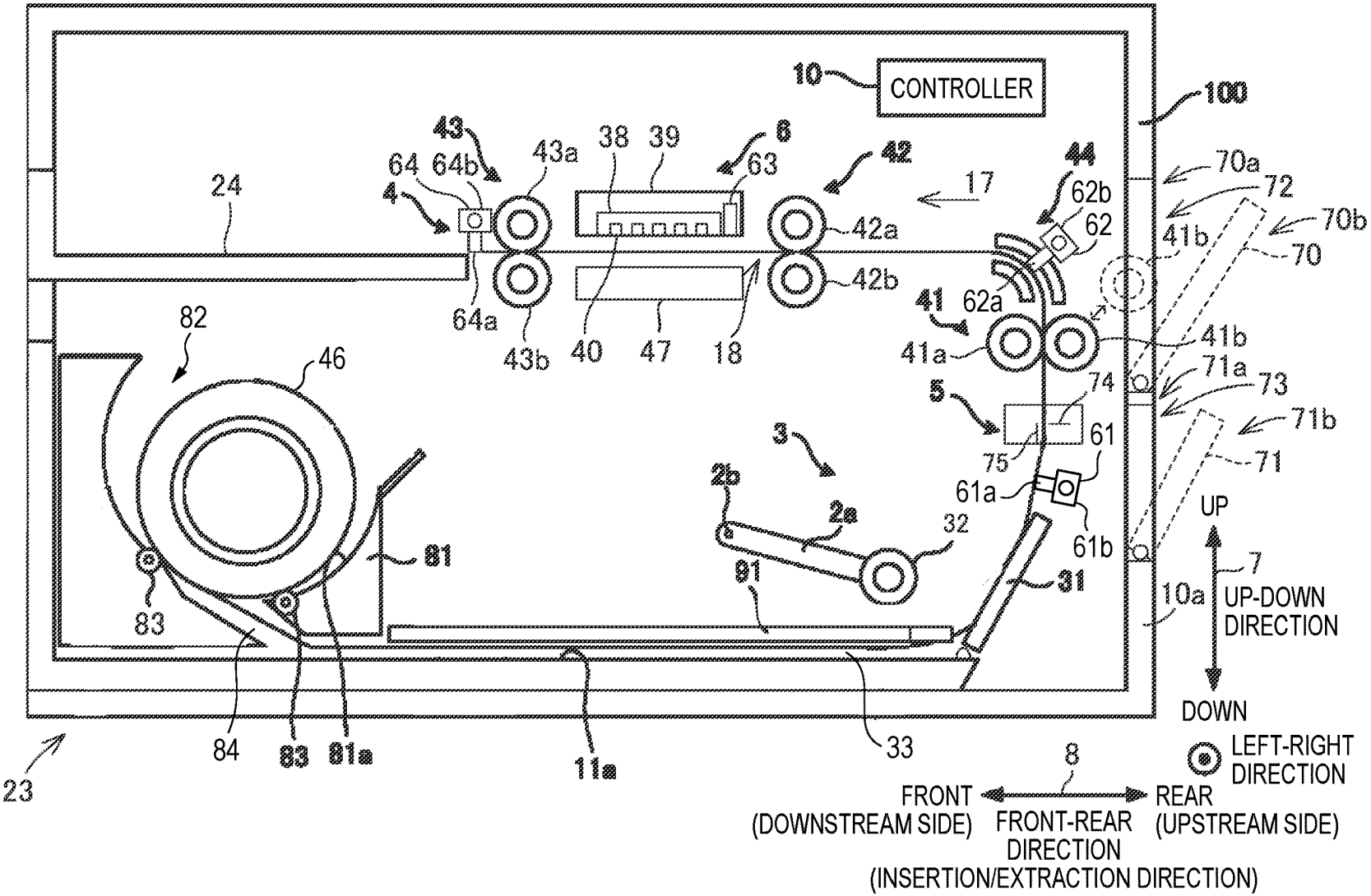
FIG. 2 is a longitudinal sectional view schematically illustrating an internal structure of the image recording device 2.

As illustrated in FIGS. 1 and 2, the image recording device 2 is formed in a substantially rectangular parallelepiped shape. The image recording device 2 is, for example, an ink jet printer, and records an image by ejecting ink onto a sheet. The image recording device 2 includes a housing 100, a sheet feeding tray 20, a conveyance portion 4, a cutter 5, the recording unit 6, the discharge tray 24, a first registration sensor 61 (an example of a first sensor), a second registration sensor 62 (an example of a second sensor), a media sensor 63 (an example of a third sensor), a discharge sensor 64 (see FIG. 4), a start point sensor 65 (an example of a fourth sensor, see FIG. 4), a turning point sensor 66 (an example of a fifth sensor, see FIG. 4), an operation panel 26 (an example of an input unit), the display 25, and a controller 10. As illustrated in FIG. 2, the housing 100 defines an outer periphery of the image recording device 2. The housing 100 is a box that has a rectangular parallelepiped shape. Regarding the housing 100, as illustrated in FIG. 2, the housing 100 includes a first cover 70 (also referred to as "REAR COVER A") and a second cover 71 (also referred to as "REAR COVER B").

First Cover 70

The first cover 70 is provided at an upper portion of a rear wall 10*a* (above the second cover 71) that defines the rear of the housing 100. An outer shape of the first cover 70 in a side view is rectangular. A lower end of the first cover 70 is axially supported by the rear wall 10*a*. The first cover 70 is rotatable toward the up-down direction 7 and the front-rear direction 8. The first cover 70 is rotatable between a close position 70*a* at which a main surface of the first cover 70 faces the front-rear direction 8 and an open position 70*b* at which the main surface of the first cover 70 faces the up-down direction 7 and the front-rear direction 8. At the open position 70*b*, the first cover 70 opens an opening 72. The inside of the housing 100 is exposed to the outside via the opening 72. At the close position 70*a*, the opening 72 is closed by the first cover 70.

Second Cover 71

The second cover 71 is provided at a lower portion of the rear wall 10*a* (below the first cover 70) of the housing 100. An outer shape of the second cover 71 in a side view is rectangular. A lower end of the second cover 71 is axially supported by the rear wall 10*a*. The second cover 71 is rotatable toward the up-down direction 7 and the front-rear direction 8. The second cover 71 is rotatable between a close position 71*a* at which a main surface of the second cover 71 faces the front-rear direction 8 and an open position 71*b* at which the main surface of the second cover 71 faces the up-down direction 7 and the front-rear direction 8. At the open position 71*b*, the second cover 71 opens an opening 73. The inside of the housing 100 is exposed to the outside via the opening 73. At the close position 71*a*, the opening 73 is closed by the second cover 71.

Sheet Feeding Tray 20

Figure 3:
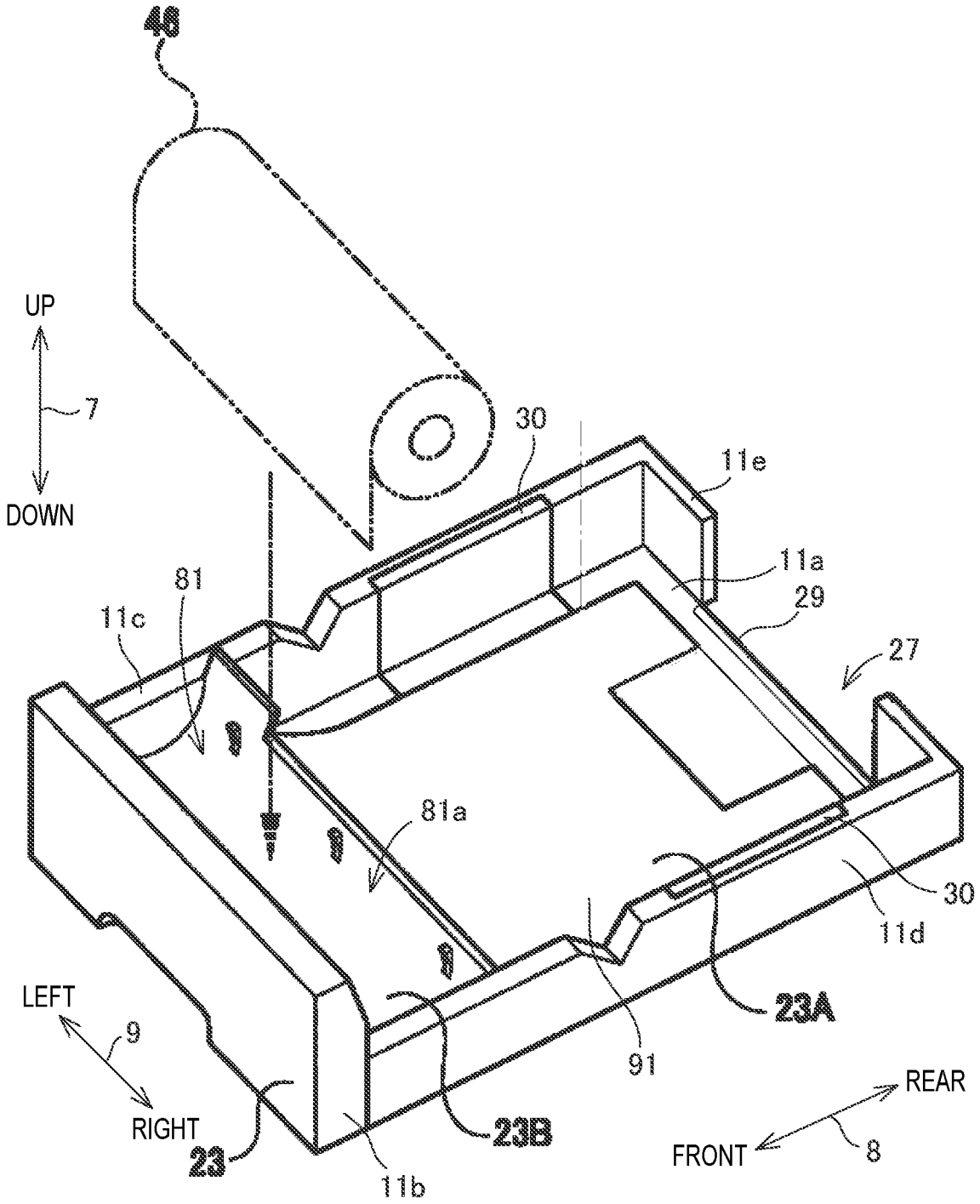
FIG. 3 is a schematic perspective view of a second tray 23.

As illustrated in FIGS. 1 to 3, the sheet feeding tray 20 is provided at a lower portion of the image recording device 2. In the present embodiment, the sheet feeding tray 20 refers to the sheet feeding tray 20 including three types of trays. Specifically, the three types of trays included in the sheet feeding tray 20 include a multipurpose tray 21, a first tray 22 (an example of a second feeding tray, also referred to as a "PAPER TRAY 1"), and a second tray 23 (an example of a first feeding tray, also referred to as a "PAPER TRAY 2"). The multipurpose tray 21 refers to the sheet feeding tray 20 that is fixed to the housing 100 of the image recording device 2. The multipurpose tray 21 allows a plurality of cut sheets to be fed from a rear end side of the image recording device 2. The cut sheet is, for example, a sheet cut into a standard size (for example, A4). In FIG. 3, the second tray 23 is representatively shown as the sheet feeding tray 20.

The first tray 22 and the second tray 23 are trays that can be inserted into and extracted from the housing 100 (see FIG. 2) of the image recording device 2. The first tray 22 is a tray capable of accommodating the plurality of cut sheets. The second tray 23 is a tray including a first region 23A and a second region 23B capable of accommodating a sheet wound in a roll shape (hereinafter, also referred to as the roll sheet 46) and a plurality of cut sheets, respectively. The second tray 23 can be inserted into and extracted from the housing 100 of the image recording device 2 in the front-rear direction 8. As illustrated in FIGS. 2 and 3, the second tray 23 is a box having an opening on an upper surface. In the following description, the second tray 23 in which the roll sheet 46 is set is mainly described as a component of the sheet feeding tray 20. The extracted state of the sheet feeding tray 20 (the first tray 22 and the second tray 23) in the present disclosure may include a state in which the feeding tray 20 is completely extracted from the housing 100 or may include a state in which the feeding tray 20 is not completely extracted (that is, partially extracted) from the housing 100.

As illustrated in FIG. 3, the second tray 23 includes a bottom surface 11*a* that faces a main surface in the up-down direction 7 and has a rectangular outer shape in a planar view, and a front wall 11*b*, a left wall 11*c*, a right wall 11*d*, and a rear wall 11*e* which stand upward from four bottom sides. The rear wall 11*e* has an opening 27 penetrating the rear wall 11*e* in the front-rear direction 8. An outer shape of the opening 27 on the rear wall 11*e* in a side view is rectangular. A width of the rear wall 11*e* in the left-right direction 9 is larger than that of the roll sheet 46. As a result, the roll sheet 46 can pass through the opening 27 rearward. As illustrated in FIGS. 2 and 3, the second tray 23 includes a support base 81, a support plate 91, a passage 33, a protrusion 29, and side guides 30.

Support Base 81

The support base 81 is provided at an end portion of the second tray 23 on the front side. The support base 81 has a rectangular parallelepiped shape in which an upper surface 81*a* is recessed, and both ends thereof in the left-right direction 9 are supported by side surfaces of the right wall 11*d* and the left wall 11*c*. A lower surface of the support base 81 is spaced from the bottom surface 11*a* of the second tray 23. A recess 82 recessed downward is provided on the upper surface 81*a* of the support base 81. An upper surface of the recess 82 is a circumferential surface recessed downward. A diameter of the upper surface of the recess 82 is larger than an outer diameter of the wound sheet (the roll sheet 46). In addition, the roll sheet 46 inserted from above is set in the recess 82. The roll sheet 46 is set on the upper surface of the recess 82. A mode of "setting" the roll sheet 46 includes, for example, a mode of "placing" the roll sheet 46 and a mode of rotatably "attaching" the roll sheet 46 to the multipurpose tray 21 or the like.

On the upper surface of the recess 82, a plurality of roller pairs are provided along the left-right direction 9. Each of the roller pairs includes a pair of rollers 83 separated from each other in the front-rear direction 8. Each of the rollers 83 is disposed such that an axial direction of each roller 83 extends along the left-right direction 9. An outer circumferential surface of each of the rollers 83 contacts an outer circumferential surface of the roll sheet 46. The pair of rollers 83 are located away from each other in the front-rear direction 8. A plurality of rollers 83 are located along the left-right direction 9. The rollers 83 rotate as the roll sheet 46 rotates.

A pull-out hole 84 is formed on the upper surface of the recess 82. The pull-out hole 84 extends to both ends of the support base 81 in the left-right direction 9. The pull-out hole 84 extends rearward and downward from the vicinity of a lowermost position on the upper surface of the recess 82, and extends from the upper surface of the recess 82 to the lower surface of the support base 81. An upper end of the pull-out hole 84 is located between the pair of rollers 83. The sheet pulled out from the roll sheet 46 is inserted through the pull-out hole 84. The pull-out hole 84 is a part of the passage 33 to be described later.

Support Plate 91

The support plate 91 is a plate that is provided between the rear of the support base 81 and the rear wall 11*e*. An outer shape of the support plate 91 in a planar view is substantially rectangular, and a central portion of a rear end portion in the left-right direction 9 is recessed forward to form a rectangular shape. At the rear end portion of the support plate 91, for example, a recess having an outer shape recessed in a rectangular shape from a rear end in a planar view is formed. Left and right ends of the support plate 91 are separated from the left wall 11*c* and the right wall 11*d*. The rear end of the support plate 91 is separated from the rear wall 11*e*. The lower surface of the support plate 91 is separated upward from the bottom surface 11*a* of the second tray 23. A front end of the support plate 91 is connected to a rear surface of the support base 81.

Passage 33

The passage 33 is formed between the lower surface of the support plate 91 and the bottom surface 11*a* of the second tray 23. The passage 33 extends from a second region 23B to the rear end of the support plate 91. Both ends in the left-right direction 9 and a rear end of the passage 33 are open. A front end of the passage 33 is a connection position between the pull-out hole 84 and the second region 23B. In the passage 33, the sheet inserted through the pull-out hole 84 from the roll sheet 46 reaches the rear of the support plate 91 through the passage 33.

A dimension of the support plate 91 in the left-right direction 9 is smaller than a dimension of the roll sheet 46 in the left-right direction 9. Left and right ends of the roll sheet 46 are located outside both ends of the support plate 91 in the left-right direction 9.

Protrusion 29

The protrusion 29 protrudes upward from the bottom surface 11*a* of the second tray 23. The protrusion 29 is provided at a rear end edge of the bottom surface 11*a*. For example, the protrusion 29 extends in the left-right direction 9 along a position of the opening 27 of the rear wall 11*e*. An upper surface of the protrusion 29 has, for example, a shape that allows the leading end of the sheet, which is fed (supplied) through the passage 33, to ride over. The upper surface of the protrusion 29 has, for example, an arch shape curved in the front-rear direction 8. In a conveyance direction of the roll sheet 46, the protrusion 29 is positioned on the downstream side of a position at which a feeding roller 32 is allowed to contact the roll sheet 46. That is, a state in which the leading end of the roll sheet 46 is positioned to contact the protrusion 29 means a state in which the leading end of the roll sheet 46 is positioned at a setting position at which the roll sheet 46 can be fed by the feeding roller 32. The user can understand that the leading end of the roll sheet 46 is set at the setting position not only by visually recognizing the leading end of the roll sheet 46 contacting the protrusion 29, but also by feeling an impact or hearing a sound caused by the leading end of the roll sheet 46 contacting (hitting) the protrusion 29.

Side Guides 30

Each side guide 30 is a plate whose main surface is oriented in the left-right direction 9. The pair of side guides 30 are located outside both ends of the support plate 91 in the left-right direction 9. Upper ends of the side guides 30 are at substantially the same positions as upper ends of the left wall 11*c* and the right wall 11*d*. The side guides 30 are movable in a direction approaching each other or a direction separating from each other along the left-right direction 9. The side guides 30 are moved along the left-right direction 9 in accordance with a width of the sheet in the left-right direction 9, and position the sheet in the left-right direction 9 by contacting left and right ends of the sheet. The pair of side guides 30 are mutually movable by, for example, a rack and pinion mechanism (not shown). The side guides 30 are moved to contact the sheet pulled out to the passage 33 from the roll sheet 46 set in the recess 82, for example.

Conveyance Portion 4

The conveyance portion 4 conveys the roll sheet 46 set in the sheet feeding tray 20. The conveyance portion 4 feeds the sheet from the sheet feeding tray 20 (the second tray 23). The conveyance portion 4 conveys the fed sheet to the recording unit 6. The conveyance portion 4 discharges the sheet on which the image is recorded by the recording unit 6 toward the discharge tray 24. Specifically, the conveyance portion 4 conveys the sheet rearward from the second tray 23. The conveyance portion 4 defines a conveyance path 18 for conveying the sheet from a rear side to an upper side and then conveying the sheet from the upper side to the front side (hereinafter, a conveyance direction of the sheet in the conveyance path 18 is also referred to as a conveyance direction 17). The conveyance portion 4 includes a feeding portion 3, an intermediate roller pair 41 (an example of a first roller pair), a guide member 44, a conveyance roller pair 42 (an example of a second roller pair), and a discharge roller pair 43.

Feeding Portion 3

As illustrated in FIG. 2, the feeding portion 3 is provided above the sheet feeding tray 20 in a state of being attached to the housing 100. The feeding portion 3 includes the feeding roller 32 and a guide piece 31.

Feeding Roller 32

The feeding roller 32 feeds the sheet pulled out from the roll sheet 46 set in the recess 82 of the support base 81.

The feeding roller 32 is axially supported by a tip end of an arm 2*a*. The arm 2*a* is rotatably supported by a support shaft 2*b*. The support shaft 2*b* is supported by the housing 100. The arm 2*a* is urged by an urging member (not shown) such that the feeding roller 32 approaches the bottom surface 11*a* of the sheet feeding tray 20. When the arm 2*a* rotates around the support shaft 2*b*, the feeding roller 32 rotates around an axis extending along the left-right direction 9 by driving of a conveying motor 120. The feeding roller 32 rotates to apply a conveying force in a direction from the front side to the rear side to the sheet in contact therewith. When the feeding roller 32 rotates, the sheet contacting the feeding roller 32 is fed in a backward direction (an example of a feeding direction).

Guide Piece 31

The guide piece 31 is a plate that is inclined such that an end portion on the rear side is located above an end portion on the front side. The guide piece 31 is provided on the rear side of the rear wall 11*e* of the second tray 23 and at the center in the left-right direction 9 when the second tray 23 is inserted into the housing 100. The sheet pulled out from the roll sheet 46 is guided obliquely upward along a surface of the guide piece 31.

Intermediate Roller Pair 41

The intermediate roller pair 41 includes a drive roller 41*a* that is rotated by the driving of the conveying motor 120 (see FIG. 5), and a driven roller 41*b* (an example of one first roller) that is rotated together with the drive roller 41*a*. The intermediate roller pair 41 is provided above the guide piece 31. The intermediate roller pair 41 nips the sheet guided by the guide piece 31 and then conveys the sheet upward.

The driven roller 41*b* is axially supported by the first cover 70. The driven roller 41*b* contacts an outer circumferential surface of the drive roller 41*a* by closing the first cover 70. The driven roller 41*b* is released from the contact with the drive roller 41*a* by opening the first cover 70, and moves rearward in accordance with the rotation of the first cover 70 (see FIG. 2). That is, the nipping by the intermediate roller pair 41 is released by opening the first cover 70. Further, the drive roller 41*a* is exposed from the opening 72 by opening the first cover 70.

Guide Member 44

The guide member 44 is provided above the intermediate roller pair 41. As illustrated in FIG. 2, the guide member 44 is disposed on the upstream side of the recording unit 6 provided in the housing 100 and is disposed adjacent to the intermediate roller pair 41. The guide member 44 forms, inside the guide member 44, a curved path (a part of the conveyance path 18) that extends from a lower side to the front side.

Conveyance Roller Pair 42

The conveyance roller pair 42 includes a conveyance roller 42*a* that is rotated by the driving of the conveying motor 120, and a pinch roller 42*b* that is rotated together with the conveyance roller 42*a*. The conveyance roller pair 42 is provided downstream of the intermediate roller pair 41 in the conveyance direction 17. The conveyance roller pair 42 is provided on the upstream side of the discharge tray 24. The conveyance roller pair 42 nips the sheet conveyed by the intermediate roller pair 41 and conveys the sheet to a downstream side of the conveyance direction 17. The conveyance roller pair 42 conveys the sheet to the recording unit 6 provided on the downstream side of the conveyance direction 17.

Discharge Roller Pair 43

The discharge roller pair 43 includes a discharge roller 43*a* that is rotated by the driving of the conveying motor 120, and a pinch roller 43*b*. The conveyance roller pair 42 and the discharge roller pair 43 are provided above the sheet feeding tray 20 and are arranged from the rear side to the front side. The discharge roller pair 43 is provided in front of a head 39.

When the conveying motor 120 is driven under the control of the controller 10, the intermediate roller pair 41 rotates while nipping and holding the sheet therebetween, and conveys the sheet upward. The conveyance roller pair 42 is provided on the rear side of the head 39. The conveyance roller pair 42 nips and holds the sheet guided forward from above by the guide member 44, and conveys the sheet forward. The discharge roller pair 43 nips and holds the sheet recorded by the recording unit 6, and conveys the sheet forward toward the discharge tray 24. The conveyance roller pair 42 and the discharge roller pair 43 release the nipping when the first tray 22 is extracted. Specifically, the conveyance roller pair 42 and the discharge roller pair 43 release the nipping when the pinch rollers 42*b* and 43*b* move downward.

Cutter 5

Figure 4:
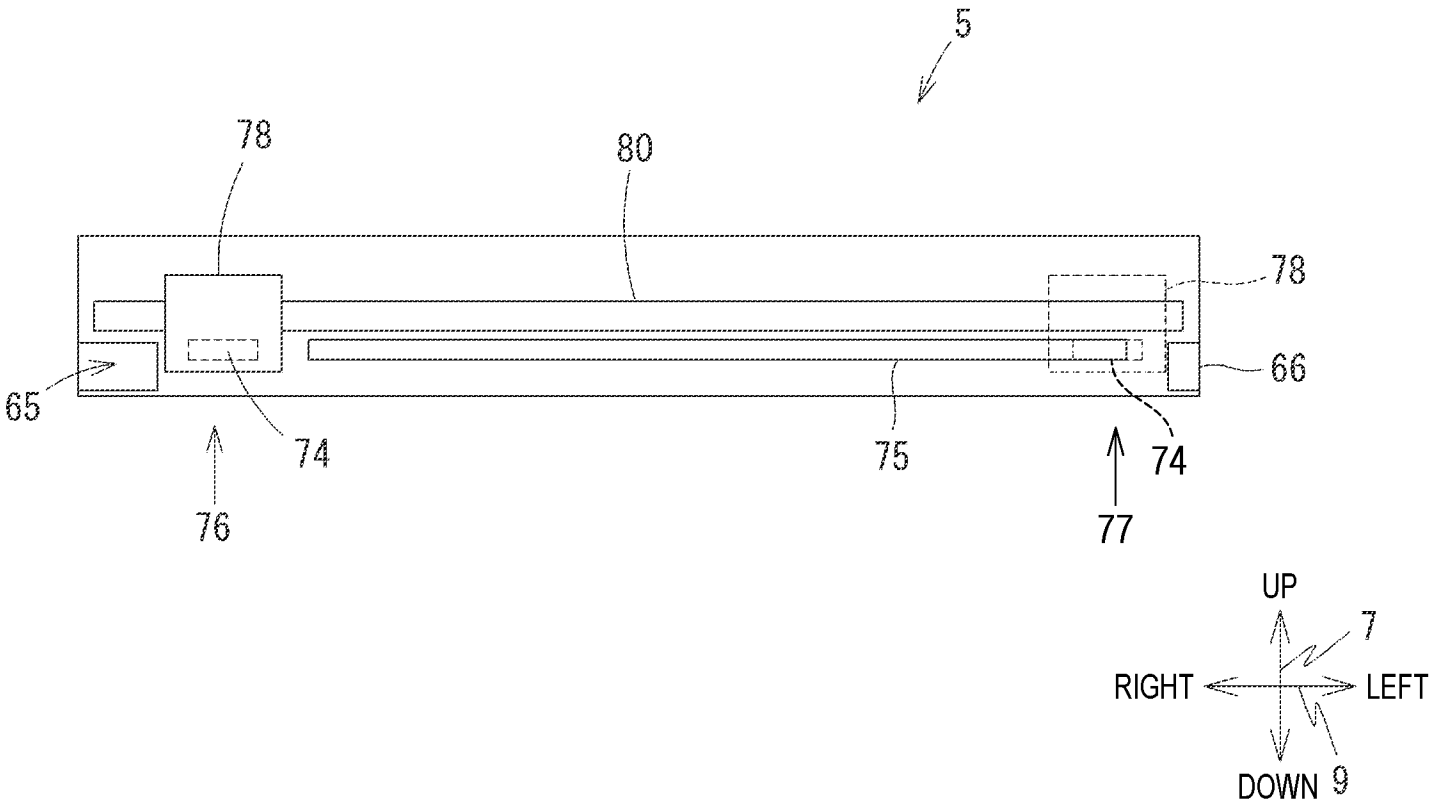
FIG. 4 is a schematic plan view of a cutter 5.

As illustrated in FIGS. 2 and 4, the cutter 5 is provided between the guide piece 31 and the intermediate roller pair 41. The cutter 5 includes, for example, a disk-shaped rotary blade 74 and a driven blade 75. The rotary blade 74 is held by a cutter carriage 78 movable along the left-right direction 9. The cutter carriage 78 has left and right ends connected to the housing 100, and is movable in the left-right direction 9 by a rod-shaped carriage guide 80 extending in the left-right direction 9. The cutter carriage 78 is moved by driving of a cutting motor 130. The rotary blade 74 reciprocates as the cutter carriage 78 moves in the left-right direction 9. The sheet pulled out from the roll sheet 46 and conveyed is cut by the cutter 5 in a width direction (the left-right direction 9) when the cutting motor 130 is driven under the control of the controller 10. The cutter 5 moves, for example, from a start point position 76 (an example of a first position) to a turning point position 77 (an example of a second position) along the left-right direction 9, and then cuts the roll sheet 46 by reciprocating movement returning to the start point position 76.

The second cover 71 is provided on the rear side of the cutter 5. Specifically, the second cover 71 is provided on the rear side of the rotary blade 74. When the second cover 71 is rotated from the close position 71*a* to the open position 71*b*, the rotary blade 74 of the cutter 5 is exposed to the outside. Accordingly, the rotary blade 74 (the cutter carriage 78) of the cutter 5 can be accessed from the outside.

Start Point Sensor 65

As illustrated in FIG. 4, the start point sensor 65 is a sensor for detecting that the cutter carriage 78 is provided at the start point position 76 which is one end in a movement direction (the left-right direction 9). The start point sensor 65 is, for example, a mechanical switch that outputs different electric signals depending on whether the mechanical switch contacts the cutter carriage 78 at the start point position 76.

Turning Point Sensor 66

The turning point sensor 66 is a sensor for detecting that the cutter carriage 78 is provided at the turning point position 77 (the example of the second position) which is the other end in the movement direction (the left-right direction 9). The turning point sensor 66 is, for example, a mechanical switch that outputs different electric signals depending on whether the mechanical switch contacts the cutter carriage 78 at the turning point position 77.

Recording Unit 6

As illustrated in FIG. 2, the recording unit 6 is provided above the conveyance path 18 and between the conveyance roller pair 42 and the discharge roller pair 43 in the conveyance direction 17. The head 39 includes a plurality of nozzles 40 on a nozzle surface 38 facing downward. Inks of different colors supplied from ink cartridges (not shown) are ejected from nozzle holes of the respective nozzles 40. A platen 47 that supports a lower surface of the sheet is provided below the nozzle surface 38.

Discharge Tray 24

In the housing 100, the discharge tray 24 is disposed in front of the head 39 and above the sheet feeding tray 20. As illustrated in FIG. 1, the discharge tray 24 can be accessed from the front of the housing 100. The discharge tray 24 can be extracted forward. When the discharge tray 24 is extracted forward, the pinch rollers 42*b* and 43*b* move downward. Accordingly, the contact between the pinch roller 42*b* and the conveyance roller 42*a* is released, and the contact between the pinch roller 43*b* and the discharge roller 43*a* is released. Therefore, the nipping between the conveyance roller 42*a* and the pinch roller 42*b* and between the discharge roller 43*a* and the pinch roller 43*b* is released.

First Registration Sensor 61

The first registration sensor 61 is provided between the guide piece 31 and the cutter 5 in the conveyance direction 17. The first registration sensor 61 is provided, for example, below the cutter 5 and above the guide piece 31. The first registration sensor 61 detects the presence or absence of the sheet moving from the sheet feeding tray 20 to the intermediate roller pair 41. The first registration sensor 61 detects the presence or absence of the sheet, for example, by detecting movement of a detector 61*a* that physically contacts the sheet by using an optical sensor 61*b*.

Second Registration Sensor 62

The second registration sensor 62 is provided between the intermediate roller pair 41 and the conveyance roller pair 42 in the conveyance direction 17. FIG. 2 shows an example in which the second registration sensor 62 is provided at the guide member 44. The second registration sensor 62 may, for example, be provided between the intermediate roller pair 41 and the guide member 44 in the conveyance direction 17. In this case, the second registration sensor 62 is provided above the intermediate roller pair 41 and below the guide member 44. The second registration sensor 62 detects the presence or absence of the sheet nipped by the intermediate roller pair 41 and moving toward the conveyance roller pair 42. The second registration sensor 62 detects the presence or absence of the sheet, for example, by detecting movement of a detector 62*a* that physically contacts the sheet by using an optical sensor 62*b*.

Media Sensor 63

The media sensor 63 is provided at the head 39 in the conveyance direction 17. The media sensor 63 is provided on the rear side of the head 39. The media sensor 63 detects the presence or absence of the sheet nipped by the conveyance roller pair 42 and moving toward the head 39. The media sensor 63 detects the presence or absence of the sheet by, for example, optically detecting the sheet conveyed to the platen 47.

Discharge Sensor 64

The discharge sensor 64 is provided downstream of the discharge roller pair 43 in the conveyance direction 17. The discharge sensor 64 detects the presence or absence of the sheet nipped by the discharge roller pair 43 and moving toward the discharge tray 24. The discharge sensor 64 detects the presence or absence of the sheet, for example, by detecting movement of a detector 64*a* that physically contacts the sheet by using an optical sensor 64*b*.

Operation Panel 26

As illustrated in FIG. 1, the operation panel 26 is provided at the center of a front surface of the housing 100. The operation panel 26 is, for example, a push button such as a numeric keypad, and receives an operation input from the user who operates the image recording device 2. The operation panel 26 may be disposed to overlap the display 25, that is, may be combined with or integrated with a so-called touch panel.

Display 25

The display 25 is provided at the center of the front surface of the housing 100. For example, the display 25 is provided adjacent to the operation panel 26 in the left-right direction 9. The display 25 can visually display, for example, an operation state, a setting content, an error, and the like of the image recording device 2 to the user. In the present embodiment, when an abnormality in the sheet is detected, the display 25 displays an object display screen on which a target location for restoring the abnormality in the sheet to a normal state is displayed by using an object 176 (see FIG. 7A to FIG. 22D). The display 25 displays, for example, guidance data including the object display screen and a notification indicating occurrence of the abnormality in the sheet. The display 25 displays any one of a first guidance to a sixth guidance as the guidance data.

Controller 10

Figure 5:
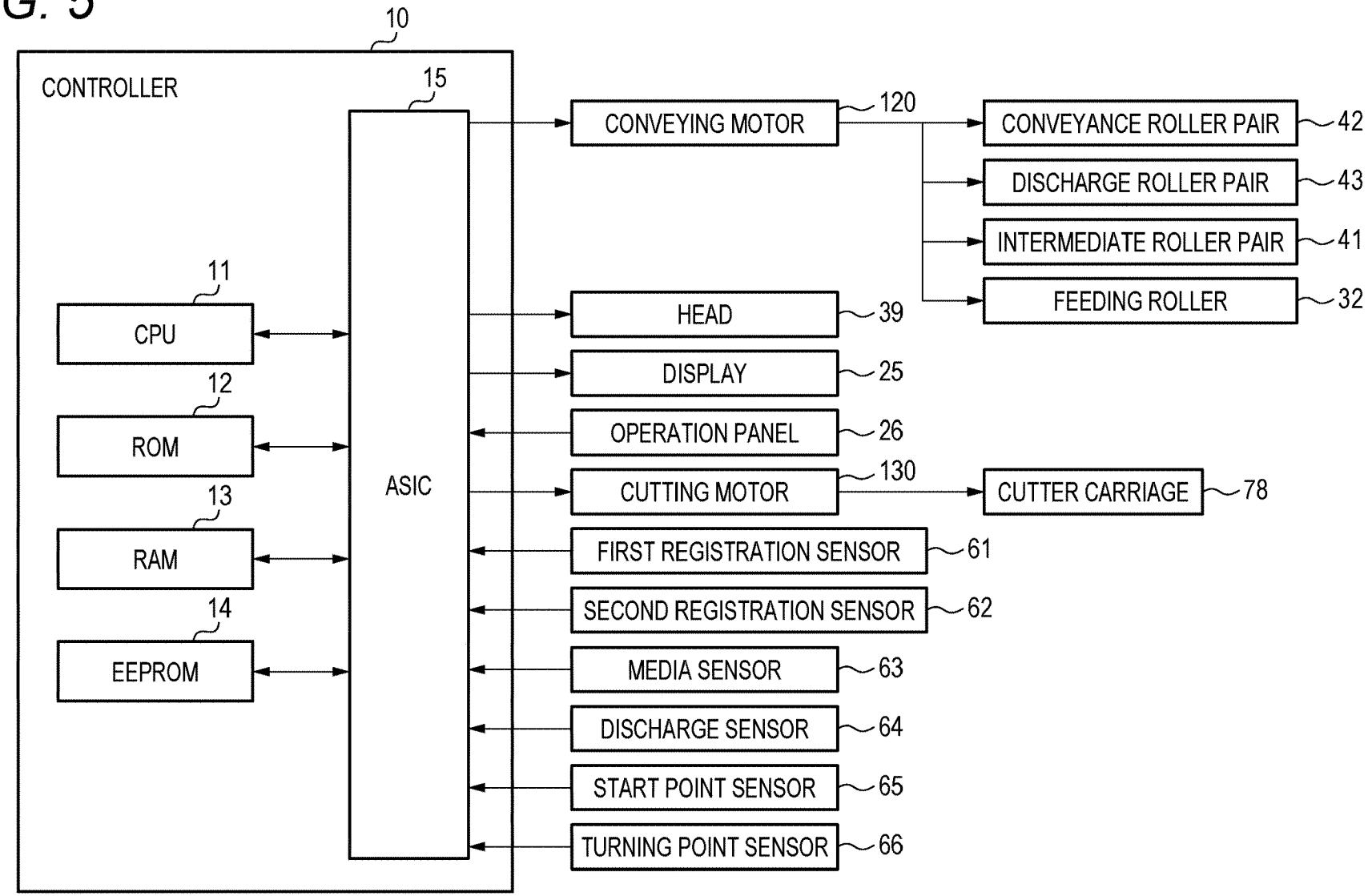
FIG. 5 is a schematic diagram illustrating components of a controller 10.

As illustrated in FIG. 5, the controller 10 includes a CPU 11, a ROM 12, a RAM 13, an EEPROM 14, and an ASIC 15, which are connected by an internal bus. The ROM 12 stores programs and the like for controlling various operations of the CPU 11. The RAM 13 is used as a storage area for temporarily storing data, signals, and the like to be used when the CPU 11 executes the programs described above, or as a work area for data processing. The EEPROM 14 stores settings, flags, and the like to be held even after a power supply is turned off.

The conveying motor 120 and the cutting motor 130 are connected to the ASIC 15. The ASIC 15 generates a drive signal for causing each motor to rotate, and controls each motor based on the drive signal. Each motor rotates forward or backward according to the drive signal from the ASIC 15. The controller 10 controls the driving of the conveying motor 120 to drive the feeding roller 32, the drive roller 41*a*, the conveyance roller 42*a*, and the discharge roller 43*a*. The controller 10 controls the driving of the cutting motor 130 to drive the cutter 5 (the cutter carriage 78 and the rotary blade 74).

The display 25 and the operation panel 26 are connected to the ASIC 15. The display 25 displays the operation state, the setting content, the first guidance to the sixth guidance, and the like of the image recording device 2. The operation panel 26 outputs an operation signal corresponding to an operation by the user to the controller 10.

The first registration sensor 61, the second registration sensor 62, the media sensor 63, the discharge sensor 64, the start point sensor 65, and the turning point sensor 66 are electrically connected to the ASIC 15. The controller 10 detects the arrival of the sheet to the first registration sensor 61 via the first registration sensor 61. The controller 10 detects the arrival of the sheet to the second registration sensor 62 via the second registration sensor 62. The controller 10 detects the arrival of the sheet to the media sensor 63 via the media sensor 63. The controller 10 detects the arrival of the sheet to the discharge sensor 64 via the discharge sensor 64. The controller 10 detects the arrival of the cutter carriage 78 to the start point position 76 via the start point sensor 65. The controller 10 detects the arrival of the cutter carriage 78 to the turning point position 77 via the turning point sensor 66.

The EEPROM 14 stores the guidance data including different object display screens depending on a detection position of the sheet and a position of the cutter carriage 78, and the notification indicating the occurrence of the abnormality in the sheet. The guidance data includes the first guidance to the sixth guidance. The EEPROM 14 stores, as the guidance data, the first guidance to the sixth guidance each including a plurality of object display screens with a predetermined display order.

The occurrence of the abnormality in the sheet is, for example, occurrence of a conveyance abnormality (a conveyance jam) of the sheet and a cutting abnormality due to the cutter 5. The conveyance abnormality of the sheet is, for example, a jam of sheet in the feeding roller 32, the intermediate roller pair 41, the conveyance roller pair 42, or the discharge roller pair 43. The cutting abnormality is, for example, one or both of the fact that the cutter 5 is driven but the sheet cannot be cut and the fact that the cutter 5 (the rotary blade 74) cannot return to the start point position 76.

The location indicated as the object 176 on the object display screen is a component to be operated or checked by the user among the components of the image recording device 2. Examples of the location include a sheet feeding portion, a cutter portion, a rear cover portion, and a discharge portion. The sheet feeding portion includes the first tray 22, the second tray 23, and the like. The cutter portion includes the cutter 5 (the rotary blade 74), the second cover 71, and the like. The rear cover portion includes the first cover 70 and the like. The discharge portion includes the discharge tray 24 and the like.

The user operates the components of the image recording device 2 in accordance with the guidance data displayed on the display 25 to remove the sheet causing the conveyance jam. Further, when the user manually operates the cutter 5 of the image recording device 2, the rotary blade 74 of the cutter 5 returns to the start point position 76. When such the work is completed, the abnormality in the sheet returns to the normal state. The description "returns to the normal state" means returning to a state in which a new image can be recorded on a sheet by removing the sheet from a portion between the sheet feeding tray 20 and the discharge tray 24 (the conveyance path 18).

Guidance Display Operation by Image Recording Device 2

Next, a guidance display operation by the image recording device 2 will be described.

Figure 6:
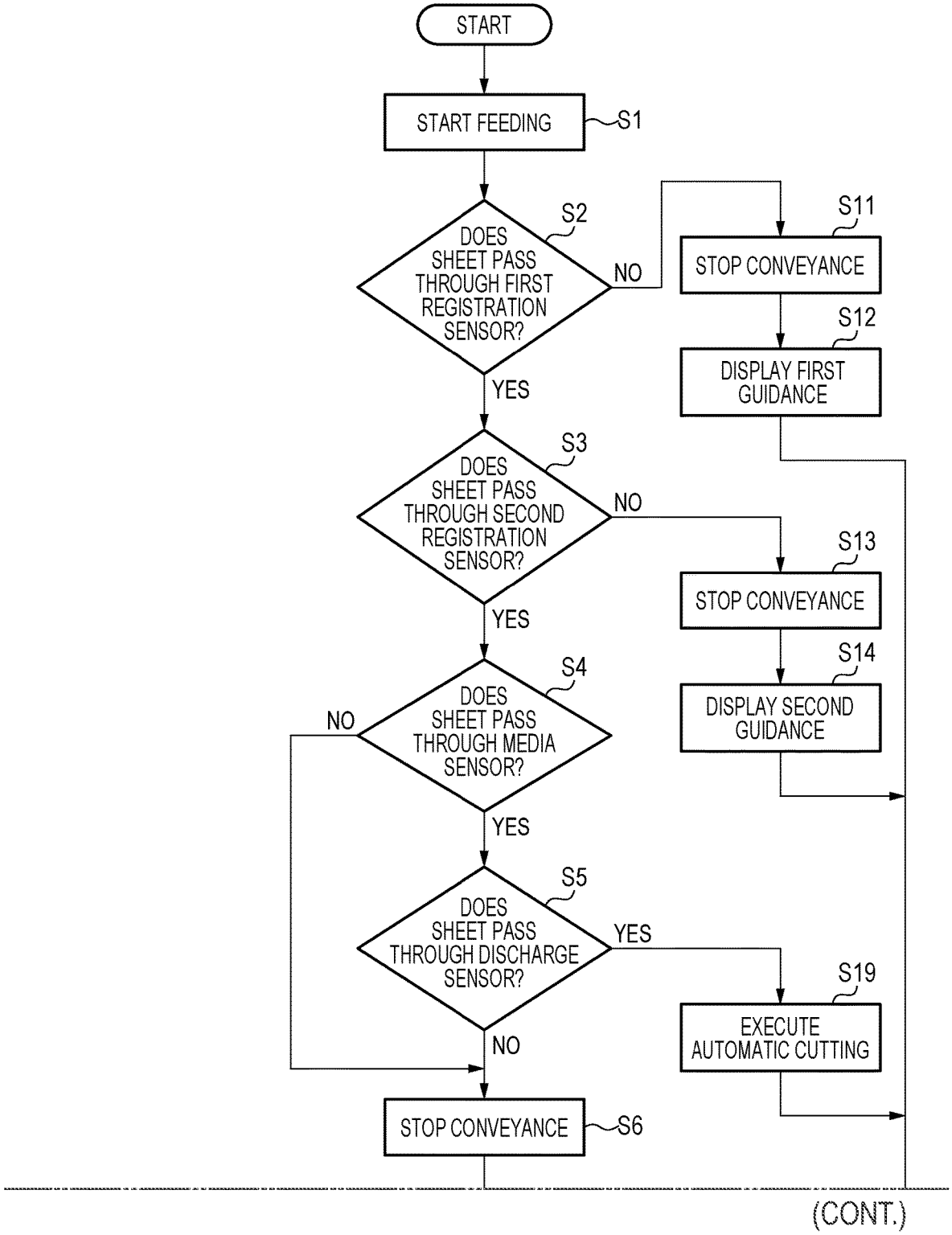
FIG. 6 is a flowchart illustrating a flow of displaying a first guidance to a sixth guidance.

As illustrated in FIG. 6, the controller 10 starts the conveyance of the sheet pulled out from the roll sheet 46 from the second tray 23. The controller 10 drives the conveying motor 120 to rotate the feeding roller 32, the intermediate roller pair 41, the conveyance roller pair 42, and the discharge roller pair 43 (step S1).

Next, the controller 10 determines whether the sheet passes through the first registration sensor 61 within a predetermined time (step S2). The controller 10 determines whether the sheet passes through the first registration sensor 61 based on a signal obtained from the first registration sensor 61. When the first registration sensor 61 detects the passage of the sheet within the predetermined time (step S2_YES), the process proceeds to step S3. When the first registration sensor 61 does not detect the passage of the sheet within the predetermined time (step S2_NO), the process proceeds to step S11.

In step S3, the controller 10 determines whether the sheet passes through the second registration sensor 62 within a predetermined time. The controller 10 determines whether the sheet passes through the second registration sensor 62 based on a signal obtained from the second registration sensor 62. When the second registration sensor 62 detects the passage of the sheet within the predetermined time (step S3_YES), the process proceeds to step S4. When the second registration sensor 62 does not detect the passage of the sheet within the predetermined time (step S3_NO), the process proceeds to step S13.

In step S4, the controller 10 determines whether the sheet passes through the media sensor 63 within a predetermined time. The controller 10 determines whether the sheet passes through the media sensor 63 based on a signal obtained from the media sensor 63. When the media sensor 63 detects the passage of the sheet within the predetermined time (step S4_YES), the process proceeds to step S5. When the media sensor 63 does not detect the passage of the sheet within the predetermined time (step S4_NO), the process proceeds to step S6.

In step S5, the controller 10 determines whether the sheet passes through the discharge sensor 64 within a predetermined time. The controller 10 determines whether the sheet passes through the discharge sensor 64 based on a signal obtained from the discharge sensor 64. When the discharge sensor 64 detects the passage of the sheet within the predetermined time (step S5_YES), the process proceeds to step S19. When the discharge sensor 64 does not detect the passage of the sheet within the predetermined time (step S5_NO), the process proceeds to step S6.

In step S6, the controller 10 stops the conveying motor 120. Accordingly, the conveyance of the sheet is stopped. In this state, it is considered that although the sheet passes through the recording unit 6, the paper jam occurs before the sheet reaches the discharge roller pair 43. That is, the sheet is nipped by the intermediate roller pair 41 and the conveyance roller pair 42. Thereafter, the process proceeds to step S7.

In step S7, the controller 10 drives the cutter carriage 78 to cut the sheet. For example, the controller 10 drives the cutting motor 130 to move the cutter carriage 78 from the start point position 76 to the turning point position 77 and then return the cutter carriage 78 to the start point position 76. In step S7, the controller 10 may execute cutting of the sheet in response to a command input to the operation panel 26.

Next, the controller 10 determines whether the cutting is completed (step S8). The controller 10 drives the cutter carriage 78 and obtains signals output from the start point sensor 65 and the turning point sensor 66. The controller 10 determines whether the cutter carriage 78 can be moved from the start point position 76 to the turning point position 77 based on the obtained signals. When a signal indicating the detection of the cutter carriage 78 cannot obtained from the turning point sensor 66, the controller 10 determines that the sheet is not successfully cut. This indicates that the cutter carriage 78 cannot cross the sheet in the left-right direction 9 and the sheet is not successfully cut. When the cutting is completed (step S8_YES), the process proceeds to step S9. When the cutting is not completed (step S8_NO), the process proceeds to step S15.

In step S9, the controller 10 determines whether the cutter carriage 78 is returned to a start point. The controller 10 obtains a signal output from the start point sensor 65. The controller 10 determines whether the cutter carriage 78 can be detected again based on the output of the start point sensor 65. When the cutter carriage 78 is detected again (step S9 YES), the process proceeds to step S10. When the cutter carriage 78 is not detected (step S9 NO), the process proceeds to step S18.

In step S10, the controller 10 reads the third guidance from the EEPROM 14 and displays the third guidance on the display 25. Details of the third guidance will be described later. Accordingly, the process according to this flow ends.

In step S11, the controller 10 stops the conveying motor 120. Accordingly, the conveyance of the sheet is stopped. In this state, it is considered that the sheet does not reach the intermediate roller pair 41 and the paper jam occurs. That is, the sheet is not nipped by any roller. Thereafter, the process proceeds to step S12.

In step S12, the controller 10 reads the first guidance from the EEPROM 14 and displays the first guidance on the display 25. Details of the first guidance will be described later. Accordingly, the process according to this flow ends.

In step S13, the controller 10 stops the conveying motor 120. Accordingly, the conveyance of the sheet is stopped. In this state, it is considered that although the sheet passes through the intermediate roller pair 41, the paper jam occurs before the sheet reaches the conveyance roller pair 42. That is, the sheet is nipped by the intermediate roller pair 41. Thereafter, the process proceeds to step S14.

In step S14, the controller 10 reads the second guidance from the EEPROM 14 and displays the second guidance on the display 25. Details of the second guidance will be described later. Accordingly, the process according to this flow ends.

In step S15, the controller 10 determines whether the cutter carriage 78 is returned to the start point position 76. The controller 10 obtains a signal output from the start point sensor 65. The controller 10 determines whether the cutter carriage 78 can be detected again based on the output of the start point sensor 65. When the cutter carriage 78 is detected again (step S15 YES), the process proceeds to step S16. When the cutter carriage 78 is not detected (step S15 NO), it is considered that the cutter carriage 78 does not return to the start point position 76. The process proceeds to step S17.

In step S16, the controller 10 reads the fifth guidance from the EEPROM 14 and displays the fifth guidance on the display 25. Details of the fifth guidance will be described later. Accordingly, the process according to this flow ends.

In step S17, the controller 10 reads the sixth guidance from the EEPROM 14 and displays the sixth guidance on the display 25. Details of the sixth guidance will be described later. Accordingly, the process according to this flow ends.

In step S18, the controller 10 reads the fourth guidance from the EEPROM 14 and displays the fourth guidance on the display 25. Details of the fourth guidance will be described later. Accordingly, the process according to this flow ends.

In step S19, the controller 10 drives the cutting motor 130 to cut the sheet. Accordingly, this flow ends without the occurrence of the abnormality in the sheet.

First Guidance

The first guidance includes an object display screen indicating, by the object 176, the target location of the image recording device 2 for dealing with the paper jam before the sheet reaches the intermediate roller pair 41. As illustrated in FIG. 7A to FIG. 22D, a title 178 (an example of the notification) is displayed in an upper portion of the object display screen for each of the following guidances. An image showing the object 176 is displayed on the left side of the object display screen. Below the image showing the object 176, arrow icons 169 for switching screens are shown. A text 177 describing an operation content is displayed on the right side of the object display screen. Below the text 177 describing the operation content, a page number and a "x" icon 167 are shown. For example, the controller 10 switches the respective screens by selecting and executing the arrow icons 169 shown at a lower left corner of each screen with the operation panel 26. On the left side of each screen, an object image including the object 176 indicating a work target portion is shown. Further, the controller 10 ends the guide according to each guidance by selecting and executing the "x" icon 167 shown at a lower right corner of each screen with the operation panel 26. According to the first guidance, the text "paper jam [roll] 01" is displayed as the title 178. In the following description of each guidance, to perform a work in accordance with the object 176 displayed on each object screen until the "x" icon 167 shown at the lower right corner of each screen is selected and executed with the operation panel 26 corresponds to a "restoring work to the normal state".

Figure 7A:
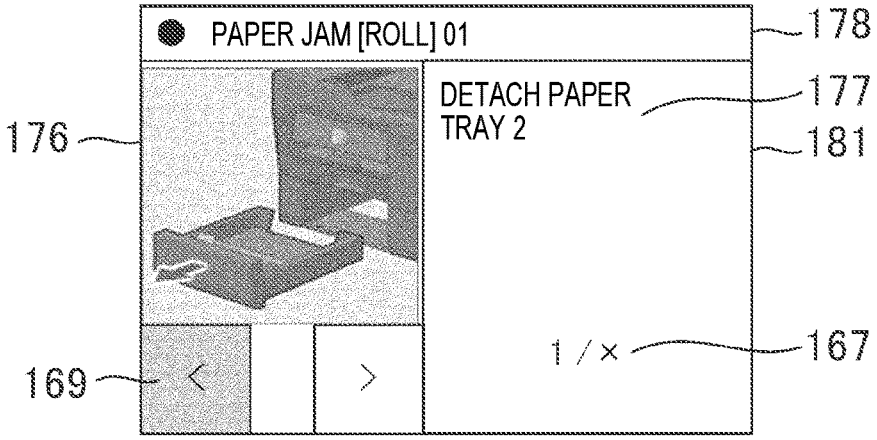
FIG. 7A to FIG. 7F illustrate examples of a screen indicating the first guidance displayed on a display 25.

As illustrated in FIG. 7A, on the left side of a screen 181, an image including the housing 100 and PAPER TRAY 2 detached from the housing 100 is shown as the object 176. On the right side thereof, the text 177 "detach paper tray 2" is shown. Accordingly, on the screen 181, the user is guided to extract the second tray 23 from the housing 100.

Figure 7B:
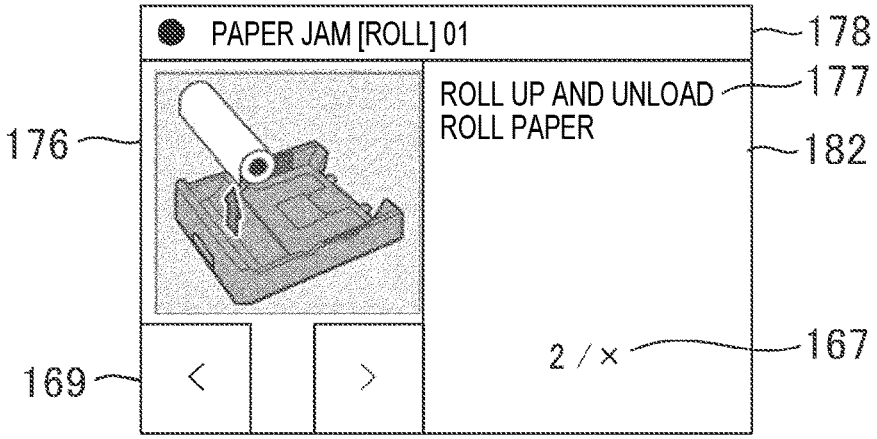

As illustrated in FIG. 7B, on the left side of a screen 182 shown next to the screen 181, an image including a perspective view of PAPER TRAY 2 and roll paper unloaded upward from PAPER TRAY 2 is shown as the object 176. On the right side thereof, the text 177 "roll up and unload roll paper" is shown. Accordingly, on the screen 182, the user is guided to roll up the roll sheet 46 and unload the roll sheet 46 from the detached second tray 23.

Figure 7C:
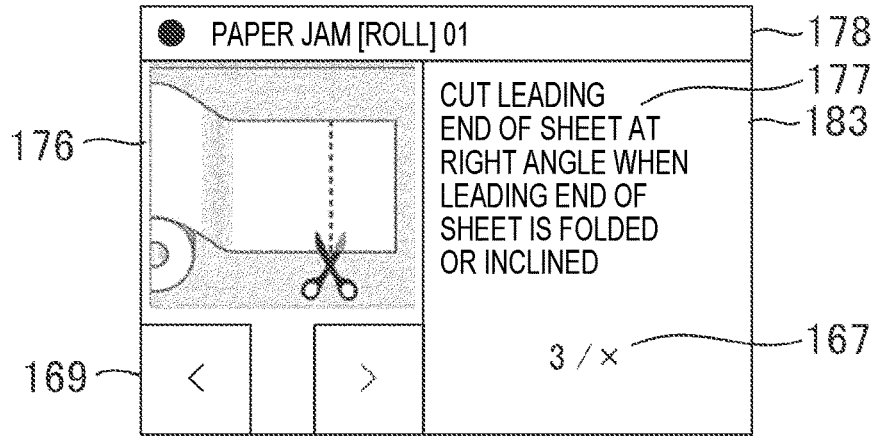

As illustrated in FIG. 7C, on the left side of a screen 183 shown next to the screen 182, an image including a perspective view of the roll paper and a leading end of the roll paper to be cut by using scissors is shown as the object 176. On the right side thereof, the text 177 "cut leading end of sheet at right angle when leading end of sheet is folded or inclined" is shown. Accordingly, on the screen 183, the user is guided to cut the leading end of the unloaded roll sheet 46 in order to adjust the leading end.

Figure 7D:
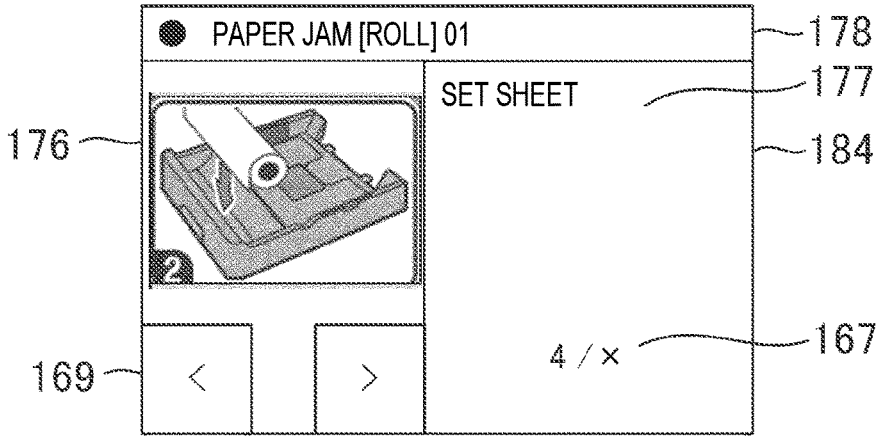

As illustrated in FIG. 7D, on the left side of a screen 184 shown next to the screen 183, an image including the perspective view of PAPER TRAY 2 and the roll paper set in PAPER TRAY 2 is shown as the object 176. On the right side thereof, the text 177 "set sheet" is shown. Accordingly, on the screen 183, the user is guided to reset the roll sheet 46 whose leading end is cut in the second tray 23.

Figure 7E:
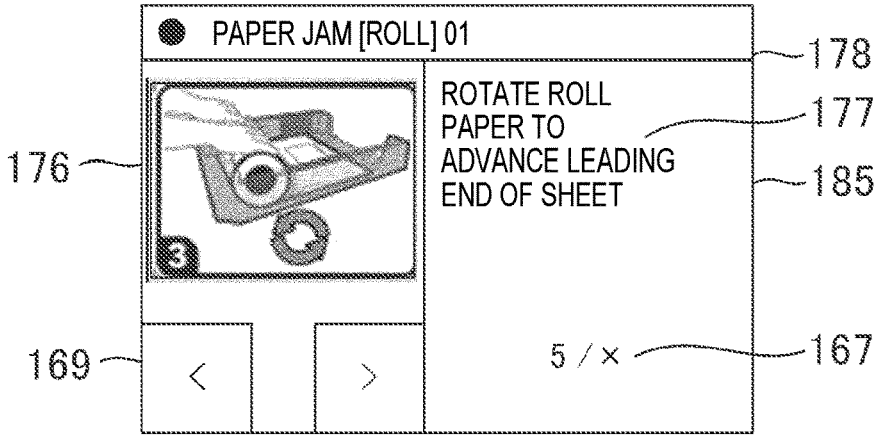

As illustrated in FIG. 7E, on the left side of a screen 185 shown next to the screen 184, an image including the perspective view of PAPER TRAY 2, the roll paper whose leading end is pulled out, and a mark for rotating the roll paper is shown as the object 176. On the right side thereof, the text 177 "rotate roll paper to advance leading end of sheet" is shown. Accordingly, on the screen 185, the user is guided to pull out the leading end of the roll sheet 46 to the passage 33 on the second tray 23.

Figure 7F:
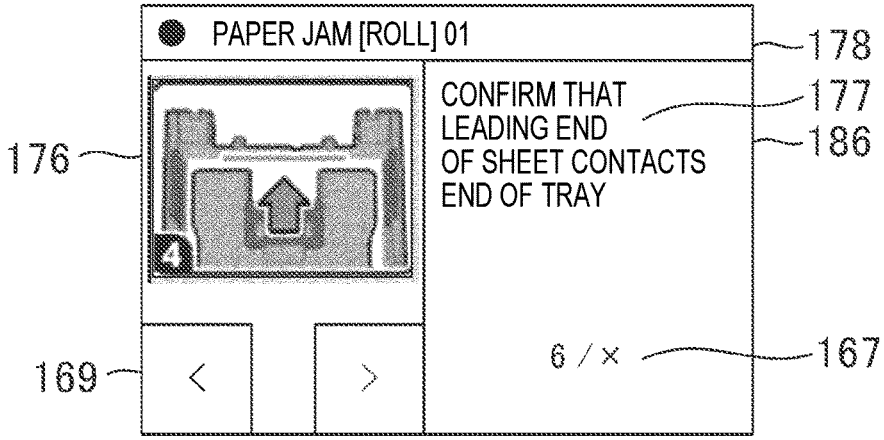

As illustrated in FIG. 7F, on the left side of a screen 186 shown next to the screen 185, an image including a planar view of a rear end side of PAPER TRAY 2 and the leading end of the roll paper pulled out to a rear end of PAPER TRAY 2 is shown as the object 176. On the right side thereof, the text 177 "confirm that leading end of sheet contacts end of tray" is shown. Accordingly, on the screen 186, the user is guided to bring the leading end of the sheet pulled out from the roll sheet 46 into contact with the protrusion 29 on the second tray 23. In the present embodiment, the protrusion 29 serves as an example of a position indicating the setting position of the leading end of the roll sheet 46 when the roll sheet 46 is set in the second tray 23. That is, by setting the leading end of the roll sheet 46 to contact the protrusion 29, the roll sheet 46 is ready to be fed and conveyed by the feeding roller 32. The screen 186 indicates that the leading end of the roll sheet 46 has been set at a position which allows the roll sheet to be fed and conveyed. The user can understand that the leading end of the roll sheet 46 is set at the setting position not only by visually recognizing the leading end of the roll sheet 46 contacting the protrusion 29, but also by feeling an impact or hearing a sound caused by the leading end of the roll sheet 46 contacting (hitting) the protrusion 29. The setting position indicated in the screen 186 of the present disclosure is not limited to the protrusion 29, and may be any position which allows the roll sheet 46 to be fed and conveyed, that is, a position at which the feeding roller 32 is allowed to contact the roll sheet or a position on the downstream side thereof in the conveyance direction of the roll sheet 46.

Figure 8A:
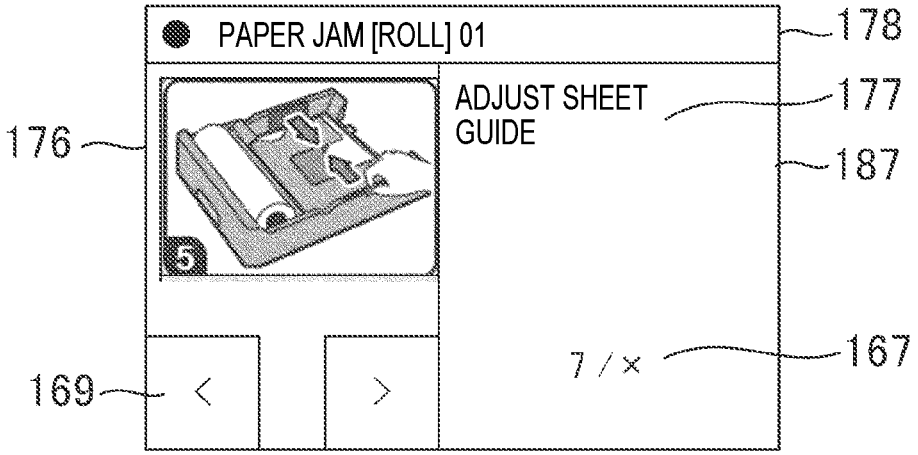
FIG. 8A and FIG. 8B illustrate examples of the screen indicating the first guidance displayed on the display 25.

As illustrated in FIG. 8A, on the left side of a screen 187 shown next to the screen 186, an image including the perspective view of PAPER TRAY 2, the set roll paper, and a mark for operating a sheet guide is shown as the object 176. On the right side thereof, the text 177 "adjust sheet guide" is shown. Accordingly, on the screen 187, the user is guided to move, on the second tray 23, the side guides 30 to contact left and right ends of the sheet pulled out from the roll sheet 46.

Figure 8B:
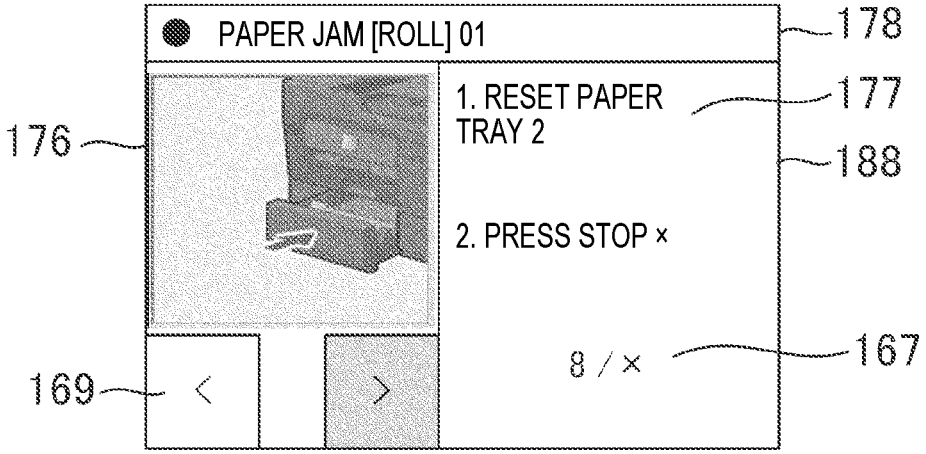

As illustrated in FIG. 8B, on the left side of a screen 188 shown next to the screen 187, an image including the perspective view of PAPER TRAY 2 and a perspective view of the housing 100 is shown as the object 176. On the right side thereof, the text 177 "1. reset paper tray 2; 2. press stop x" is shown. Accordingly, on the screen 188, the user is guided to attach the second tray 23 to the housing 100. Accordingly, the guide according to the first guidance ends.

Second Guidance

The second guidance includes an object display screen indicating, by the object 176, the target location of the image recording device 2 for dealing with the paper jam before the sheet passes through the conveyance roller pair 42 after the sheet reaches the intermediate roller pair 41. According to the second guidance, the text "paper jam [roll] 02" is displayed as the title 178 (the example of the notification).

Figure 9A:
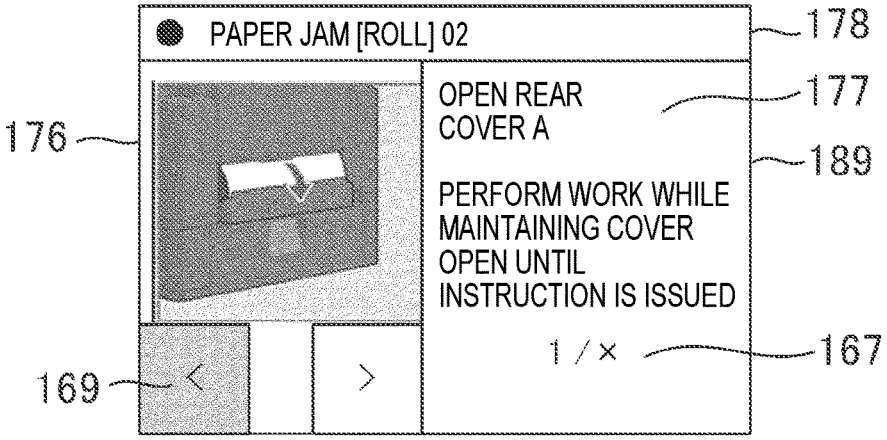
FIG. 9A to FIG. 9F illustrate examples of a screen indicating the second guidance displayed on the display 25.

As illustrated in FIG. 9A, on the left side of a screen 189, an image including REAR COVER A to be opened and a rear surface of the image recording device 2 is shown as the object 176. On the right side thereof, the text 177 "open rear cover A; perform work while maintaining cover open until instruction is issued" is shown. Accordingly, on the screen 189, the user is guided to open the first cover 70 and release the nipping of the sheet by the intermediate roller pair 41.

Figure 9B:
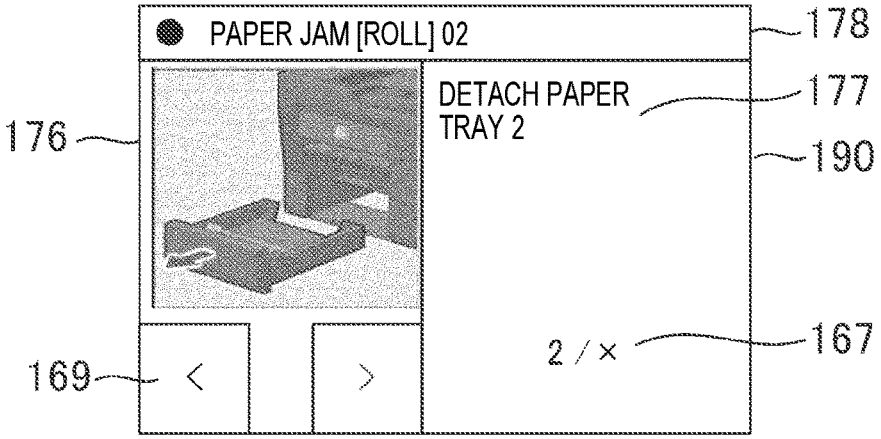

As illustrated in FIG. 9B, on a screen 190 shown next to the screen 189, the object 176 and the text 177 having the same contents as those of the screen 181 are shown. Accordingly, on the screen 190, the user is guided to extract the second tray 23 from the housing 100.

Figure 9C:
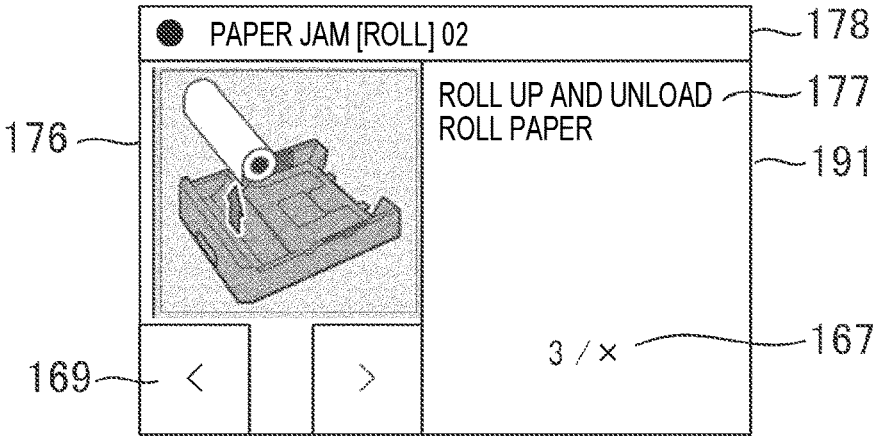

As illustrated in FIG. 9C, on a screen 191 shown next to the screen 190, the object 176 and the text 177 having the same contents as those of the screen 182 are shown. Accordingly, on the screen 191, the user is guided to roll up the roll sheet 46 and unload the roll sheet 46 from the detached second tray 23.

Figure 9D:
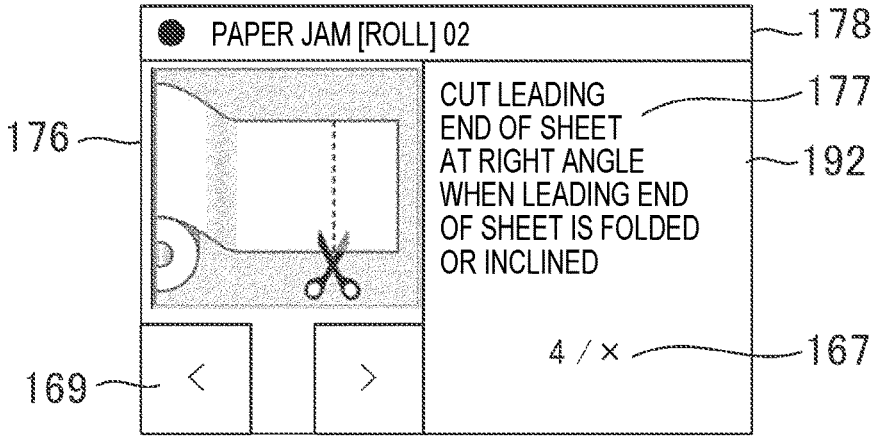

As illustrated in FIG. 9D, on a screen 192 shown next to the screen 191, the object 176 and the text 177 having the same contents as those of the screen 183 are shown. Accordingly, on the screen 192, the user is guided to cut the leading end of the unloaded roll sheet 46 in order to adjust the leading end.

Figure 9E:
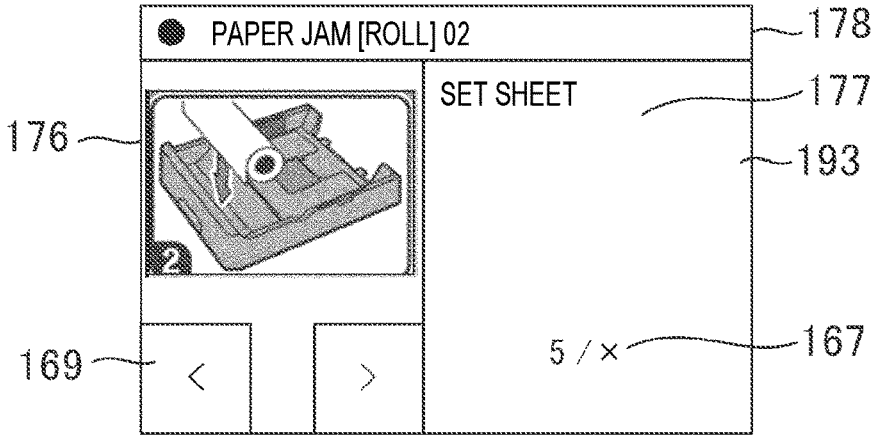

As illustrated in FIG. 9E, on a screen 193 shown next to the screen 192, the object 176 and the text 177 having the same contents as those of the screen 184 are shown. Accordingly, on the screen 193, the user is guided to reset the roll sheet 46 whose leading end is cut in the second tray 23.

Figure 9F:
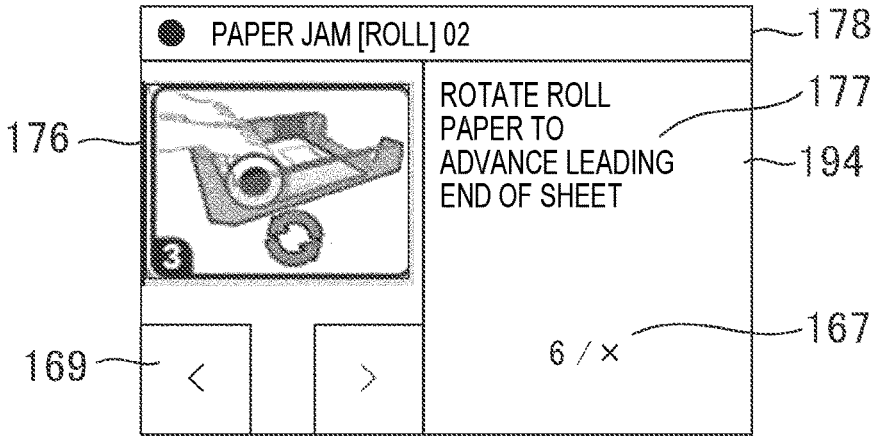

As illustrated in FIG. 9F, on a screen 194 shown next to the screen 193, the object 176 and the text 177 having the same contents as those of the screen 185 are shown. Accordingly, on the screen 194, the user is guided to pull out the leading end of the roll sheet 46 to the passage 33.

Figure 10A:
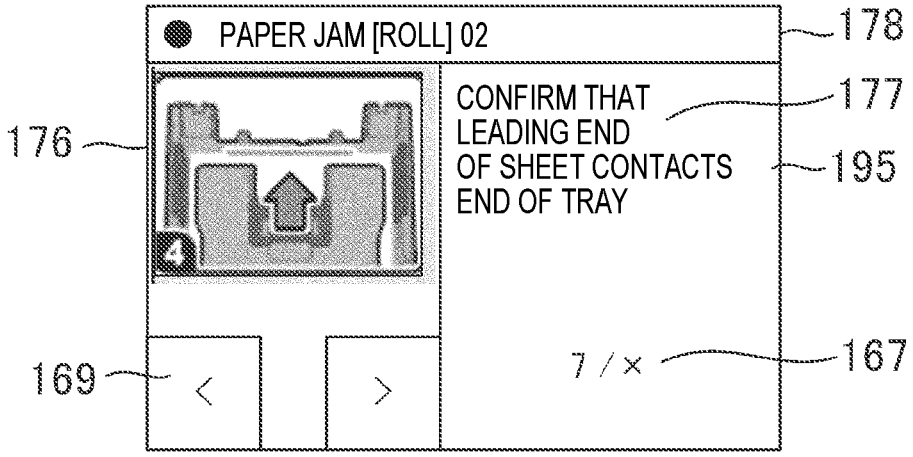
FIG. 10A to FIG. 10D illustrate examples of the screen indicating the second guidance displayed on the display 25.

As illustrated in FIG. 10A, on a screen 195 shown next to the screen 194, the object 176 and the text 177 having the same contents as those of the screen 186 are shown. Accordingly, on the screen 195, the user is guided to bring the leading end of the sheet pulled out from the roll sheet 46 into contact with the protrusion 29.

Figure 10B:
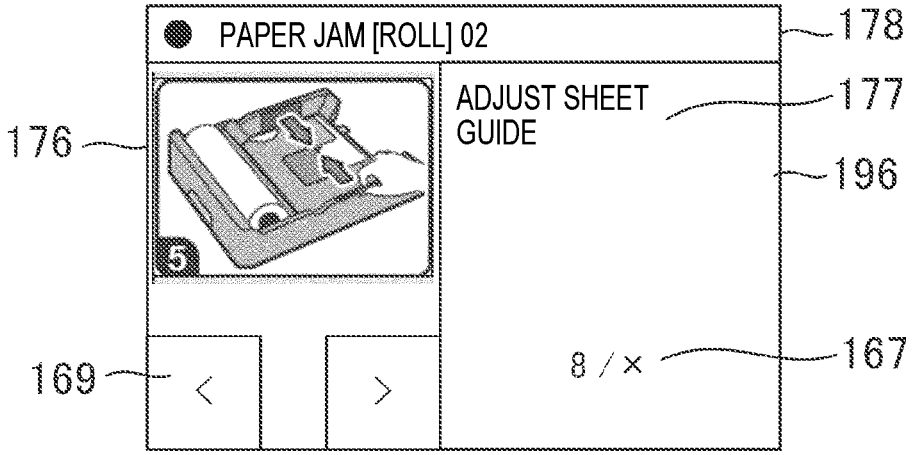

As illustrated in FIG. 10B, on a screen 196 shown next to the screen 195, the object 176 and the text 177 having the same contents as those of the screen 187 are shown. Accordingly, on the screen 196, the user is guided to move the side guides 30 to contact the left and right ends of the sheet pulled out from the roll sheet 46.

Figure 10C:
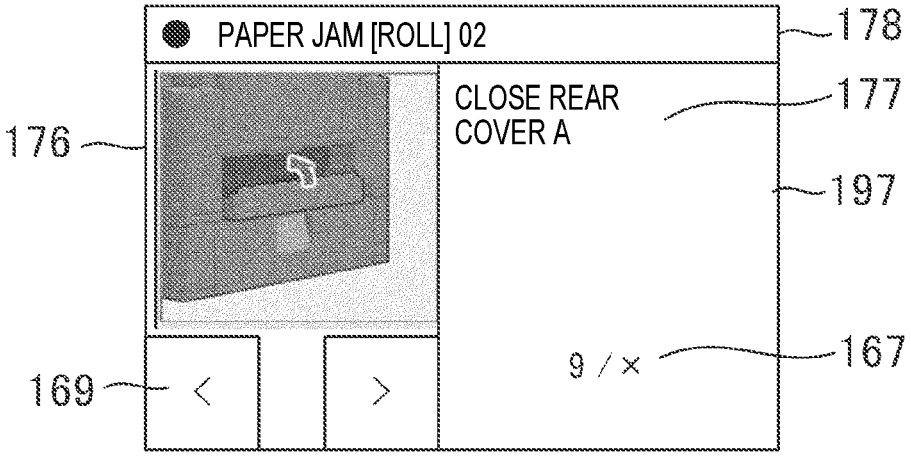

As illustrated in FIG. 10C, on the left side of a screen 197 shown next to the screen 196, an image including REAR COVER A to be closed and the rear surface of the image recording device 2 is shown as the object 176. On the right side thereof, the text 177 "close rear cover A" is shown. Accordingly, on the screen 197, the user is guided to close the first cover 70 and return the intermediate roller pair 41 to an original state.

Figure 10D:
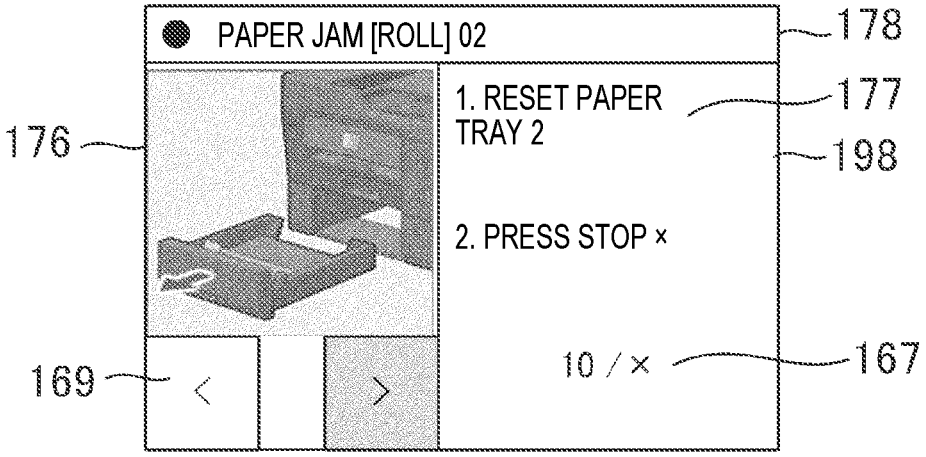

As illustrated in FIG. 10D, on a screen 198 shown next to the screen 197, the object 176 and the text 177 having the same contents as those of the screen 188 are shown. Accordingly, on the screen 198, the user is guided to attach the second tray 23 to the housing 100. Accordingly, the guide according to the second guidance ends.

Third Guidance

The third guidance includes an object display screen indicating, by the object 176, the target location of the image recording device 2 for dealing with the paper jam while the sheet is passing through the discharge sensor 64 after the sheet reaches the conveyance roller pair 42. According to the third guidance, the text "paper jam [roll] 03" is displayed as the title 178 (the example of the notification).

Figure 11A:
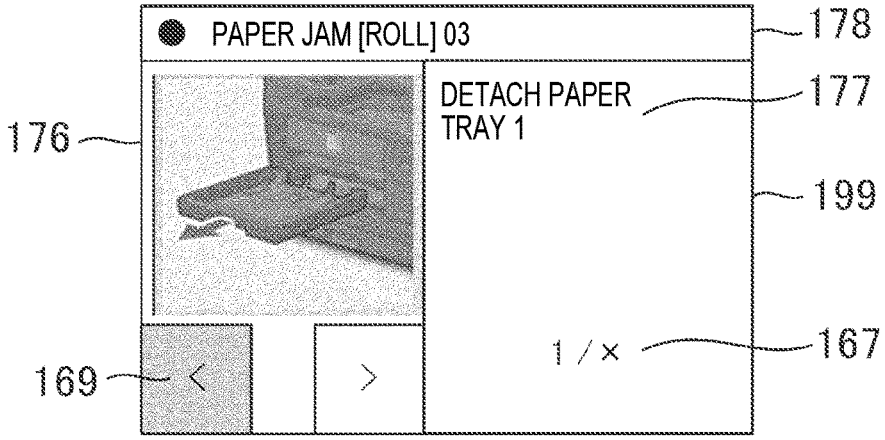
FIG. 11A to FIG. 11F illustrate examples of a screen indicating the third guidance displayed on the display 25.

As illustrated in FIG. 11A, on the left side of a screen 199, an image including a perspective view of PAPER TRAY 1 and a perspective view of a front surface of the image recording device 2 is shown as the object 176. On the right side thereof, the text 177 "detach paper tray 1" is shown. Accordingly, on the screen 199, the user is guided to extract the first tray 22 from the housing 100.

Figure 11B:
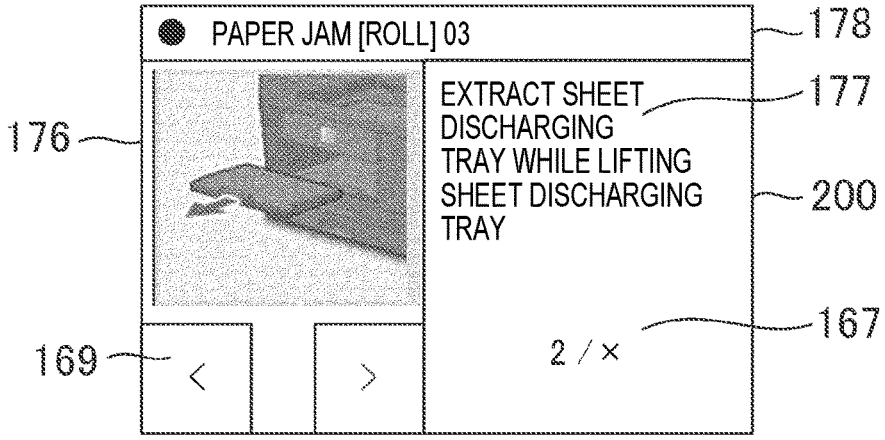

As illustrated in FIG. 11B, on the left side of a screen 200 shown next to the screen 199, an image including a perspective view of the discharge tray 24 and the perspective view of the front surface of the image recording device 2 is shown as the object 176. On the right side thereof, the text 177 "extract sheet discharging tray while lifting sheet discharging tray" is shown. Accordingly, on the screen 200, the user is guided to detach the discharge tray 24 from the housing 100.

Figure 11C:
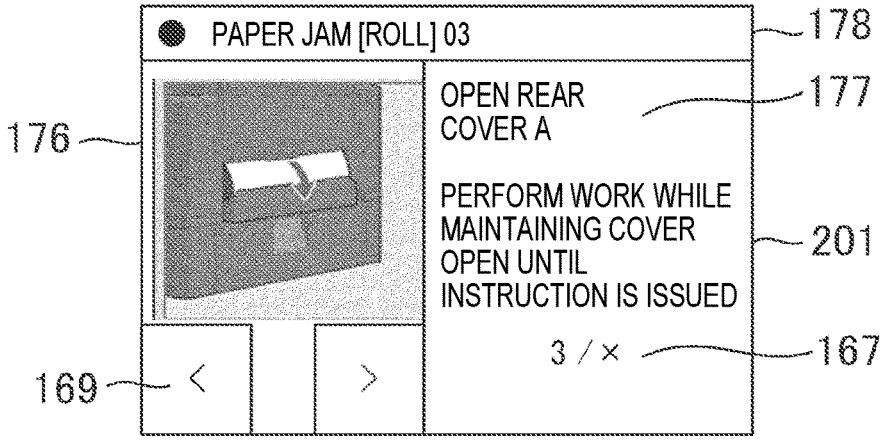

As illustrated in FIG. 11C, on a screen 201 shown next to the screen 200, the object 176 and the text 177 having the same contents as those of the screen 189 are shown. Accordingly, on the screen 201, the user is guided to open the first cover 70 and release the nipping of the sheet by the intermediate roller pair 41.

Figure 11D:
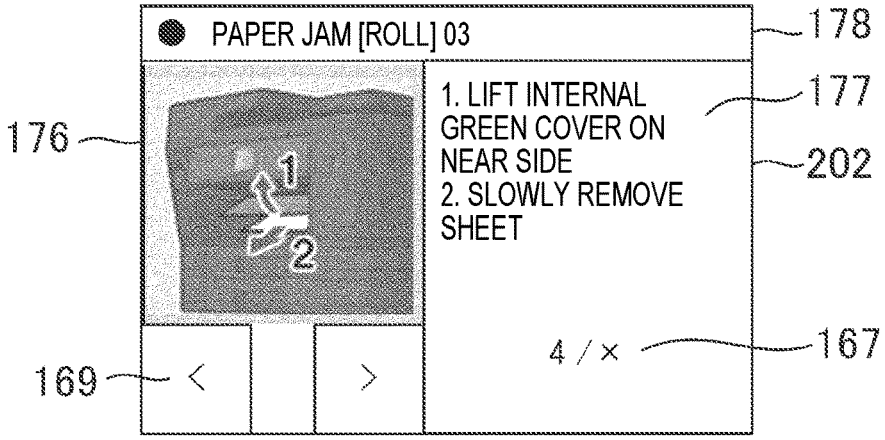

As illustrated in FIG. 11D, on the left side of a screen 202 shown next to the screen 201, an image including the front surface of the image recording device 2 and the sheet to be extracted to the front surface is shown as the object 176. On the right side thereof, the text 177 "1. lift internal green cover on near side; 2. slowly remove sheet" is shown. Accordingly, on the screen 202, the user is guided to extract the sheet existing downstream of the cutter 5 in the conveyance direction 17.

Figure 11E:
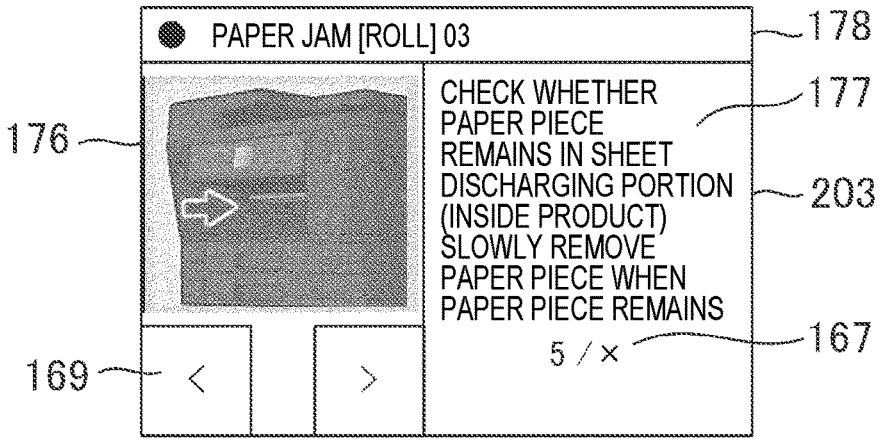

As illustrated in FIG. 11E, on the left side of a screen 203 shown next to the screen 202, an image including the front surface of the image recording device 2 and a mark for checking the front surface of the image recording device 2 is shown as the object 176. On the right side thereof, the text 177 "check whether paper piece remains in sheet discharging portion (inside product); slowly remove paper piece when paper piece remains" is shown. Accordingly, on the screen 203, the user is guided to remove the sheet existing around the discharge tray 24.

Figure 11F:
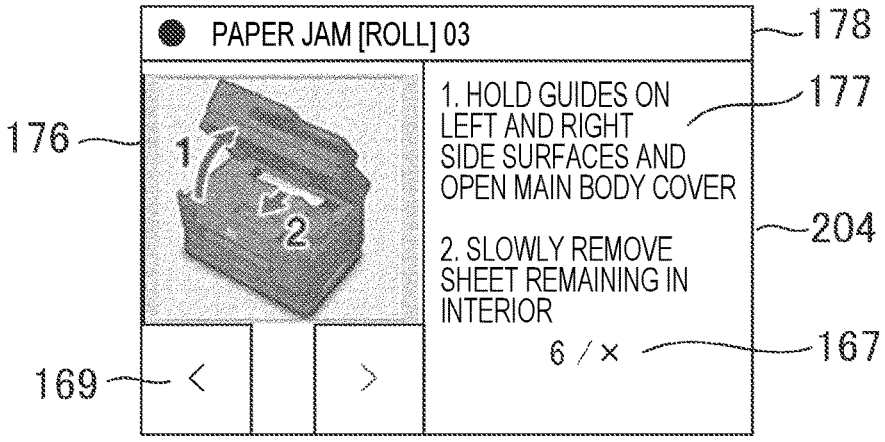

As illustrated in FIG. 11F, on the left side of a screen 204 shown next to the screen 203, an image including a perspective view in which an upper surface of the image recording device 2 is opened and a mark indicating an order of removing the sheet is shown as the object 176. On the right side thereof, the text 177 "1. hold guides on left and right side surfaces and open main body cover; 2. slowly remove sheet remaining in interior" is shown. Accordingly, on the screen 204, the user is guided to remove the sheet around the conveyance roller pair 42 and the guide member 44.

Figure 12A:
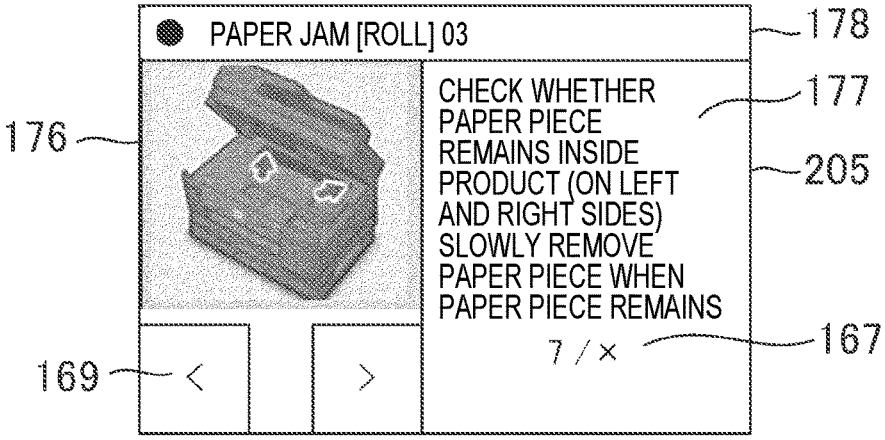
FIG. 12A to FIG. 12F illustrate examples of the screen indicating the third guidance displayed on the display 25.

As illustrated in FIG. 12A, on the left side of a screen 205 shown next to the screen 204, an image including the perspective view in which the upper surface of the image recording device 2 is opened and a mark for checking the right and left sides inside the image recording device 2 is shown as the object 176. On the right side thereof, the text 177 "check whether paper piece remains inside product (on left and right sides); slowly remove paper piece when paper piece remains" is displayed. Accordingly, on the screen 205, the user is guided to remove the sheet around left and right ends of the guide member 44.

Figure 12B:
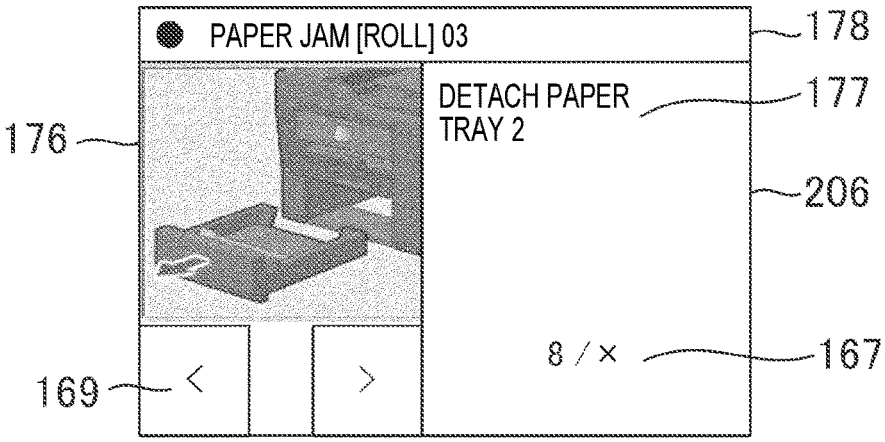

As illustrated in FIG. 12B, on a screen 206 shown next to the screen 205, the object 176 and the text 177 having the same contents as those of the screen 181 are shown. Accordingly, on the screen 206, the user is guided to extract the second tray 23 from the housing 100.

Figure 12C:
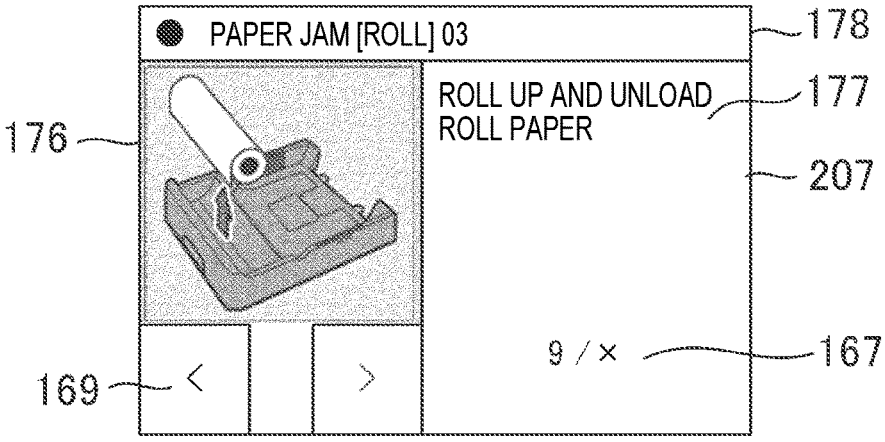

As illustrated in FIG. 12C, on a screen 207 shown next to the screen 206, the object 176 and the text 177 having the same contents as those of the screen 182 are shown. Accordingly, on the screen 207, the user is guided to roll up the roll sheet 46 and unload the roll sheet 46 from the detached second tray 23.

Figure 12D:
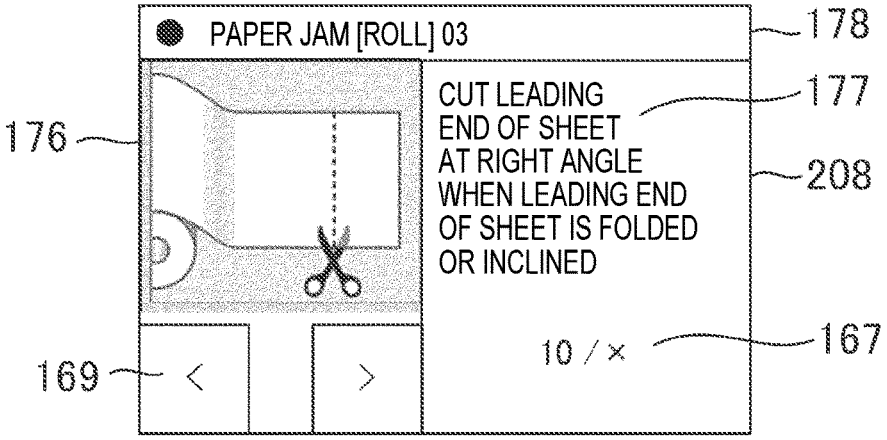

As illustrated in FIG. 12D, on a screen 208 shown next to the screen 207, the object 176 and the text 177 having the same contents as those of the screen 183 are shown. Accordingly, on the screen 208, the user is guided to cut the leading end of the unloaded roll sheet 46 in order to adjust the leading end.

Figure 12E:
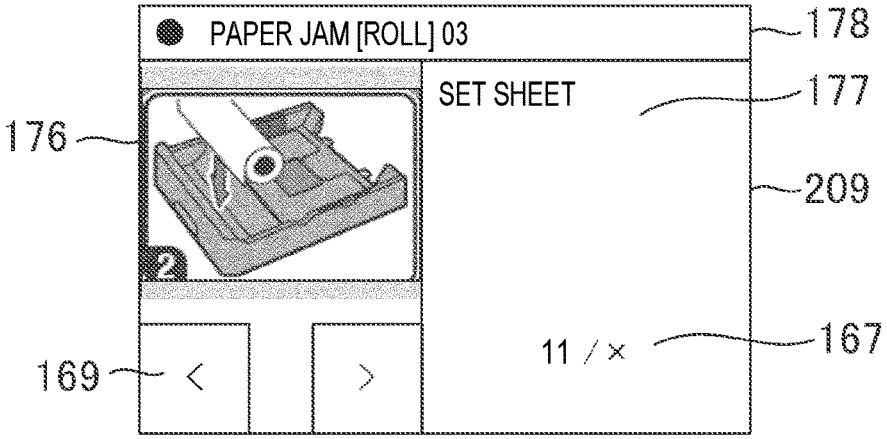

As illustrated in FIG. 12E, on a screen 209 shown next to the screen 208, the object 176 and the text 177 having the same contents as those of the screen 184 are shown. Accordingly, on the screen 209, the user is guided to reset the roll sheet 46 whose leading end is cut in the second tray 23.

Figure 12F:
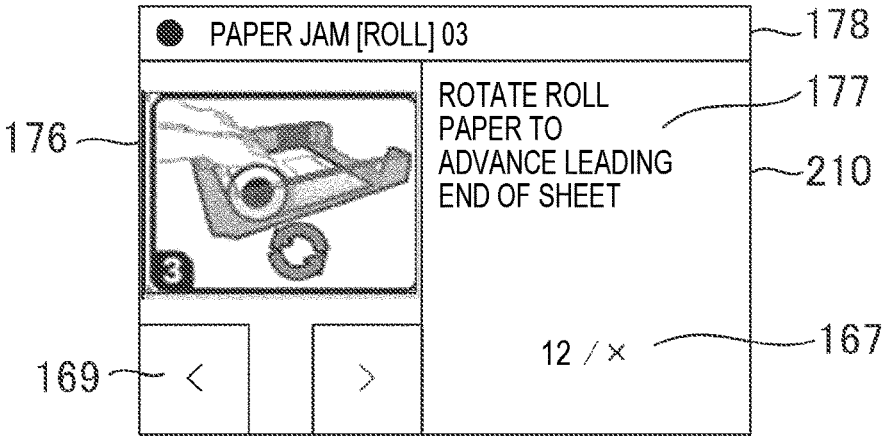

As illustrated in FIG. 12F, on a screen 210 shown next to the screen 209, the object 176 and the text 177 having the same contents as those of the screen 185 are shown. Accordingly, on the screen 210, the user is guided to pull out the leading end of the roll sheet 46 to the passage 33.

Figure 13A:
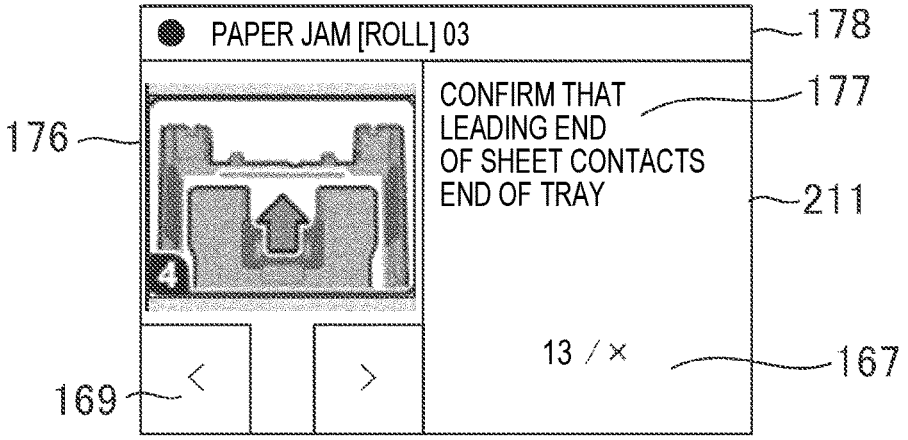
FIG. 13A to FIG. 13E illustrate examples of the screen indicating the third guidance displayed on the display 25.

As illustrated in FIG. 13A, on a screen 211 shown next to the screen 210, the object 176 and the text 177 having the same contents as those of the screen 186 are shown. Accordingly, on the screen 211, the user is guided to bring the leading end of the roll sheet 46 into contact with the protrusion 29.

Figure 13B:
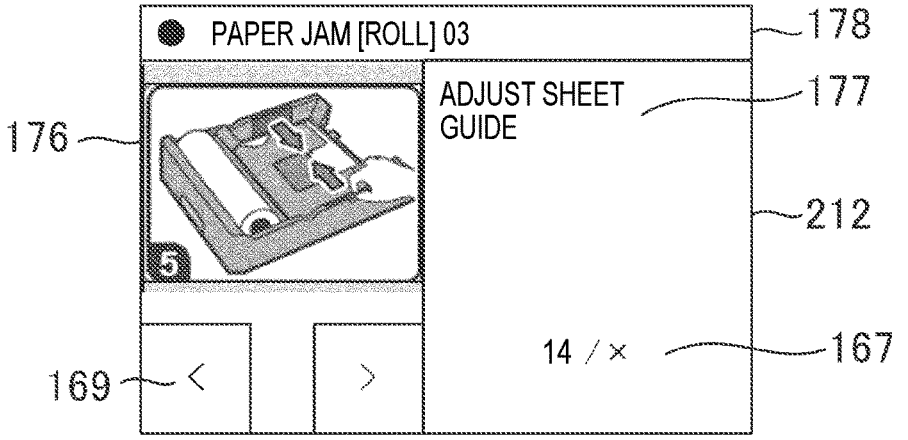

As illustrated in FIG. 13B, on a screen 212 shown next to the screen 211, the object 176 and the text 177 having the same contents as those of the screen 187 are shown. Accordingly, on the screen 212, the user is guided to move the side guides 30 to contact the left and right ends of the sheet pulled out from the roll sheet 46.

Figure 13C:
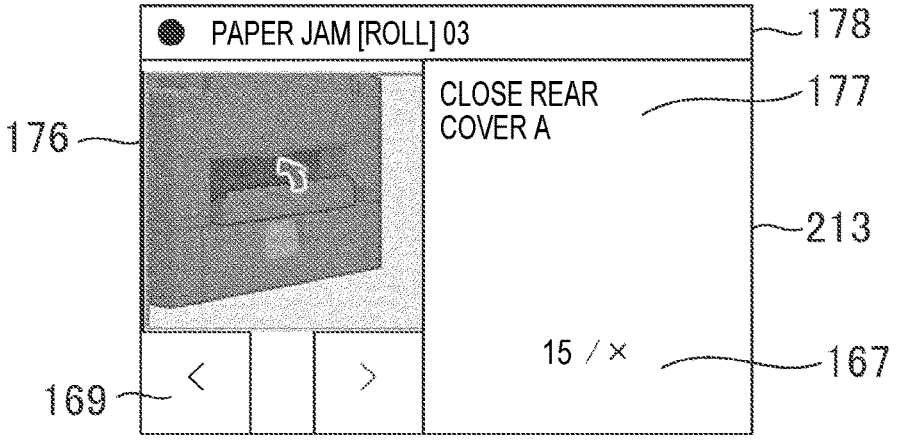

As illustrated in FIG. 13C, on a screen 213 shown next to the screen 212, the object 176 and the text 177 having the same contents as those of the screen 197 are shown. Accordingly, on the screen 213, the user is guided to close the first cover 70 and return the intermediate roller pair 41 to the original state.

Figure 13D:
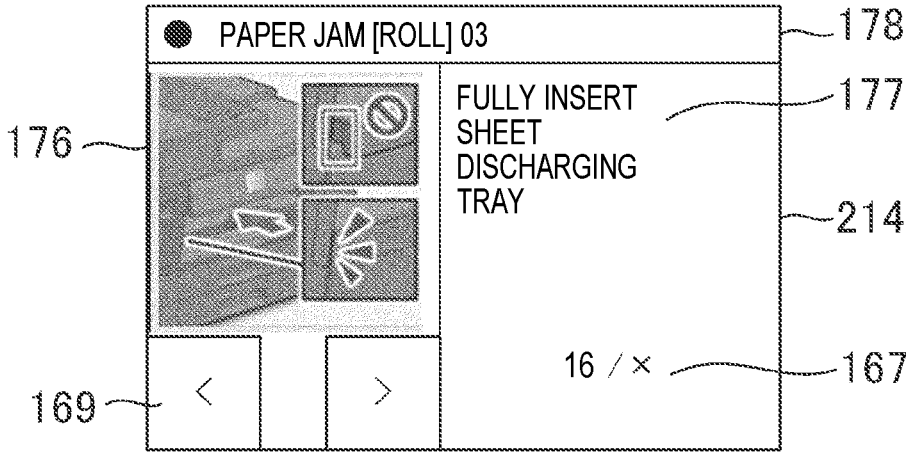

As illustrated in FIG. 13D, on the left side of a screen 214 shown next to the screen 213, an image including a perspective view of the image recording device 2 and the discharge tray 24 attached to the image recording device 2 is shown as the object 176. On the right side thereof, the text 177 "fully insert sheet discharging tray" is shown. Accordingly, on the screen 214, the user is guided to attach the discharge tray 24 to the housing 100.

Figure 13E:
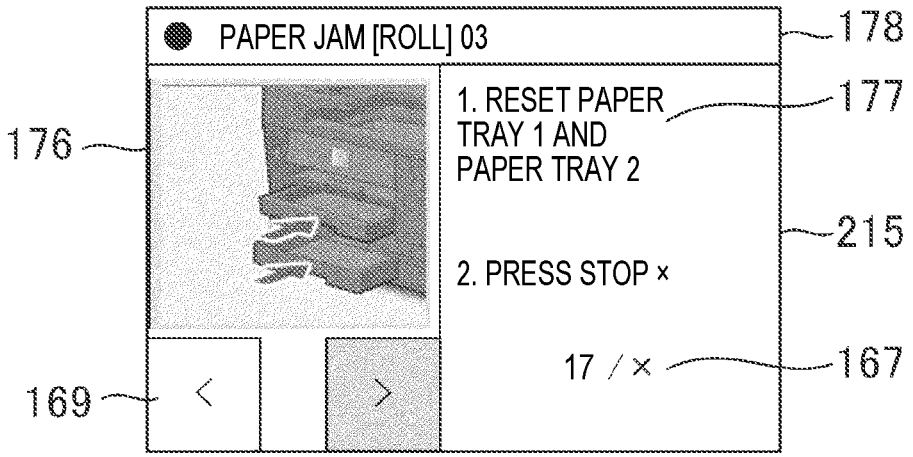

As illustrated in FIG. 13E, on the left side of a screen 215 shown next to the screen 214, an image including the perspective view of the image recording device 2 and PAPER TRAY 1 and PAPER TRAY 2 attached to the image recording device 2 is shown as the object 176. On the right side thereof, the text 177 "1. reset paper tray 1 and paper tray 2; 2. press stop x" is shown. Accordingly, on the screen 215, the user is guided to attach the first tray 22 and the second tray 23 to the housing 100. Accordingly, the guide according to the third guidance ends.

Fourth Guidance

The fourth guidance includes the object display screen indicating, by the object 176, the target location of the image recording device 2 for dealing with the paper jam while the sheet is passing through the discharge sensor 64 after the sheet reaches the conveyance roller pair 42. According to the fourth guidance, the text "unable to cut sheet 03" is displayed as the title 178 (the example of the notification).

Figure 21A:
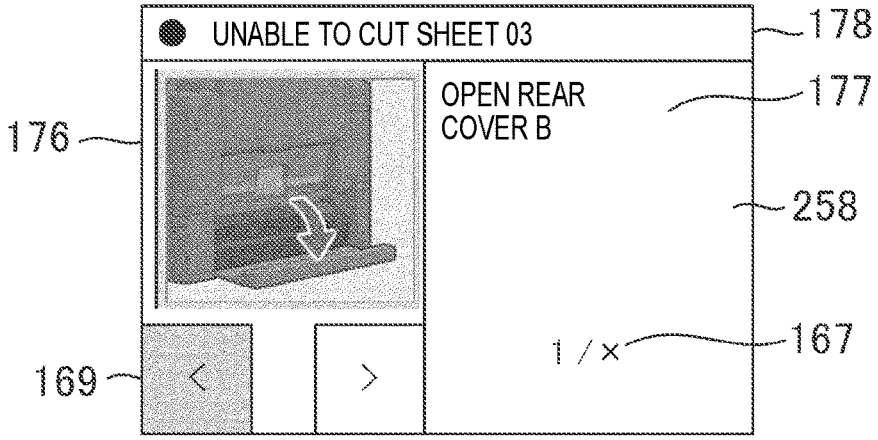
FIG. 21A to FIG. 21F illustrate examples of a screen indicating the fourth guidance displayed on the display 25.

As illustrated in FIG. 21A, on the left side of a screen 258, an image including the rear surface of the image recording device 2 and REAR COVER B to be opened is shown as the object 176. On the right side thereof, the text 177 "open rear cover B" is shown. Accordingly, on the screen 258, the user is guided to open the second cover 71.

Figure 21B:
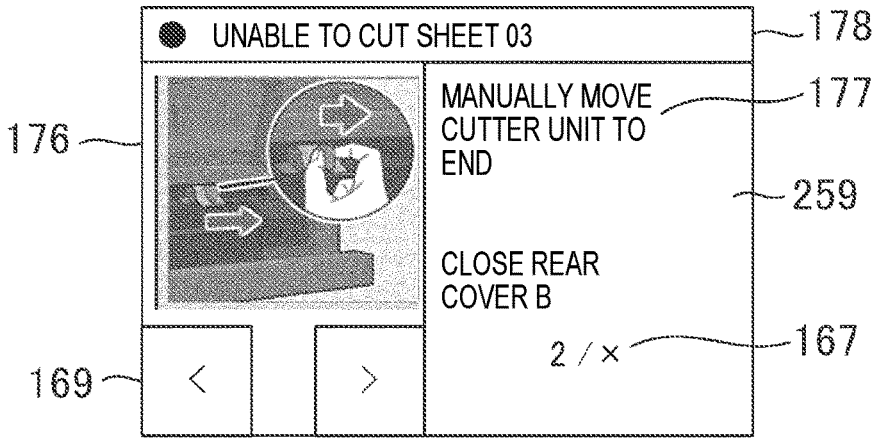

As illustrated in FIG. 21B, on the left side of a screen 259 shown next to the screen 258, an image including the cutter carriage 78 and a mark for moving a cutter unit is shown as the object 176. On the right side thereof, the text 177 "manually move cutter unit to end; close rear cover B" is shown. Accordingly, on the screen 259, the user is guided to move and return the cutter carriage 78 to the start point position 76 and then close the second cover 71.

Figure 21C:
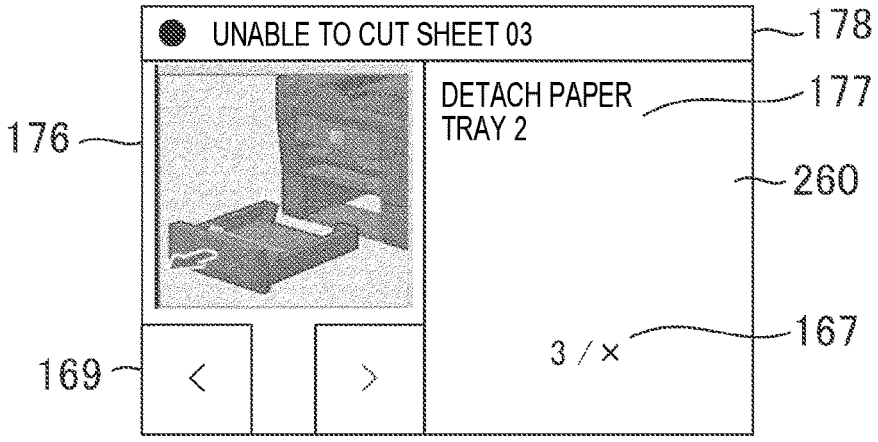

As illustrated in FIG. 21C, on a screen 260 shown next to the screen 259, the object 176 and the text 177 having the same contents as those of the screen 181 are shown. Accordingly, on the screen 260, the user is guided to extract the second tray 23 from the housing 100.

Figure 21D:
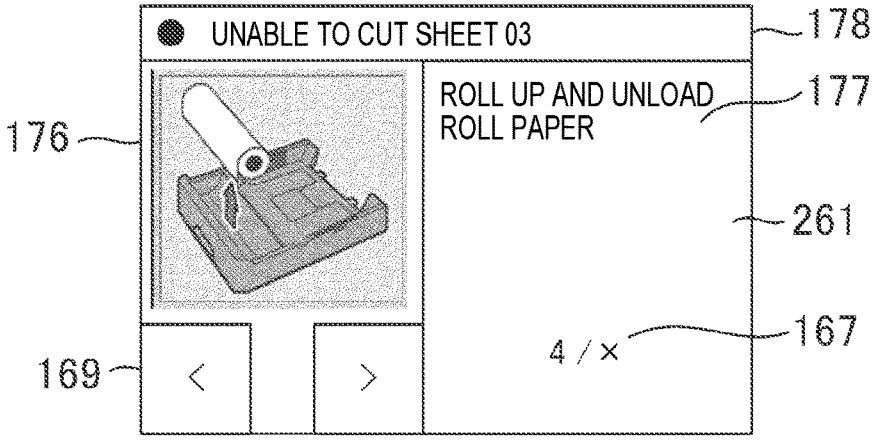

As illustrated in FIG. 21D, on a screen 261 shown next to the screen 260, the object 176 and the text 177 having the same contents as those of the screen 182 are shown. Accordingly, on the screen 261, the user is guided to roll up the roll sheet 46 and unload the roll sheet 46 from the detached second tray 23.

Figure 21E:
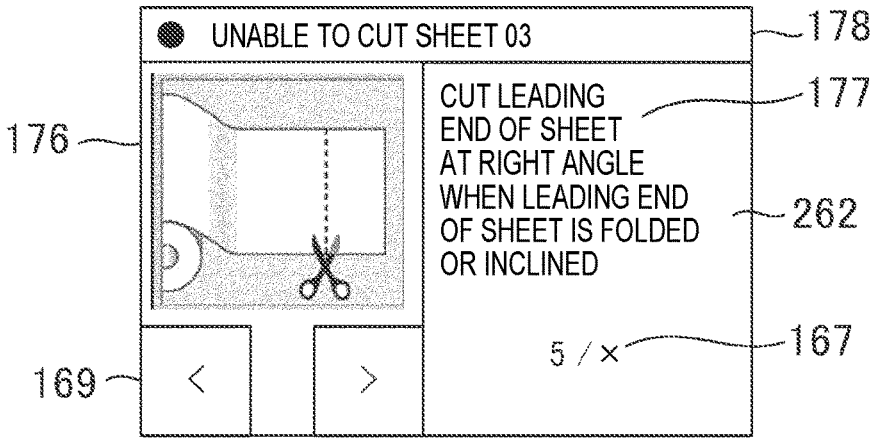

As illustrated in FIG. 21E, on a screen 262 shown next to the screen 261, the object 176 and the text 177 having the same contents as those of the screen 183 are shown. Accordingly, on the screen 262, the user is guided to cut the leading end of the unloaded roll sheet 46 in order to adjust the leading end.

Figure 21F:
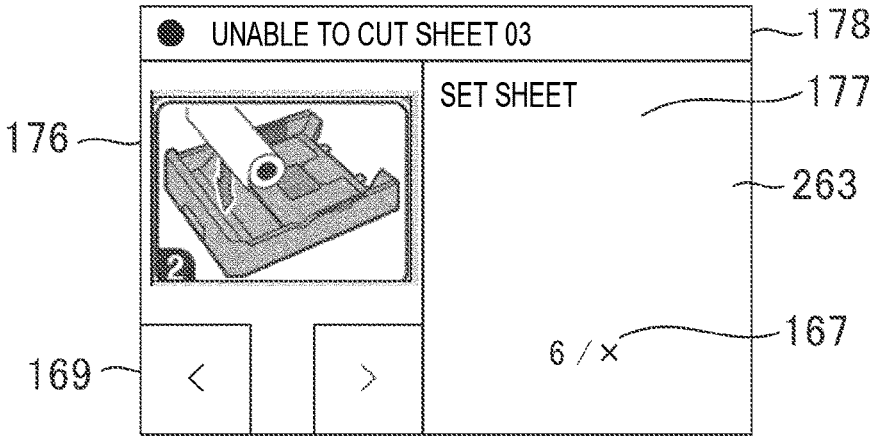

As illustrated in FIG. 21F, on a screen 263 shown next to the screen 262, the object 176 and the text 177 having the same contents as those of the screen 184 are shown. Accordingly, on the screen 263, the user is guided to reset the roll sheet 46 whose leading end is cut in the second tray 23.

Figure 22A:
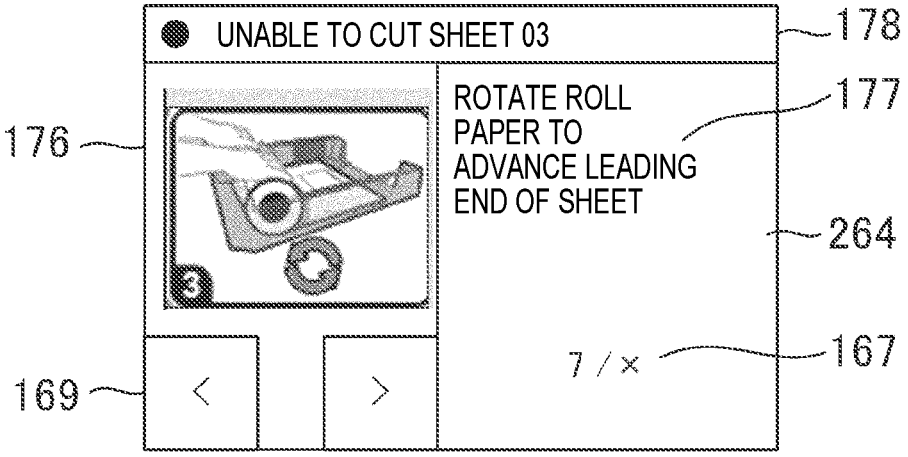
FIG. 22A to FIG. 22D illustrate examples of the screen indicating the fourth guidance displayed on the display 25.

As illustrated in FIG. 22A, on a screen 264 shown next to the screen 263, the object 176 and the text 177 having the same contents as those of the screen 185 are shown. Accordingly, on the screen 264, the user is guided to pull out the leading end of the roll sheet 46 to the passage 33.

Figure 22B:
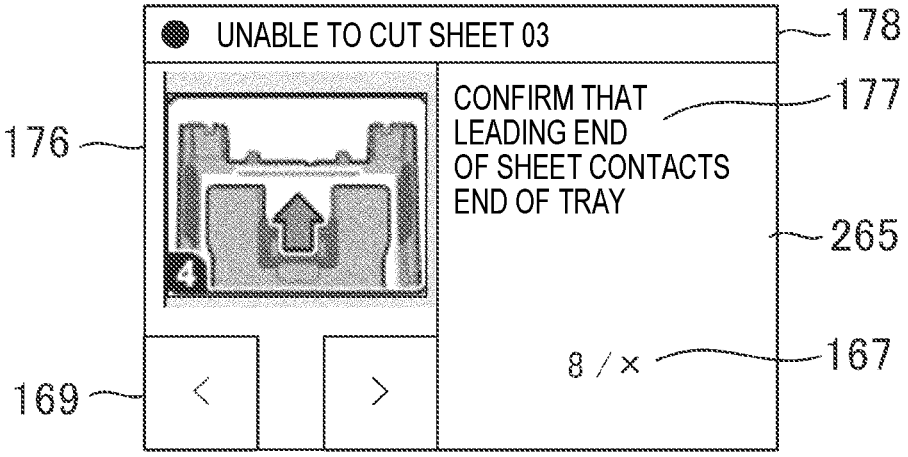

As illustrated in FIG. 22B, on a screen 265 shown next to the screen 264, the object 176 and the text 177 having the same contents as those of the screen 186 are shown.

Accordingly, on the screen 265, the user is guided to bring the leading end of the sheet pulled out from the roll sheet 46 into contact with the protrusion 29.

Figure 22C:
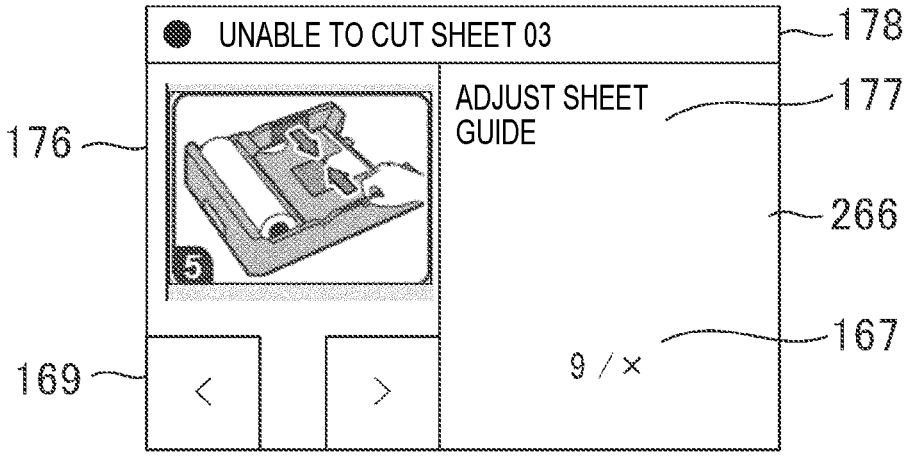

As illustrated in FIG. 22C, on a screen 266 shown next to the screen 265, the object 176 and the text 177 having the same contents as those of the screen 187 are shown.

Accordingly, on the screen 266, the user is guided to bring the side guides 30 to contact the left and right ends of the sheet pulled out from the roll sheet 46.

Figure 22D:
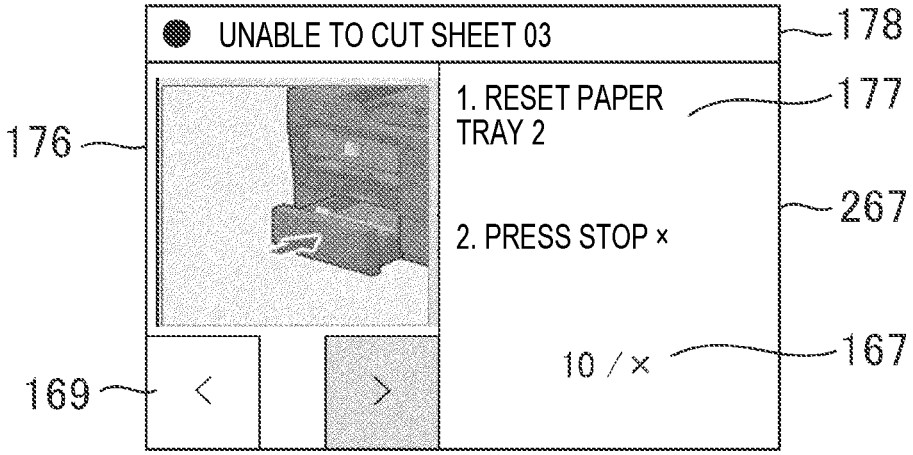

As illustrated in FIG. 22D, on a screen 267 shown next to the screen 266, the object 176 and the text 177 having the same contents as those of the screen 188 are shown. Accordingly, on the screen 267, the user is guided to attach the second tray 23 to the housing 100. Accordingly, the guide according to the fourth guidance ends.

Fifth Guidance

The fifth guidance includes the object display screen indicating, by the object 176, the target location of the image recording device 2 for dealing with the paper jam while the sheet is passing through the discharge sensor 64 after the sheet reaches the conveyance roller pair 42. According to the fifth guidance, the text "unable to cut sheet 01" is displayed as the title 178 (the example of the notification).

Figure 14A:
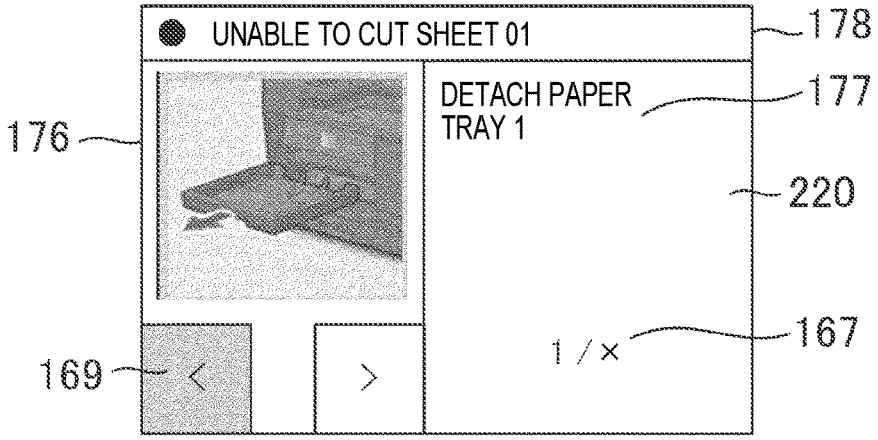
FIG. 14A to FIG. 14F illustrate examples of a screen indicating the fifth guidance displayed on the display 25.

As illustrated in FIG. 14A, on a screen 220, the object 176 and the text 177 having the same contents as those of the screen 199 are shown. Accordingly, on the screen 220, the user is guided to extract the first tray 22 from the housing 100.

Figure 14B:
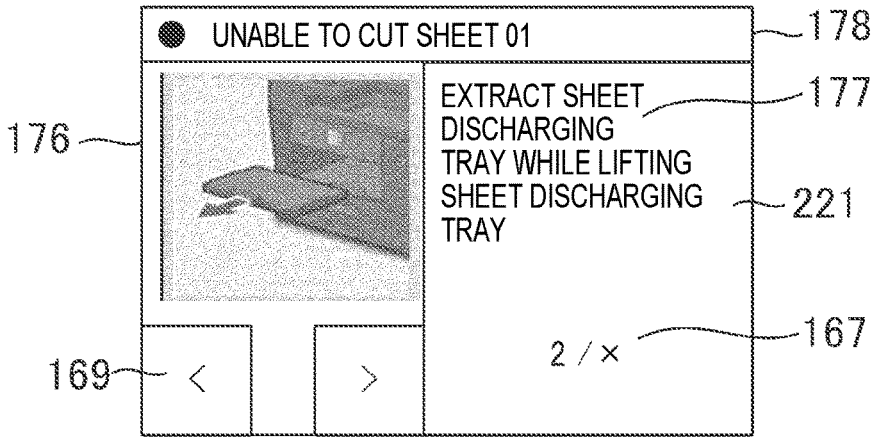

As illustrated in FIG. 14B, on a screen 221 shown next to the screen 220, the object 176 and the text 177 having the same contents as those of the screen 200 are shown. Accordingly, on the screen 221, the user is guided to detach the discharge tray 24 from the housing 100.

Figure 14C:
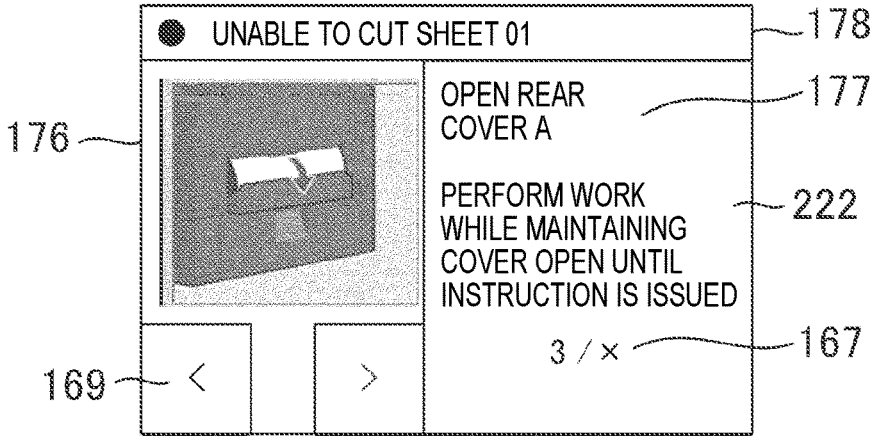

As illustrated in FIG. 14C, on a screen 222 shown next to the screen 221, the object 176 and the text 177 having the same contents as those of the screen 189 are shown. Accordingly, on the screen 222, the user is guided to open the first cover 70 and release the nipping of the sheet by the intermediate roller pair 41.

Figure 14D:
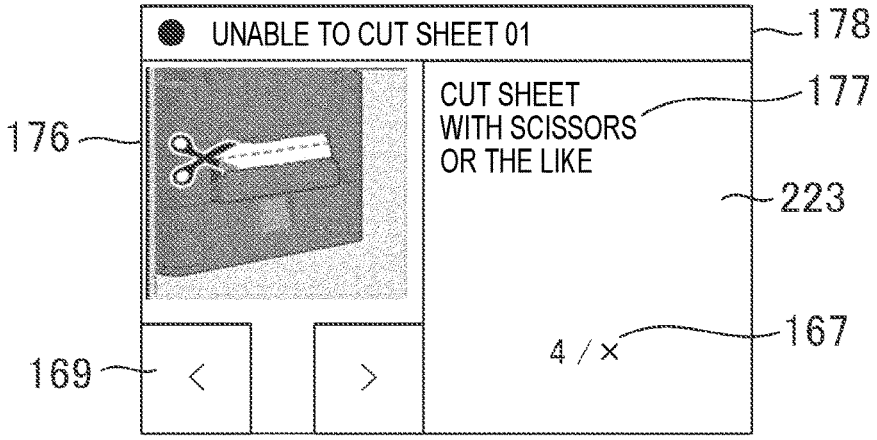

As illustrated in FIG. 14D, on the left side of a screen 223 shown next to the screen 222, an image including REAR COVER A to be opened and a mark for cutting the sheet is shown as the object 176. On the right side thereof, the text 177 "cut sheet with scissors or the like" is shown. Accordingly, on the screen 223, the user is guided to manually cut the sheet along the left-right direction 9 at a position of the first cover 70.

Figure 14E:
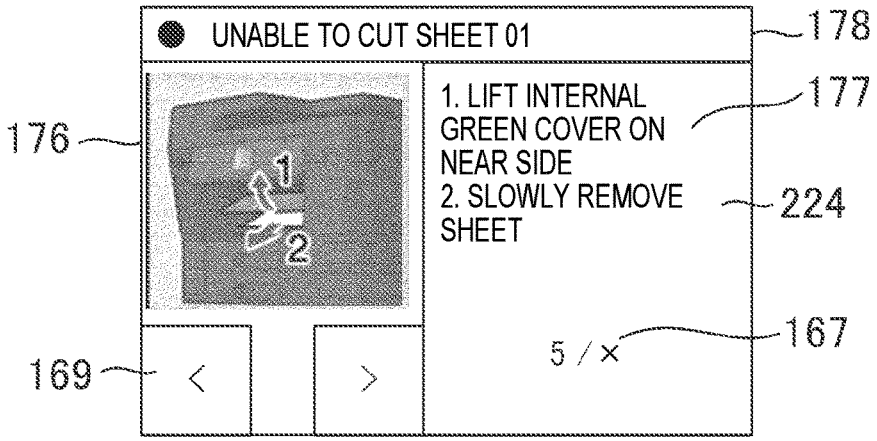

As illustrated in FIG. 14E, on a screen 224 shown next to the screen 223, the object 176 and the text 177 having the same contents as those of the screen 202 are shown. Accordingly, on the screen 224, the user is guided to extract the sheet existing downstream of the cutter 5 in the conveyance direction 17.

Figure 14F:
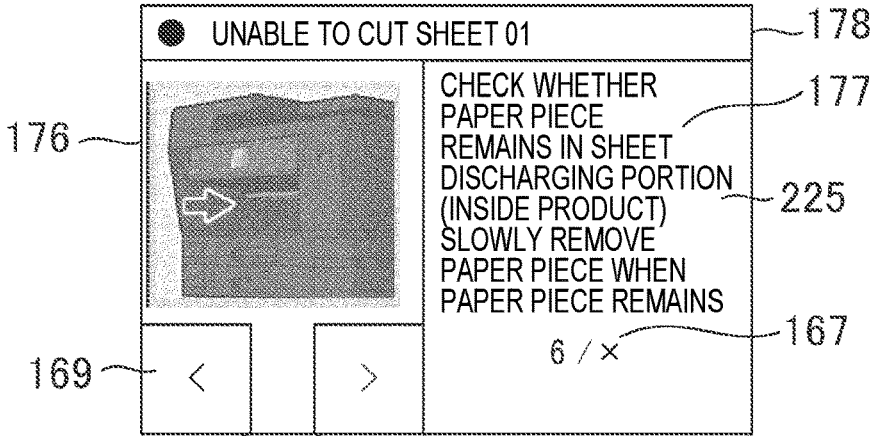

As illustrated in FIG. 14F, on a screen 225 shown next to the screen 224, the object 176 and the text 177 having the same contents as those of the screen 203 are shown. Accordingly, on the screen 225, the user is guided to remove the sheet existing around the discharge tray 24.

Figure 15A:
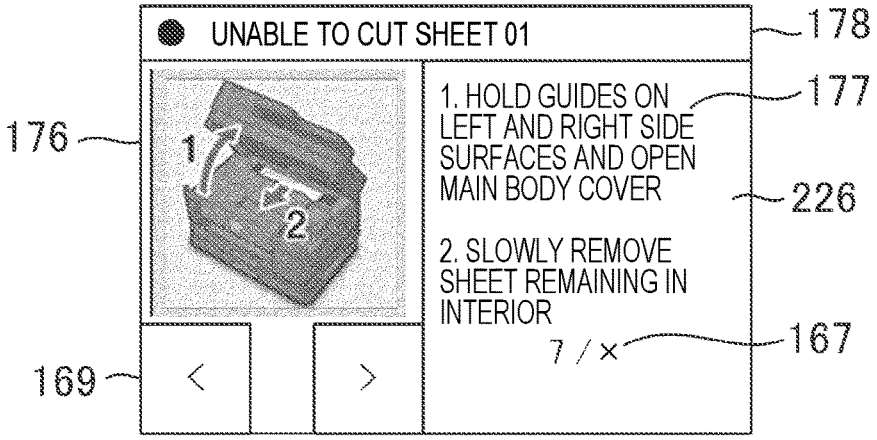
FIG. 15A to FIG. 15F illustrate examples of the screen indicating the fifth guidance displayed on the display 25.

As illustrated in FIG. 15A, on a screen 226 shown next to the screen 225, the object 176 and the text 177 having the same contents as those of the screen 204 are shown. Accordingly, on the screen 226, the user is guided to remove the sheet around the conveyance roller pair 42 and the guide member 44.

Figure 15B:
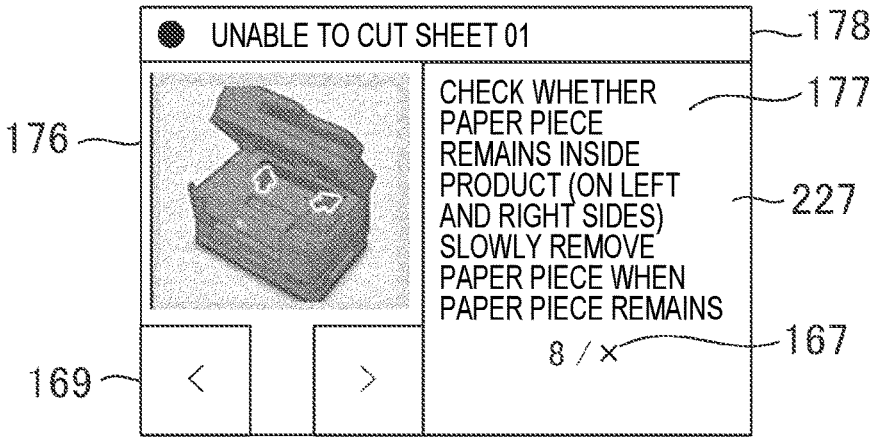

As illustrated in FIG. 15B, on a screen 227 shown next to the screen 226, the object 176 and the text 177 having the same contents as those of the screen 205 are shown. Accordingly, on the screen 227, the user is guided to remove the sheet around the left and right ends of the guide member 44.

Figure 15C:
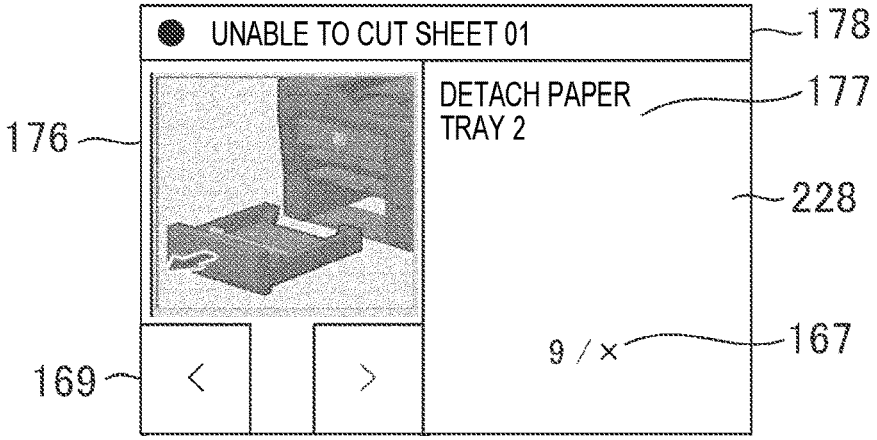

As illustrated in FIG. 15C, on a screen 228 shown next to the screen 227, the object 176 and the text 177 having the same contents as those of the screen 181 are shown. Accordingly, on the screen 228, the user is guided to extract the second tray 23 from the housing 100.

Figure 15D:
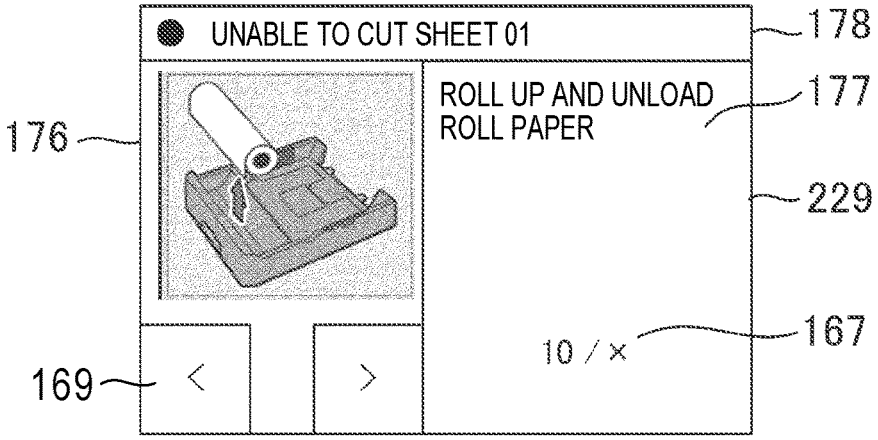

As illustrated in FIG. 15D, on a screen 229 shown next to the screen 228, the object 176 and the text 177 having the same contents as those of the screen 182 are shown. Accordingly, on the screen 229, the user is guided to roll up the roll sheet 46 and unload the roll sheet 46 from the detached second tray 23.

Figure 15E:
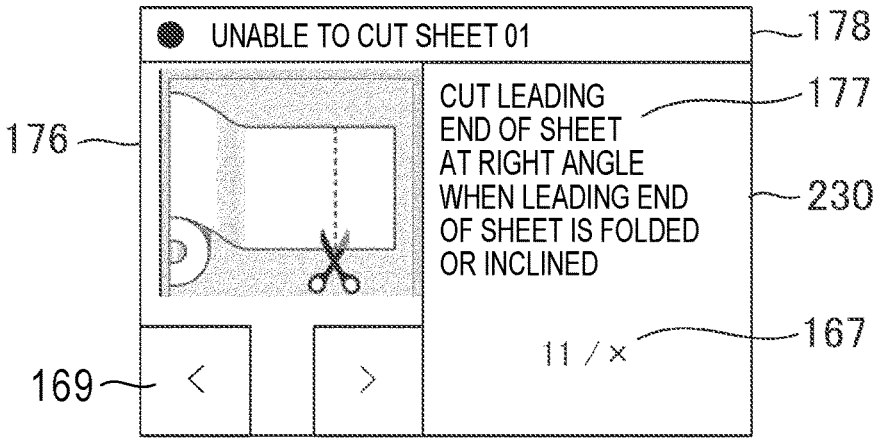

As illustrated in FIG. 15E, on a screen 230 shown next to the screen 229, the object 176 and the text 177 having the same contents as those of the screen 183 are shown. Accordingly, on the screen 230, the user is guided to cut the leading end of the unloaded roll sheet 46 in order to adjust the leading end.

Figure 15F:
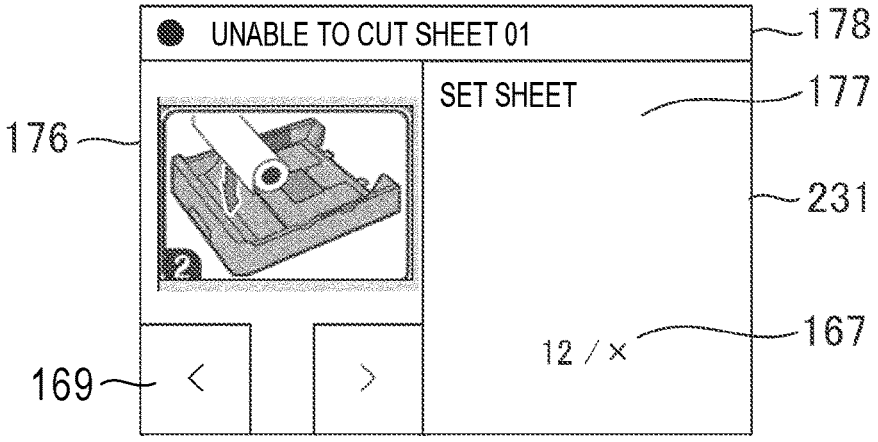

As illustrated in FIG. 15F, on a screen 231 shown next to the screen 230, the object 176 and the text 177 having the same contents as those of the screen 184 are shown. Accordingly, on the screen 231, the user is guided to reset the roll sheet 46 whose leading end is cut in the second tray 23.

Figure 16A:
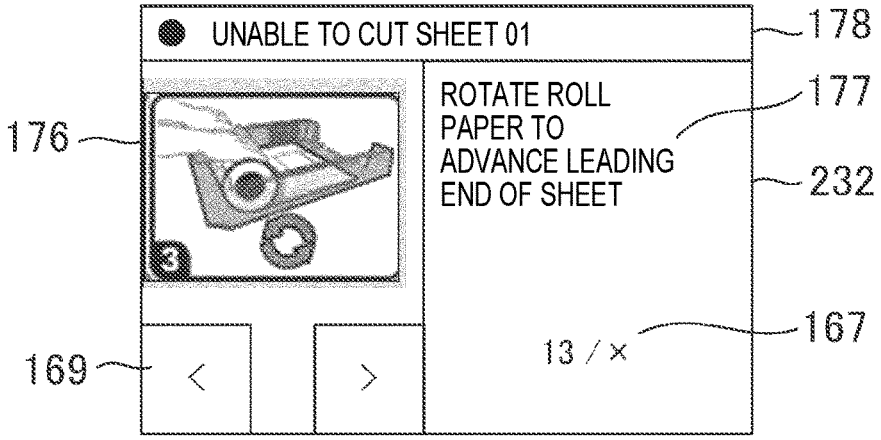
FIG. 16A to FIG. 16F illustrate examples of the screen indicating the fifth guidance displayed on the display 25.

As illustrated in FIG. 16A, on a screen 232 shown next to the screen 231, the object 176 and the text 177 having the same contents as those of the screen 185 are shown. Accordingly, on the screen 232, the user is guided to pull out the leading end of the roll sheet 46 to the passage 33.

Figure 16B:
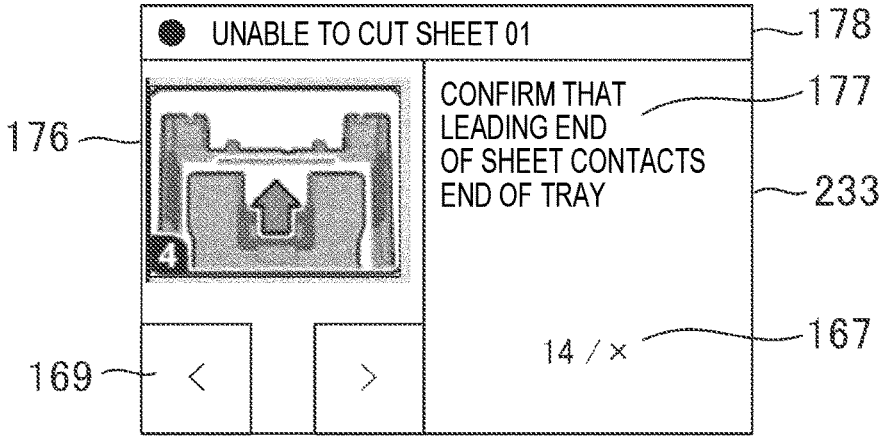

As illustrated in FIG. 16B, on a screen 233 shown next to the screen 232, the object 176 and the text 177 having the same contents as those of the screen 186 are shown. Accordingly, on the screen 233, the user is guided to bring the leading end of the sheet pulled out from the roll sheet 46 into contact with the protrusion 29.

Figure 16C:
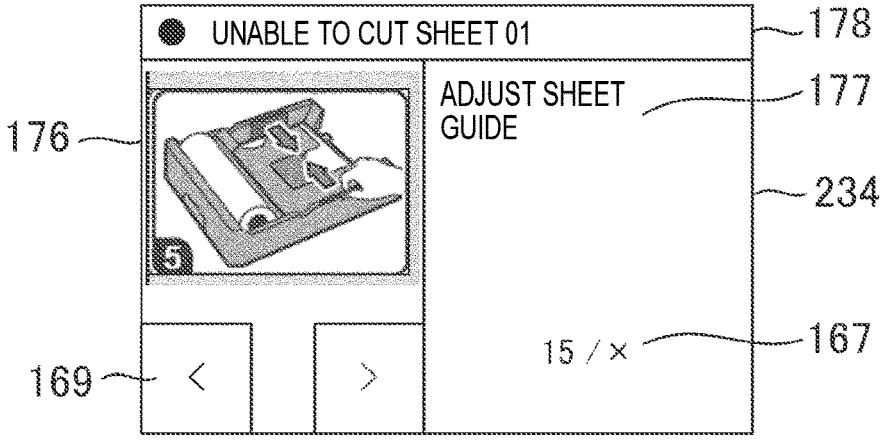

As illustrated in FIG. 16C, on a screen 234 shown next to the screen 233, the object 176 and the text 177 having the same contents as those of the screen 187 are shown. Accordingly, on the screen 234, the user is guided to move the side guides 30 to contact the left and right ends of the sheet pulled out from the roll sheet 46.

Figure 16D:
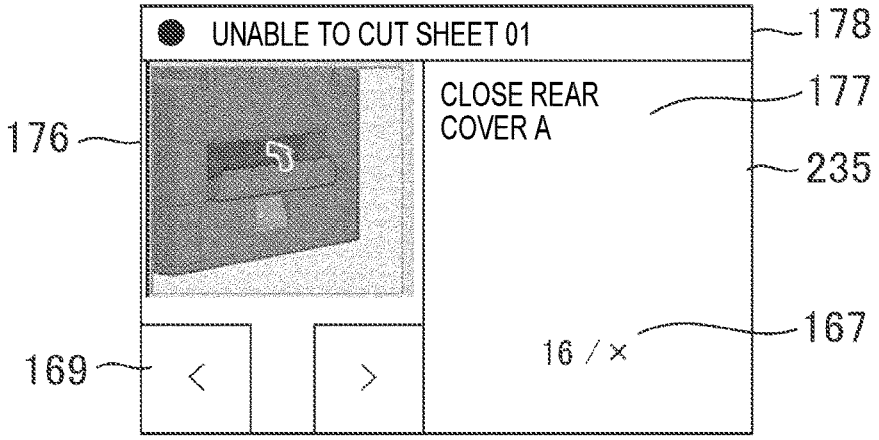

As illustrated in FIG. 16D, on a screen 235 shown next to the screen 234, the object 176 and the text 177 having the same contents as those of the screen 197 are shown. Accordingly, on the screen 235, the user is guided to close the first cover 70 and return the intermediate roller pair 41 to the original state.

Figure 16E:
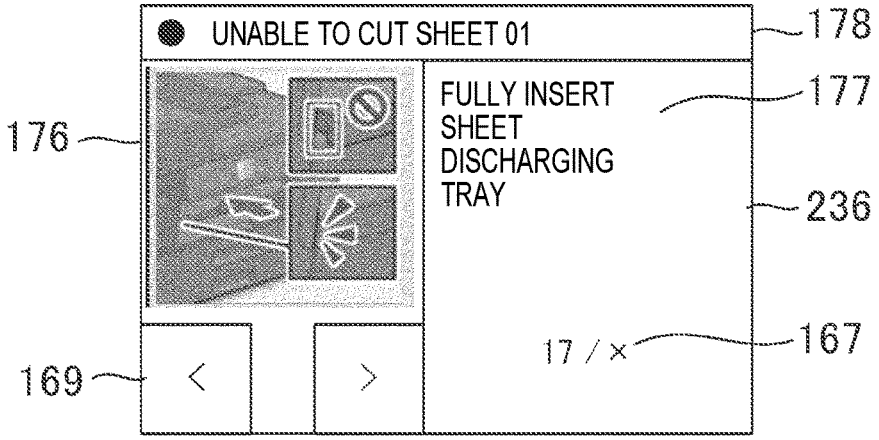

As illustrated in FIG. 16E, on a screen 236 shown next to the screen 235, the object 176 and the text 177 having the same contents as those of the screen 214 are shown. Accordingly, on the screen 236, the user is guided to attach the discharge tray 24 to the housing 100.

Figure 16F:
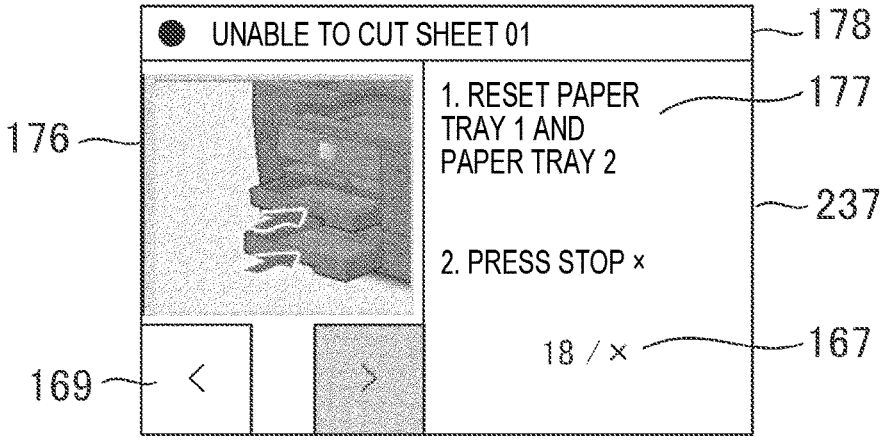

As illustrated in FIG. 16F, on a screen 237 shown next to the screen 236, the object 176 and the text 177 having the same contents as those of the screen 215 are shown. Accordingly, on the screen 237, the user is guided to attach the first tray 22 and the second tray 23 to the housing 100. Accordingly, the guide according to the fifth guidance ends.

Sixth Guidance

The sixth guidance includes the object display screen indicating, by the object 176, the target location of the image recording device 2 for dealing with the paper jam while the sheet is passing through the discharge sensor 64 after the sheet reaches the conveyance roller pair 42. According to the sixth guidance, the text "unable to cut sheet 02" is displayed as the title 178 (the example of the notification).

Figure 17A:
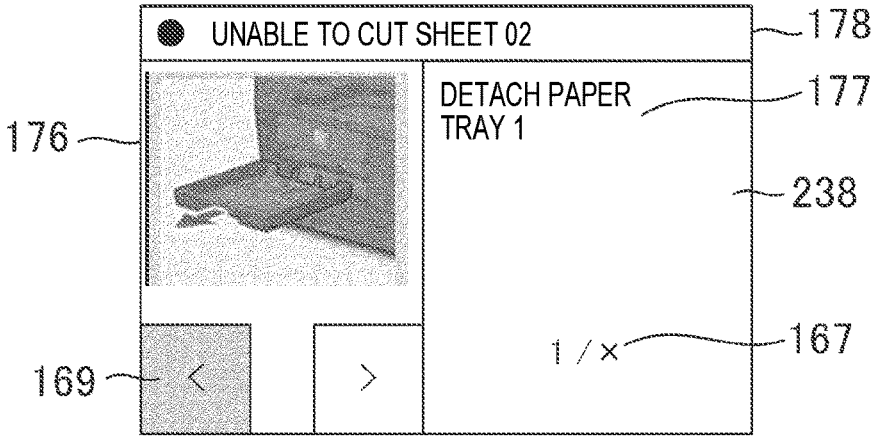
FIG. 17A to FIG. 17F illustrate examples of a screen indicating the sixth guidance displayed on the display 25.

As illustrated in FIG. 17A, on a screen 238, the object 176 and the text 177 having the same contents as those of the screen 199 are shown. Accordingly, on the screen 238, the user is guided to detach the first tray 22 from the housing 100.

Figure 17B:
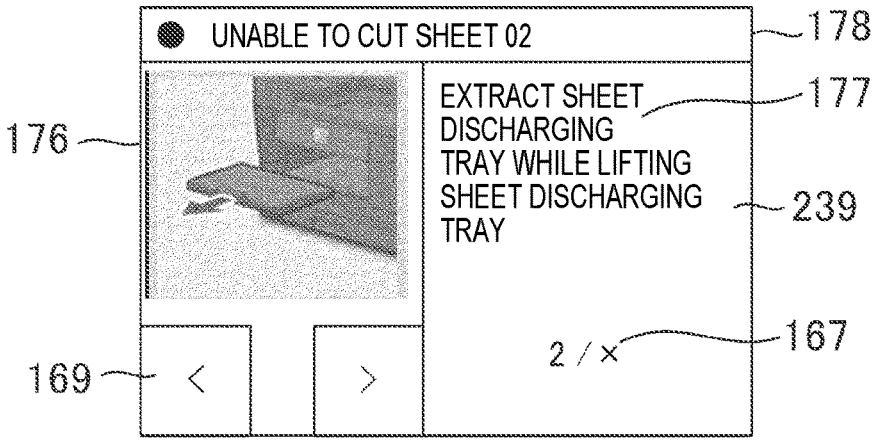

As illustrated in FIG. 17B, on a screen 239 shown next to the screen 238, the object 176 and the text 177 having the same contents as those of the screen 200 are shown. Accordingly, on the screen 239, the user is guided to detach the discharge tray 24 from the housing 100.

Figure 17C:
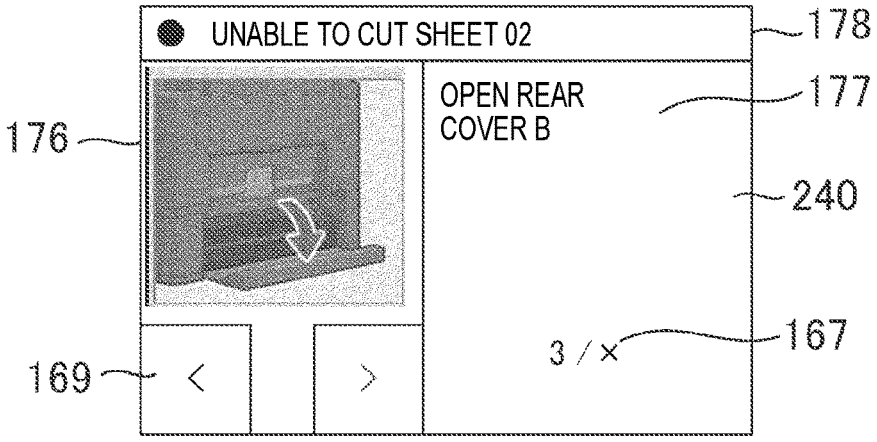

As illustrated in FIG. 17C, on a screen 240 shown next to the screen 239, the object 176 and the text 177 having the same contents as those of the screen 258 are shown. Accordingly, on the screen 240, the user is guided to open the second cover 71.

Figure 17D:
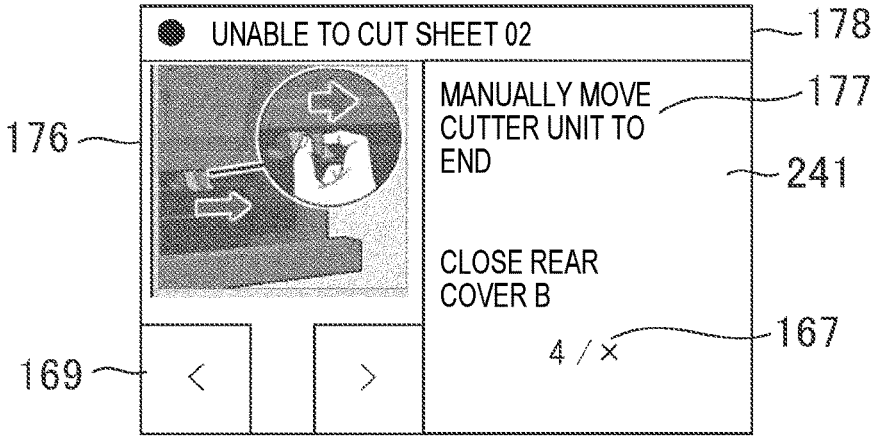

As illustrated in FIG. 17D, on a screen 241 shown next to the screen 240, the object 176 and the text 177 having the same contents as those of the screen 259 are shown. Accordingly, on the screen 241, the user is guided to move and return the cutter carriage 78 to the start point position 76 and then close the second cover 71.

Figure 17E:
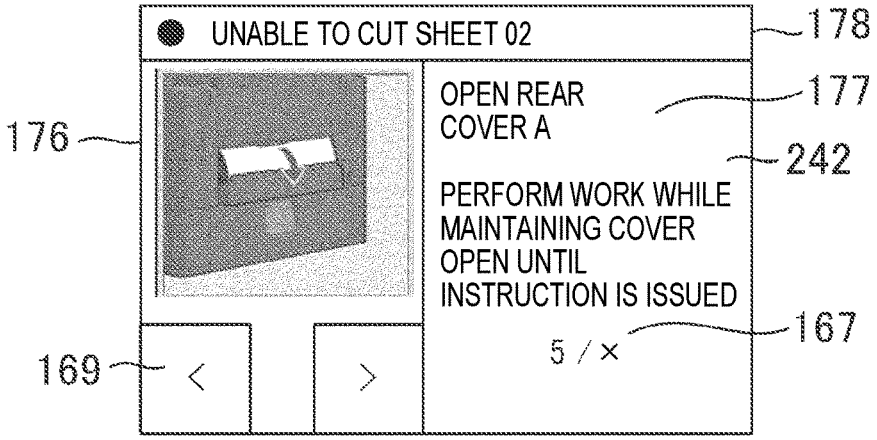

As illustrated in FIG. 17E, on a screen 242 shown next to the screen 241, the object 176 and the text 177 having the same contents as those of the screen 189 are shown. Accordingly, on the screen 242, the user is guided to open the first cover 70 and release the nipping of the sheet by the intermediate roller pair 41.

Figure 17F:
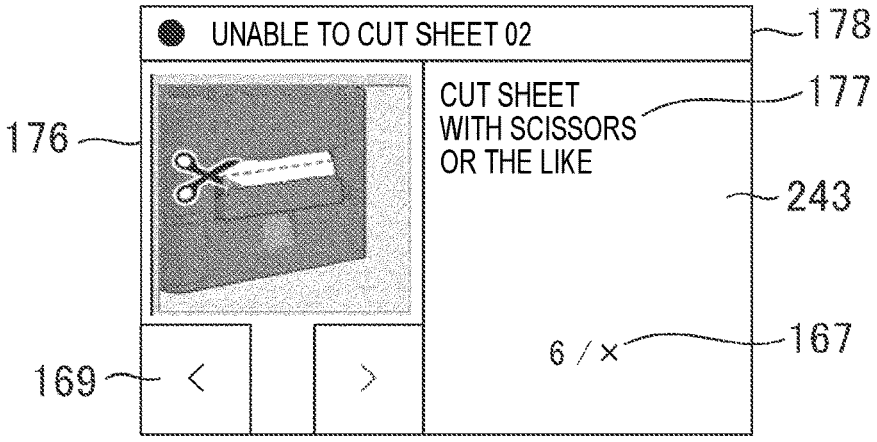

As illustrated in FIG. 17F, on a screen 243 shown next to the screen 242, the object 176 and the text 177 having the same contents as those of the screen 223 are shown. Accordingly, on the screen 243, the user is guided to manually cut the sheet along the left-right direction 9 at the position of the first cover 70.

Figure 18A:
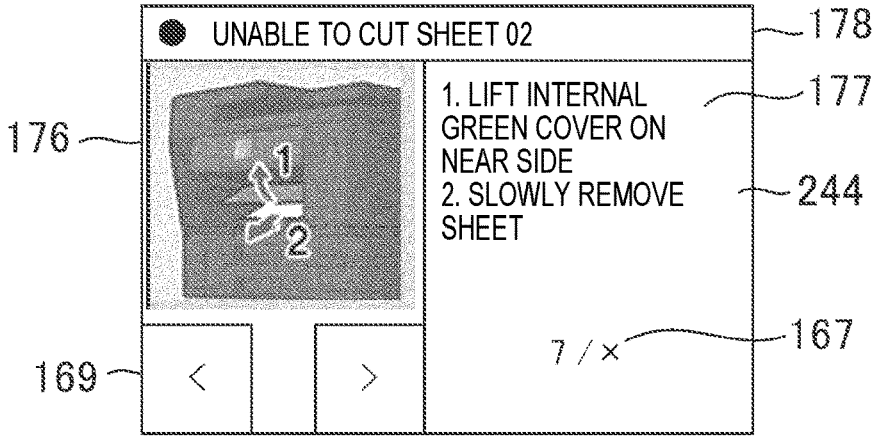
FIG. 18A to FIG. 18F illustrate examples of the screen indicating the sixth guidance displayed on the display 25.

As illustrated in FIG. 18A, on a screen 244 shown next to the screen 243, the object 176 and the text 177 having the same contents as those of the screen 202 are shown. Accordingly, on the screen 244, the user is guided to extract the sheet existing downstream of the cutter 5 in the conveyance direction 17.

Figure 18B:
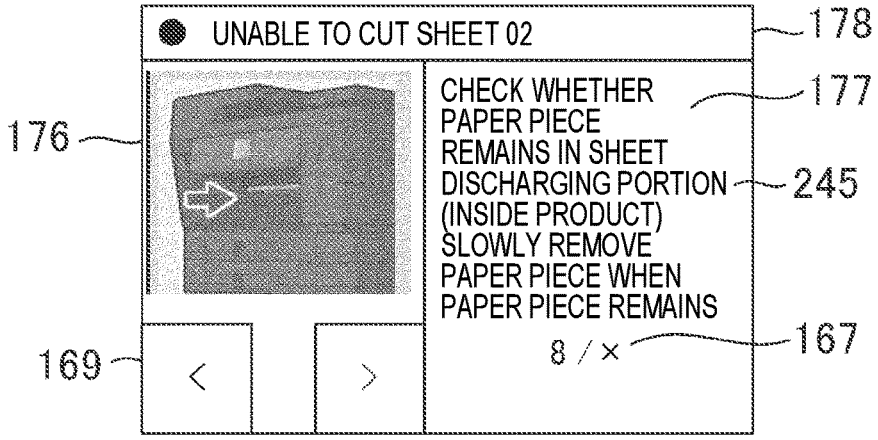

As illustrated in FIG. 18B, on a screen 245 shown next to the screen 244, the object 176 and the text 177 having the same contents as those of the screen 203 are shown. Accordingly, on the screen 245, the user is guided to remove the sheet existing around the discharge tray 24.

Figure 18C:
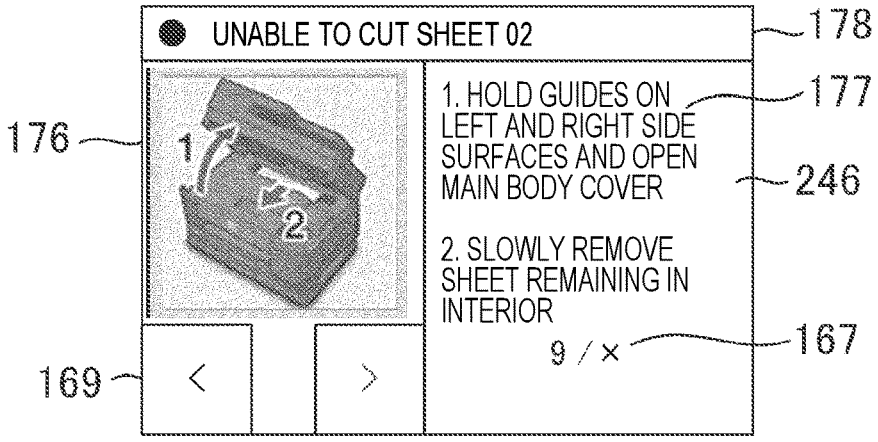

As illustrated in FIG. 18C, on a screen 246 shown next to the screen 245, the object 176 and the text 177 having the same contents as those of the screen 204 are shown. Accordingly, on the screen 246, the user is guided to remove the sheet around the conveyance roller pair 42 and the guide member 44.

Figure 18D:
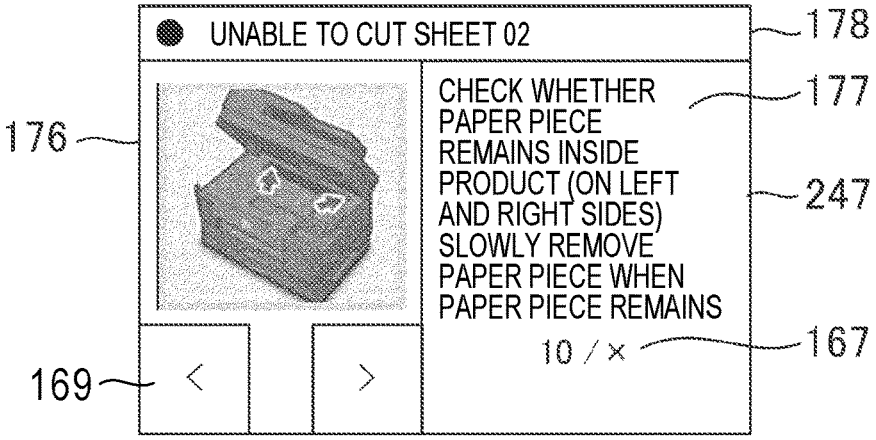

As illustrated in FIG. 18D, on a screen 247 shown next to the screen 246, the object 176 and the text 177 having the same contents as those of the screen 205 are shown. Accordingly, on the screen 247, the user is guided to remove the sheet around the left and right ends of the guide member 44.

Figure 18E:
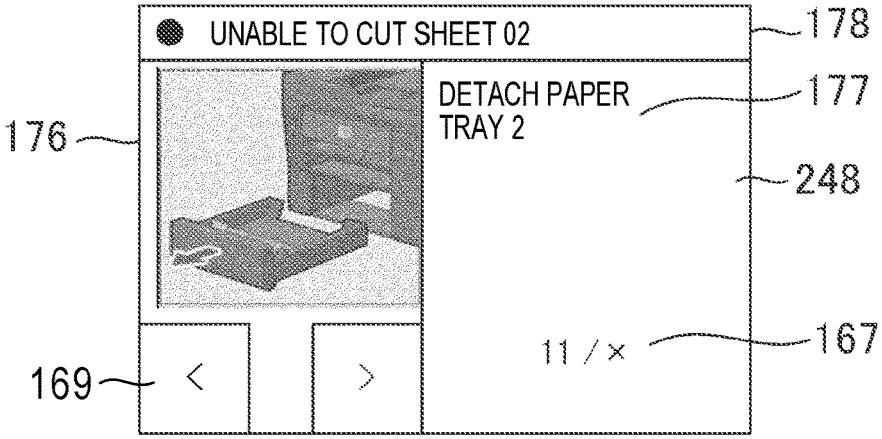

As illustrated in FIG. 18E, on a screen 248 shown next to the screen 247, the object 176 and the text 177 having the same contents as those of the screen 181 are shown. Accordingly, on the screen 248, the user is guided to extract the second tray 23 from the housing 100.

Figure 18F:
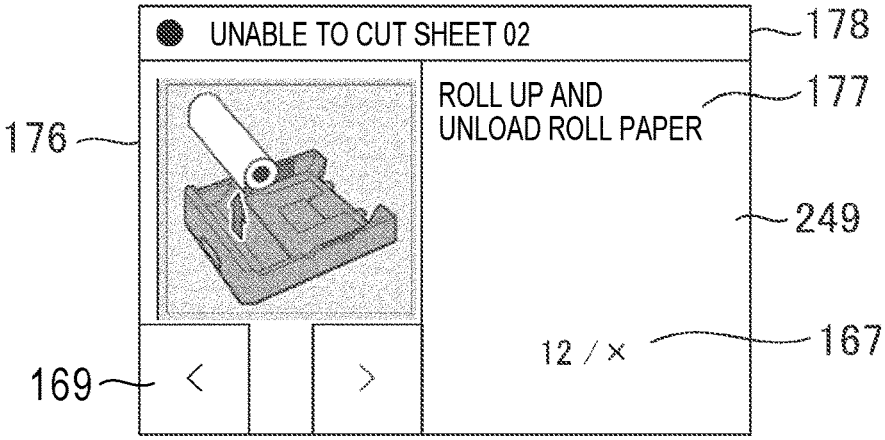

As illustrated in FIG. 18F, on a screen 249 shown next to the screen 248, the object 176 and the text 177 having the same contents as those of the screen 182 are shown. Accordingly, on the screen 249, the user is guided to roll up the roll sheet 46 and unload the roll sheet 46 from the detached second tray 23.

Figure 19A:
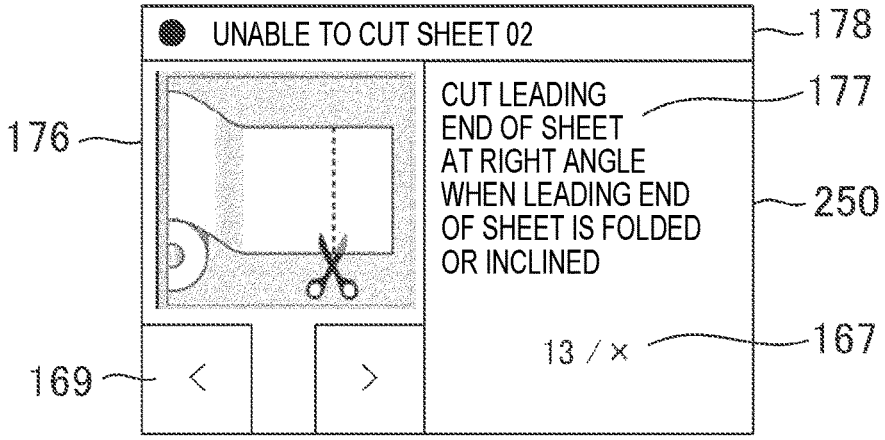
FIG. 19A to FIG. 19F illustrate examples of the screen indicating the sixth guidance displayed on the display 25.

As illustrated in FIG. 19A, on a screen 250 shown next to the screen 249, the object 176 and the text 177 having the same contents as those of the screen 183 are shown. Accordingly, on the screen 250, the user is guided to cut the leading end of the unloaded roll sheet 46 in order to adjust the leading end.

Figure 19B:
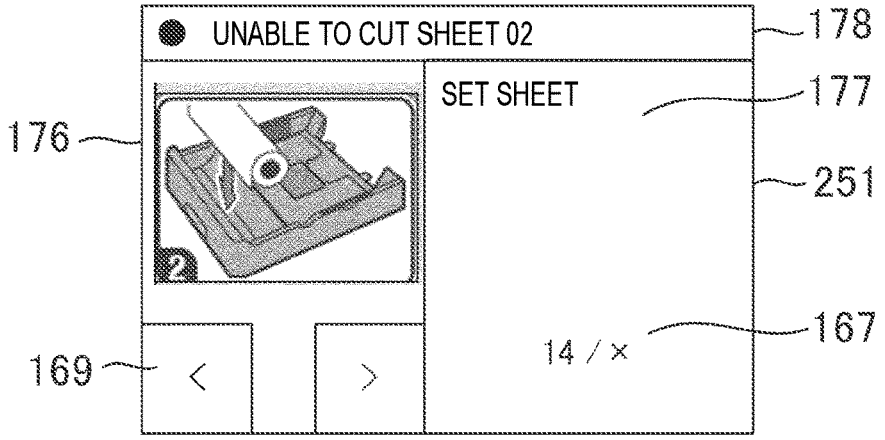

As illustrated in FIG. 19B, on a screen 251 shown next to the screen 250, the object 176 and the text 177 having the same contents as those of the screen 184 are shown. Accordingly, on the screen 251, the user is guided to reset the roll sheet 46 whose leading end is cut in the second tray 23.

Figure 19C:
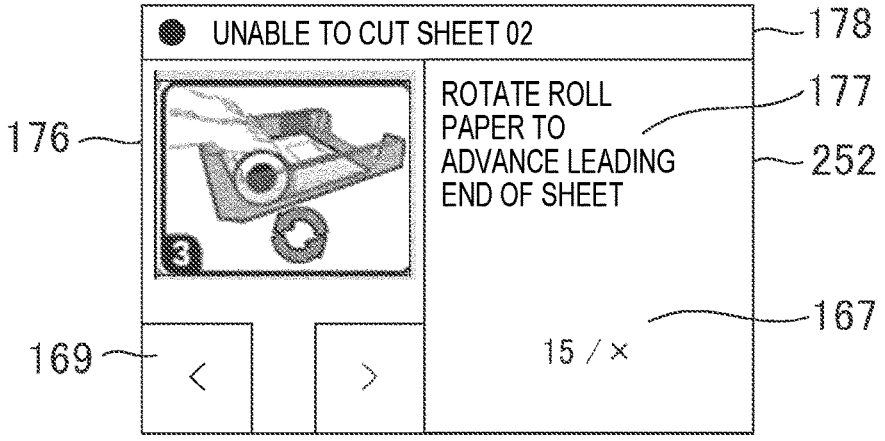

As illustrated in FIG. 19C, on a screen 252 shown next to the screen 251, the object 176 and the text 177 having the same contents as those of the screen 185 are shown. Accordingly, on the screen 252, the user is guided to pull out the leading end of the roll sheet 46 to the passage 33.

Figure 19D:
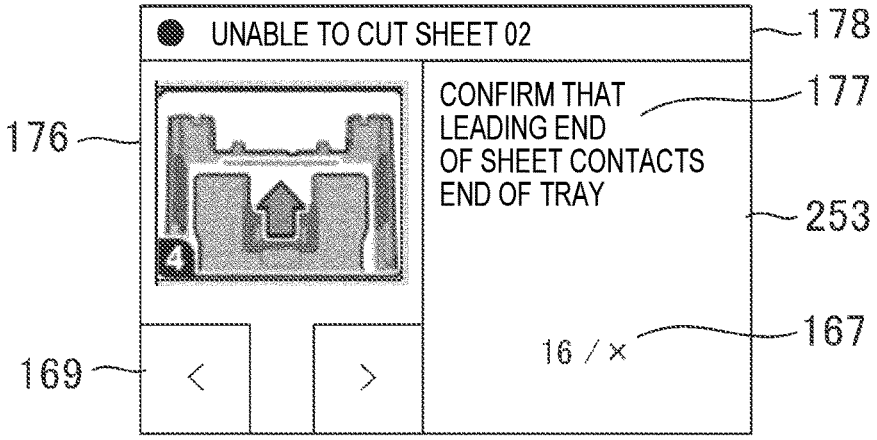

As illustrated in FIG. 19D, on a screen 253 shown next to the screen 252, the object 176 and the text 177 having the same contents as those of the screen 186 are shown. Accordingly, on the screen 253, the user is guided to bring the leading end of the sheet pulled out from the roll sheet 46 into contact with the protrusion 29.

Figure 19E:
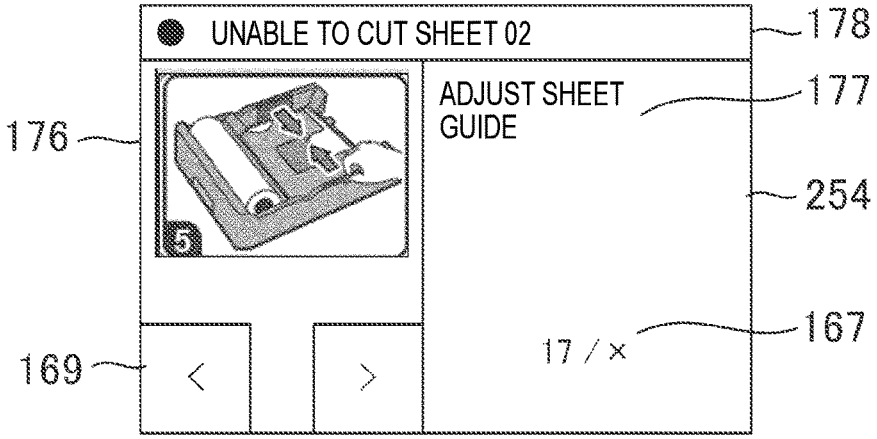

As illustrated in FIG. 19E, on a screen 254 shown next to the screen 253, the object 176 and the text 177 having the same contents as those of the screen 187 are shown. Accordingly, on the screen 254, the user is guided to move the side guides 30 to contact the left and right ends of the sheet pulled out from the roll sheet 46.

Figure 19F:
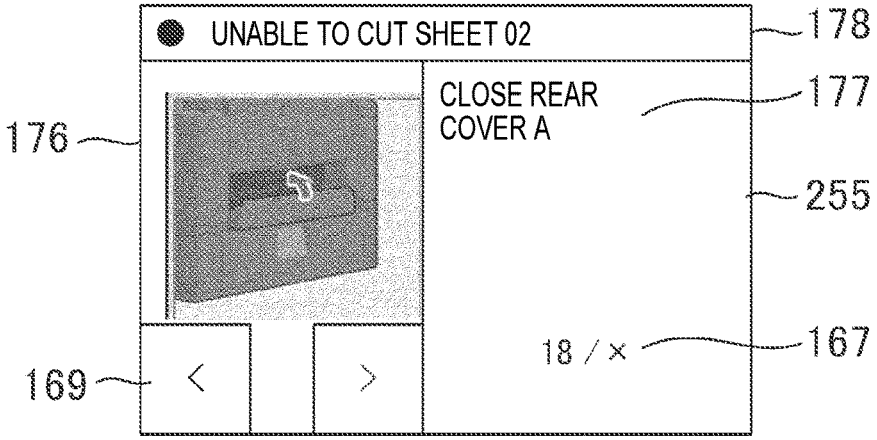

As illustrated in FIG. 19F, on a screen 255 shown next to the screen 254, the object 176 and the text 177 having the same contents as those of the screen 197 are shown. Accordingly, on the screen 255, the user is guided to close the first cover 70 and return the intermediate roller pair 41 to the original state.

Figure 20A:
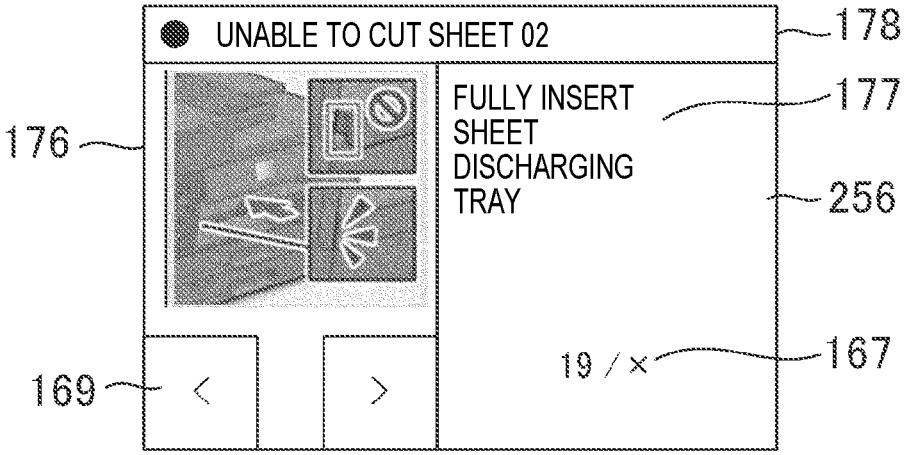
FIG. 20A and FIG. 20B illustrate examples of the screen indicating the sixth guidance displayed on the display 25.

As illustrated in FIG. 20A, on a screen 256 shown next to the screen 255, the object 176 and the text 177 having the same contents as those of the screen 214 are shown. Accordingly, on the screen 256, the user is guided to attach the discharge tray 24 to the housing 100.

Figure 20B:
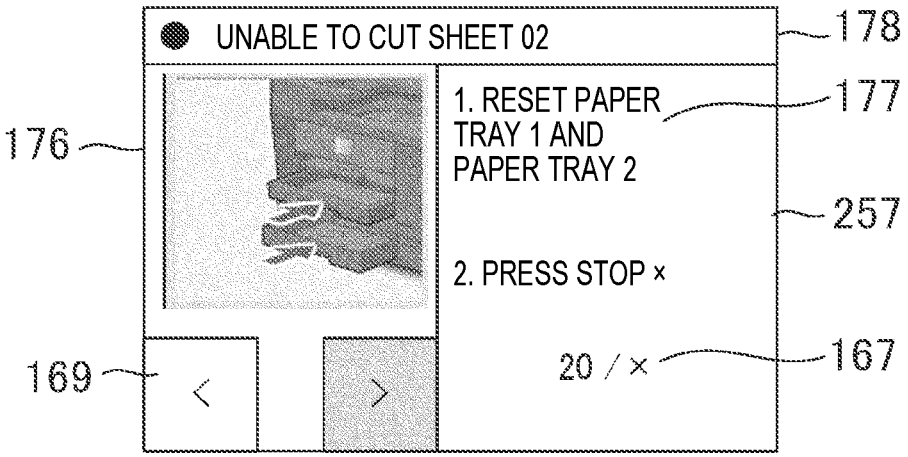

As illustrated in FIG. 20B, on a screen 257 shown next to the screen 256, the object 176 and the text 177 having the same contents as those of the screen 215 are shown. Accordingly, on the screen 257, the user is guided to attach the first tray 22 and the second tray 23 to the housing 100. Accordingly, the guide according to the sixth guidance ends.

Effects of Embodiment

According to the present embodiment, when the abnormality in the sheet is detected, it is possible to visually indicate the target location related to the work to restore the abnormality to the normal state. Since the operation for restoring to the normal state can be performed while seeing the display on the display 25, the operation is facilitated.

When the sheet fed to the conveyance path 18 by the feeding portion 3 is jammed in the conveyance path 18 before reaching the first registration sensor 61, the first registration sensor 61 does not detect the sheet. At this time, the user can easily understand the means for fixing the conveyance jam by the first guidance displayed on the display 25.

The user can easily grasp whether the conveyance jam is caused by the sheet wound in the roll shape or the conveyance jam is caused by the sheet in the stacked state.

The user can easily understand that the leading end of the sheet, which is folded or the like, is cut.

The user can easily understand that when the sheet wound in the roll shape is reset in the sheet feeding tray 20, the leading end of the sheet is set at the setting position, whereby the roll sheet 46 is ready to be fed.

The user can easily understand that when the sheet wound in the roll shape is reset in the sheet feeding tray 20, the side guides 30 are moved in accordance with the sheet.

When the sheet fed to the conveyance path 18 by the feeding portion 3 is jammed in the conveyance path 18 before reaching the second registration sensor 62, the second registration sensor 62 does not detect the sheet. At this time, the user can easily understand the means for fixing the conveyance jam by the second guidance displayed on the display 25.

The user can easily understand that the nipping of the sheet by the intermediate roller pair 41 is released by opening the first cover 70.

When the sheet fed to the conveyance path 18 by the feeding portion 3 is detected by the second registration sensor 62, the sheet is nipped and held by the conveyance roller pair 42. The media sensor 63 can determine whether the sheet is jammed downstream of the conveyance roller pair 42 in the conveyance direction 17. At this time, the user can easily understand the means for fixing the conveyance jam by the third guidance displayed on the display 25.

After the sheet is cut by the cutter 5 when the conveyance jam occurs, the user can easily understand the means for fixing the conveyance jam by the third guidance displayed on the display 25.

In a state in which the cutter carriage 78 does not return to the start point position 76 after the cutter 5 cuts the sheet, the user can understand that the cutter carriage 78 is returned to the start point position 76 by the fourth guidance.

In a state in which the cutter carriage 78 returns to the start point position 76 without cutting the sheet by the cutter 5, the user can understand that the sheet is cut by itself by the fifth guidance.

In a state in which the cutter 5 does not cut the sheet and the cutter carriage 78 does not return to the start point position 76, the user can understand that the cutter carriage 78 is returned to the start point position 76 and the sheet is cut by itself by the sixth guidance.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

Modifications

The controller 10 may drive the cutting motor 130 when the power supply of the image recording device 2 is turned on. When the cutter carriage 78 moves from the start point position 76 to the turning point position 77 and cannot return to the start point position 76, the controller 10 may display, on the display 25, an object display screen for manually returning the cutter carriage 78 to the start point position 76.

In addition, in the embodiment described above, the roll sheet 46 may be obtained by winding paper, a cloth, or a film.

Further, the roll sheet 46 is set in PAPER TRAY 2, but the present disclosure is not limited thereto. The roll sheet 46 may be set in the multipurpose tray 21. Regarding the roll sheet 46, the roll sheet 46 may be held (set) in a tray prepared separately from the housing 100 of the image recording device 2. The separately prepared tray may not be attached to the image recording device 2. Positions of the cutter carriage 78 and the intermediate roller pair 41 may be appropriately changed in accordance with a position of the roll sheet 46 set in the multipurpose tray 21.

Further, the side guides 30 may contact the left and right ends of the roll sheet 46 set in the recess 82.

In addition, in the embodiment described above, the media sensor 63 is set as the third sensor, but the present disclosure is not limited thereto. The third sensor may be, for example, the discharge sensor 64.

In the embodiment described above, the controller 10 may change a content of the notification of the conveyance jam, which is displayed on the display 25, depending on whether the conveyance jam is caused by the cut sheet fed from the first tray 22 or whether the conveyance jam is caused by the roll sheet 46 fed from the second tray 23. For example, the controller 10 may change the content of the notification of the conveyance jam, which is displayed on the display 25, based on information for identifying the sheet feeding tray 20 (the first tray 22 or the second tray 23) used for sheet feeding and the detection of the abnormality in the sheet. For example, the controller 10 may display "sheet jam" on the object display screen displayed on the display 25 based on information indicating that the first tray 22 is used for the sheet feeding and the detection of the abnormality. In addition, for example, the controller 10 may display "sheet jam (roll)" on the object display screen displayed on the display 25 based on information indicating that the second tray 23 is used for the sheet feeding and the detection of the abnormality.

In the embodiment described above, the controller 10 may execute a confirmation operation of checking whether the image recording device 2 is returned to the normal state after the display of the guidance data on the display 25 is completed. For example, the controller 10 may check whether an operation of each component of the image recording device 2 is in a normal state according to the selection and execution of the "x" icon 167 at the time of the ending of each guidance. Further, the controller 10 may display, on the display 25, a confirmation result of the operation of each component (whether the component is returned to the normal state). When the confirmation of the operation of each component by the controller 10 is normally completed, the operation of the image recording device 2 is returned to the normal state.

What is claimed is:

1. An image recording device comprising:

a conveyer configured to convey a sheet set in a first feeding tray in a state in which the sheet is wound in a roll shape to serve as a roll sheet;

a recording device configured to record an image on the sheet conveyed by the conveyer;

a display; and a controller, wherein the controller is configured to execute:

a process of stopping conveyance of the sheet in response to detection of an abnormality in the sheet after the conveyance of the sheet is started; and a process of causing the display to display thereon at least one object display screen which indicates, by an object, a target location to restore the abnormality in the sheet to a normal state.

2. The image recording device according to claim 1, wherein the controller causes the display to display thereon guidance data comprising the at least one object display screen and a notification indicating occurrence of the abnormality in the sheet.

3. The image recording device according to claim 1, wherein the abnormality in the sheet is a conveyance jam of the sheet.

4. The image recording device according to claim 3, further comprising:

a second feeding tray configured to allow a plurality of sheets to be set in a stacked state, wherein the controller is configured to cause the display to display thereon which of the first feeding tray or the second feeding tray the sheet causing the conveyance jam is fed from.

5. The image recording device according to claim 2, wherein the guidance data comprises a notification indicating occurrence of an abnormality in cutting of the sheet.

6. The image recording device according to claim 2, further comprising:

a first sensor configured to detect a presence or absence of the sheet at a first detection position in a conveyance path in which the sheet is conveyed from the first feeding tray by the conveyer, wherein the conveyer comprises:

a feeder configured to feed the sheet from the first feeding tray to the conveyance path; and a first roller pair configured to convey the sheet in the conveyance path, wherein the controller is configured to cause, in response to determining that the sheet does not reach the first detection position based on a signal obtained from the first sensor after driving the feeder, the display to display thereon a first guidance as the guidance data, the first guidance comprising the at least one object display screen, and wherein the at least one object display screen in the first guidance comprises:

a screen indicating that the first feeding tray is extracted from a housing; and a screen for resetting the roll sheet in the first feeding tray.

7. The image recording device according to claim 6, wherein the first guidance comprises a screen indicating that a leading end of the sheet is cut.

8. The image recording device according to claim 6, wherein the first feeding tray defines a passage extending from a setting position of the roll sheet in a feeding direction of the sheet, and wherein the first guidance comprises a screen indicating that the leading end of the sheet, which has entered the passage, is set at a setting position.

9. The image recording device according to claim 8, wherein the first feeding tray comprises a side guide configured to move in a direction intersecting the feeding direction to contact the sheet passing through the passage, and wherein the first guidance comprises a screen indicating that the side guide is moved.

10. The image recording device according to claim 6, further comprising:

a second roller pair provided downstream of the first roller pair in a conveyance direction in the conveyance path; and a second sensor provided upstream of the second roller pair in the conveyance direction in the conveyance path and configured to detect a presence or absence of the sheet at a second detection position in the conveyance path upstream of the second roller pair in the conveyance direction, wherein the controller is configured to cause the display to display thereon a second guidance as the guidance data, in response to determining, after driving the feeder, based on signals obtained from the first sensor and the second sensor that the sheet is nipped and held by the first roller pair but does not reach the second roller pair, and wherein the at least one object display screen in the second guidance comprises:

a screen indicating release of nipping of the sheet by the first roller pair;

the screen indicating that the first feeding tray is extracted from the housing; and a screen indicating that the roll sheet is reset in the first feeding tray.

11. The image recording device according to claim 10, wherein the housing comprises a first cover configured to open a part of the conveyance path to the outside, the part of the conveyance path at which the first roller pair is provided, wherein one roller of the first roller pair is configured to be separate, by moving together with the first cover, from another roller of the first roller pair, and wherein the at least one object display screen in the second guidance comprises a screen for opening the first cover to release the nipping of the sheet by the first roller pair.

12. The image recording device according to claim 10, further comprising:

a third sensor provided downstream of the second sensor in the conveyance direction in the conveyance path and configured to detect a presence or absence of the sheet at a third detection position in the conveyance path downstream of the second roller pair in the conveyance direction; and a discharge tray configured to be attached to and detached from the housing and support the sheet discharged from the conveyance path, wherein the controller is configured to cause the display to display thereon a third guidance as the guidance data, in response to:

determining, after driving the feeder, based on signals obtained from the first sensor and the second sensor, that the sheet is nipped and held by the first roller pair and the second roller pair; and determining, after driving the feeder, based on a signal obtained from the third sensor, a conveyance jam of the sheet occurs, and wherein the at least one object display screen in the third guidance comprises:

the screen indicating release of nipping of the sheet by the first roller pair;

a screen indicating that the discharge tray is detached from the housing to remove the sheet from the conveyance path;

a screen indicating that the first feeding tray is extracted from the housing; and a screen indicating that the roll sheet is reset in the first feeding tray.

13. The image recording device according to claim 12, further comprising:

a cutter carriage provided upstream of the first roller pair in the conveyance direction in the conveyance path and configured to move in a movement direction intersecting the conveyance direction;

a cutter mounted on the cutter carriage; and an input device, wherein the controller is configured to cause the display to display thereon the third guidance after moving the cutter carriage in accordance with a command input to the input device.

14. The image recording device according to claim 13, further comprising:

a fourth sensor configured to detect the cutter carriage being located at a first position, the first position being one end in the movement direction; and a fifth sensor configured to detect the cutter carriage being located at a second position, the second position being another end in the movement direction, wherein the housing further comprises a second cover configured to open the cutter carriage to the outside, wherein the controller is configured to cause the display to display thereon a fourth guidance as the guidance data in response to causing the cutter carriage to move and determining, based on signals obtained from the fourth sensor and the fifth sensor, that the cutter carriage is not moved to the first position after being moved from the first position to the second position, and wherein the at least one object display screen in the fourth guidance comprises a screen indicating that the second cover is opened and the cutter carriage is moved to the first position.

15. The image recording device according to claim 13, further comprising:

a fourth sensor configured to detect the cutter carriage being located at a first position, the first position being one end in the movement direction; and a fifth sensor configured to detect the cutter carriage being located at a second position, the second position being another end in the movement direction, wherein the housing further comprises a second cover configured to open the cutter carriage to the outside, wherein the controller is configured to cause the display to display thereon a fifth guidance as the guidance data in response to causing the cutter carriage to move and determining, based on signals obtained from the fourth sensor and the fifth sensor, that the cutter carriage is moved to the first position without being moved from the first position to the second position, and wherein the at least one object display screen in the fifth guidance comprises a screen indicating that the second cover is opened and the sheet is cut.

16. The image recording device according to claim 13, further comprising:

a fourth sensor configured to detect the cutter carriage being located at a first position, the first position being one end in the movement direction; and a fifth sensor configured to detect the cutter carriage being located at a second position, the second position being the other end in the movement direction, wherein the housing further comprises a second cover configured to open the cutter carriage to the outside, wherein the controller is configured to cause the display to display thereon a sixth guidance as the guidance data in response to causing the cutter carriage to move and determining, based on signals obtained from the fourth sensor and the fifth sensor, that the cutter carriage is not moved from the first position to the second position and is not moved to the first position, and wherein the at least one object display screen in the sixth guidance comprises a screen indicating that the second cover is opened, the cutter carriage is moved to the first position, and the sheet is cut.

* * * * *